US008047369B2

(12) United States Patent
Stahl

(10) Patent No.: US 8,047,369 B2
(45) Date of Patent: Nov. 1, 2011

(54) BREADBASKET WITH MERCHANDISER WINDOW AND FLAPS

(75) Inventor: Edward L. Stahl, Tyler, TX (US)

(73) Assignee: Orbis Canada Limited, Toronto, Ontario (CA)

( * ) Notice: Subject to any disclaimer, the term of this patent is extended or adjusted under 35 U.S.C. 154(b) by 1294 days.

(21) Appl. No.: 11/674,407

(22) Filed: Feb. 13, 2007

(65) Prior Publication Data

US 2007/0187276 A1 Aug. 16, 2007

Related U.S. Application Data

(63) Continuation-in-part of application No. 29/243,824, filed on Dec. 1, 2005, now Pat. No. Des. 598,684.

(51) Int. Cl.
*B65D 21/032* (2006.01)

(52) U.S. Cl. ..... 206/506

(58) Field of Classification Search ..... 206/506, 206/505; 220/6

See application file for complete search history.

(56) References Cited

U.S. PATENT DOCUMENTS

| | | | |
|---|---|---|---|
| 2,026,204 | A | 12/1935 | Andrews |
| 2,029,746 | A | 2/1936 | Tufts et al. |
| 2,061,414 | A | 11/1936 | Tufts et al. |
| 2,457,841 | A | 1/1949 | Smith et al. |
| 2,457,842 | A | 1/1949 | Smith et al. |
| 2,641,383 | A | 6/1953 | Coursey |
| 3,375,953 | A | 4/1968 | Miller, Jr. |
| 3,379,339 | A | 4/1968 | Asenbauer |
| 3,387,740 | A | 6/1968 | Bockenstette |
| 3,392,875 | A | 7/1968 | Bockenstette |
| 3,420,402 | A | 1/1969 | Frater et al. |
| 3,421,656 | A | 1/1969 | Asenbauer |
| 3,570,697 | A | 3/1971 | Langston |
| 3,659,743 | A | 5/1972 | Box |
| 3,752,352 | A | 8/1973 | Senecal |
| 3,780,905 | A | 12/1973 | Herolzer |
| D236,168 | S | 7/1975 | Johnson |
| 3,907,111 | A | 9/1975 | Levenhagen |

(Continued)

FOREIGN PATENT DOCUMENTS

| | | |
|---|---|---|
| CA | 892971 | 2/1972 |

(Continued)

OTHER PUBLICATIONS

Canadian Official Action for Canadian Patent Application No. 2,431,444 dated Dec. 12, 2005 (2 pages).

(Continued)

*Primary Examiner* — Stephen Castellano
(74) *Attorney, Agent, or Firm* — Ungaretti & Harris LLP

(57) ABSTRACT

A basket for shipping and displaying of baked products, wherein the basket comprises several features that substantially inhibit or reduce lateral motion, as well frontward and rearwards motion. Similar baskets can be stacked in a 0°, 90° or 180° configuration, and in the 0° and 180°, an upper basket can pivot and slide about a lower basket. Preferably, three window flaps are provided in one or more merchandising windows of the basket to allow consumers to retrieve baked product from an interior portion of the basket. The window flaps can moved from an open position to provide customers access to the tray, to a closed position to substantially inhibit or prevent product spillage when being transported or stored.

3 Claims, 38 Drawing Sheets

U.S. PATENT DOCUMENTS 3,934,724 A 1/1976 Johnson
3,951,265 A 4/1976 Carroll
3,952,903 A 4/1976 Sanders et al.
3,993,211 A 11/1976 Astle
4,000,817 A 1/1977 Sanders et al.
4,093,070 A 6/1978 Stahl
4,093,071 A 6/1978 Stahl et al.
4,102,453 A 7/1978 Carroll et al.
4,105,117 A 8/1978 Atkin et al.
4,106,623 A 8/1978 Carroll et al.
4,106,624 A 8/1978 Thurman
4,106,625 A 8/1978 Carroll et al.
4,109,791 A 8/1978 Clipson et al.
4,189,052 A 2/1980 Carroll et al.
4,194,626 A 3/1980 Boller
4,211,327 A 7/1980 Stahl et al.
D258,050 S 1/1981 Cornou
4,247,004 A 1/1981 Bird
4,316,154 A 2/1982 Krause
4,320,837 A 3/1982 Carroll et al.
4,391,369 A 7/1983 Stahl et al.
4,423,813 A 1/1984 Kreeger et al.
4,426,001 A 1/1984 Stahl et al.
4,440,302 A 4/1984 Ehrman et al.
4,466,541 A 8/1984 Tabler et al.
4,520,928 A 6/1985 Wilson
4,523,681 A 6/1985 Kreeger
4,573,577 A 3/1986 Miller
4,577,759 A 3/1986 Kreeger
4,600,103 A 7/1986 Tabler
4,601,393 A 7/1986 Veenman et al.
RE32,223 E 8/1986 Kreeger et al.
4,619,366 A 10/1986 Kreeger
4,619,371 A 10/1986 Rehrig
4,643,310 A 2/1987 Deaton et al.
4,671,411 A 6/1987 Rehrig et al.
D292,634 S 11/1987 Chabot
4,714,169 A * 12/1987 Keenan et al. ..... 220/8
4,848,578 A 7/1989 Schafer
4,905,833 A 3/1990 Kreeger et al.
4,917,255 A * 4/1990 Foy et al. ..... 220/6
4,936,458 A 6/1990 Tabler et al.
4,960,207 A 10/1990 Tabler et al.
4,982,844 A 1/1991 Madan et al.
5,035,326 A 7/1991 Stahl
D319,908 S 9/1991 Stahl
D320,298 S 9/1991 Apps et al.
5,163,587 A 11/1992 Apps et al.
D343,042 S 1/1994 Apps et al.
D344,387 S 2/1994 Holliday
5,287,966 A 2/1994 Stahl
D348,138 S 6/1994 Lang-Ree et al.
D348,342 S 6/1994 Lang-Ree et al.
D348,343 S 6/1994 Lang-Ree et al.
D350,028 S 8/1994 Apps
D350,437 S 9/1994 Apps et al.
5,344,021 A 9/1994 Rose
5,344,022 A 9/1994 Stahl
5,372,257 A 12/1994 Beauchamp et al.
D354,167 S 1/1995 Stahl
5,377,858 A 1/1995 Morris, Sr.
5,415,293 A 5/1995 Ackermann et al.
5,469,986 A 11/1995 Jang
5,494,163 A 2/1996 Apps
D374,555 S 10/1996 McMath
5,582,296 A 12/1996 Beauchamp et al.
5,609,254 A 3/1997 Loftus et al.
D379,718 S 6/1997 Raghunathan
D381,203 S 7/1997 Ackermann et al.
D384,975 S 10/1997 Jackson
5,711,444 A * 1/1998 Meacham et al. ..... 220/6
5,735,431 A 4/1998 LeTrudet
5,752,602 A 5/1998 Ackermann et al.
5,772,033 A 6/1998 Loftus et al.
D398,448 S 9/1998 Zanni
D400,711 S 11/1998 Hwang
D401,066 S 11/1998 Ackermann
D401,412 S 11/1998 LeTrudet
5,860,527 A 1/1999 Frankenberg et al.
5,881,902 A 3/1999 Ackermann
5,896,987 A 4/1999 Bettenhausen
5,950,836 A * 9/1999 Iwamoto et al. ..... 206/711
5,975,324 A 11/1999 Schmitt
5,992,673 A 11/1999 Hwang
6,015,056 A 1/2000 Overholt et al.
D420,219 S 2/2000 Elvin-Jensen et al.
6,036,049 A 3/2000 Hwang
D423,217 S 4/2000 Varfeldt
D424,299 S 5/2000 Varfeldt
D429,565 S 8/2000 Aiken
6,098,827 A 8/2000 Overholt et al.
6,138,863 A 10/2000 Aiken
D436,729 S 1/2001 Aiken
D439,049 S 3/2001 Koefelda
6,209,742 B1 4/2001 Overholt et al.
6,250,490 B1 6/2001 Loftus
6,260,706 B1 7/2001 Koefelda
D446,017 S 8/2001 Koefelda
D446,392 S 8/2001 Overholt et al.
D446,939 S 8/2001 Koefelda
6,273,259 B1 8/2001 Stahl
6,293,418 B1 9/2001 Ogden et al.
6,308,858 B1 10/2001 Koefelda
D452,614 S 1/2002 Overholt
6,338,181 B1 1/2002 Hwang
6,386,388 B1 5/2002 Overholt
6,394,274 B1 5/2002 Cheeseman
D458,753 S 6/2002 Overholt et al.
6,398,054 B1 6/2002 Overholt et al.
6,405,888 B1 6/2002 Overholt et al.
6,409,041 B1 6/2002 Overholt et al.
D460,619 S 7/2002 Koefelda
D463,667 S 10/2002 Hwang
6,460,717 B1 10/2002 Smyers et al.
D478,421 S 8/2003 Overholt et al.
6,601,724 B1 8/2003 Koefelda et al.
6,607,199 B2 8/2003 Gruber
6,631,822 B1 10/2003 Overholt
6,843,386 B2 1/2005 Raghunathan et al.
6,857,642 B2 2/2005 Gruber
6,863,180 B2 3/2005 Apps et al.
6,880,705 B2 4/2005 Otting et al.
6,886,710 B2 5/2005 Verna et al.
6,899,242 B2 5/2005 Overholt et al.
6,918,502 B1 7/2005 Overholt et al.
6,918,508 B2 7/2005 Hwang
6,994,216 B2 2/2006 Wong
7,017,766 B2 3/2006 Hsu et al.
7,044,319 B2 5/2006 Overholt et al.
7,048,134 B1 5/2006 Hagan
7,048,135 B2 5/2006 Smyers et al.
7,059,489 B2 6/2006 Apps et al.
7,063,210 B2 6/2006 Smyers et al.
7,063,223 B2 * 6/2006 Iwahara et al. ..... 220/6
7,086,555 B2 8/2006 Overholt et al.
7,100,786 B2 9/2006 Smyers
7,104,414 B2 9/2006 Apps et al.
7,104,553 B2 9/2006 Gruber
7,128,231 B2 10/2006 Overholt
7,195,127 B2 3/2007 Hsu et al.
7,264,122 B2 9/2007 Koefelda et al.
2002/0056717 A1 5/2002 Hwang
2002/0130132 A1 9/2002 Overholt
2002/0148842 A1 10/2002 Overholt et al.
2002/0153682 A1 10/2002 Gruber
2002/0158067 A1 10/2002 Overholt et al.
2003/0024845 A1 2/2003 Smyers et al.
2003/0042255 A1 3/2003 Smyers et al.
2003/0116564 A1 6/2003 Overholt et al.
2003/0132228 A1 7/2003 Apps et al.
2003/0155275 A1 8/2003 Apps et al.
2003/0222081 A1 12/2003 Apps et al.
2003/0230510 A1 12/2003 Aiken et al.
2004/0020821 A1 2/2004 Koefelda et al.
2004/0050742 A1 3/2004 Gruber
2004/0060844 A1 4/2004 Stahl
2004/0069780 A1 4/2004 Apps et al.

| | | | |
|---|---|---|---|
| 2004/0099662 | A1 | 5/2004 | Overholt |
| 2004/0104231 | A1 | 6/2004 | Hassell et al. |
| 2004/0144680 | A1 | 7/2004 | Stahl |
| 2004/0155048 | A1 | 8/2004 | Aiken |
| 2004/0178197 | A1 | 9/2004 | Hsu et al. |
| 2004/0182858 | A1 | 9/2004 | Smyers |
| 2004/0195139 | A1 | 10/2004 | Wong |
| 2004/0226945 | A1 | 11/2004 | Hsu et al. |
| 2005/0140107 | A1 | 6/2005 | Gruber |
| 2005/0183980 | A1 | 8/2005 | Fernandez et al. |
| 2006/0011627 | A1 | 1/2006 | Overholt et al. |
| 2006/0070906 | A1 | 4/2006 | Verna et al. |
| 2006/0180491 | A1 | 8/2006 | Zephir et al. |
| 2006/0186123 | A1 | 8/2006 | Baltz et al. |
| 2006/0196800 | A1 | 9/2006 | Baltz |
| 2006/0231555 | A1 | 10/2006 | Smyers et al. |
| 2006/0237341 | A1 | 10/2006 | McDade |
| 2007/0056874 | A1 | 3/2007 | Apps et al. |
| 2007/0144931 | A1 | 6/2007 | McTavish et al. |
| 2007/0175790 | A1 | 8/2007 | Fernandez et al. |
| 2007/0187276 | A1 | 8/2007 | Stahl |

FOREIGN PATENT DOCUMENTS

| | | |
|---|---|---|
| CA | 1273881 | 9/1990 |
| CA | 2032012 | 6/1991 |
| CA | 2129617 | 2/1995 |
| CA | 2130973 | 3/1995 |
| CA | 2212239 | 8/1996 |
| CA | 2484830 | 8/1996 |
| CA | 2313137 | 7/1999 |
| CA | 2296895 | 7/2000 |
| CA | 2326118 | 5/2001 |
| CA | 2387491 | 5/2001 |
| CA | 2389010 | 5/2001 |
| CA | 2392265 | 6/2001 |
| CA | 2395367 | 7/2001 |
| CA | 2397522 | 8/2001 |
| CA | 2406099 | 10/2001 |
| CA | 2408247 | 11/2001 |
| CA | 2384941 | 1/2002 |
| CA | 2421595 | 3/2002 |
| CA | 2426949 | 5/2002 |
| CA | 2367649 | 7/2002 |
| CA | 2442723 | 10/2002 |
| CA | 2455355 | 2/2003 |
| CA | 2458773 | 3/2003 |
| CA | 2472360 | 7/2003 |
| CA | 2475531 | 9/2003 |
| CA | 2485544 | 12/2003 |
| CA | 2448920 | 7/2004 |
| CA | 2431444 | 12/2004 |
| EP | 370771 | 5/1990 |
| FR | 2678585 | 1/1993 |
| GB | 2129401 | 5/1984 |
| GB | 2137167 | 10/1984 |
| GB | 2141778 | 1/1985 |
| GB | 2171980 | 9/1986 |
| GB | 2180821 | 4/1987 |
| TW | 338405 | 8/1998 |
| TW | 372539 | 10/1999 |
| WO | 0027716 | 5/2000 |
| WO | 0066440 | 11/2000 |
| WO | 0185558 | 11/2001 |

OTHER PUBLICATIONS

Canadian Official Action for Canadian Patent Application No. 2,408,247 dated Nov. 24, 2005 (3 pages).

International Preliminary Examination Report dated Sep. 10, 2002, issued in PCT/CA01/00640 (11 pages).

Correspondence regarding European Patent Application No. 01 931 236.6-2308 dated May 27, 2004 (2 pages).

Correspondence regarding European Patent Application No. 01 931 236.6-2308 dated Jun. 2, 2005 (3 pages).

* cited by examiner

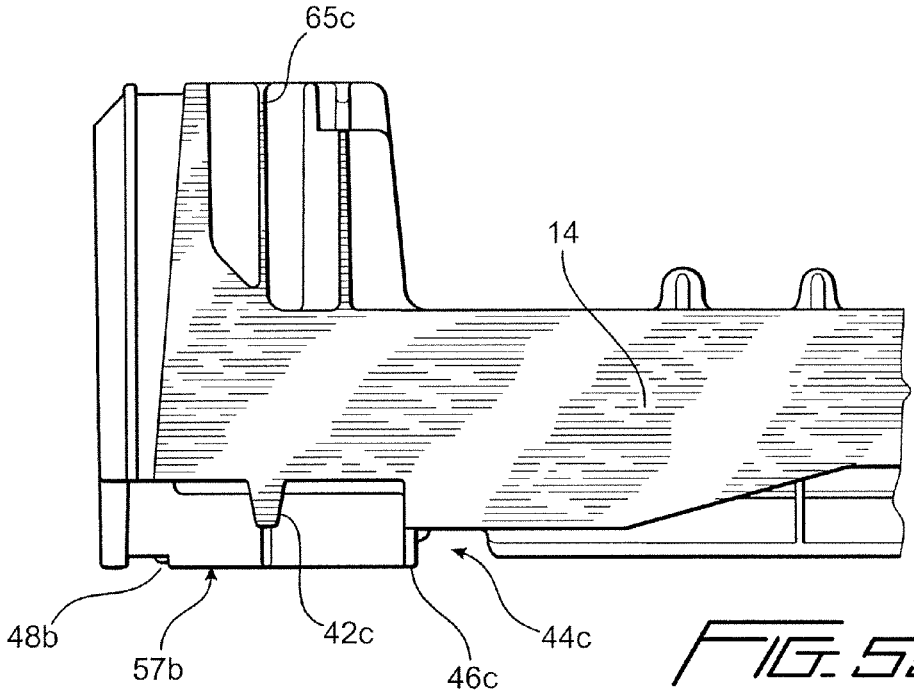
FIG. 59
FIG. 60
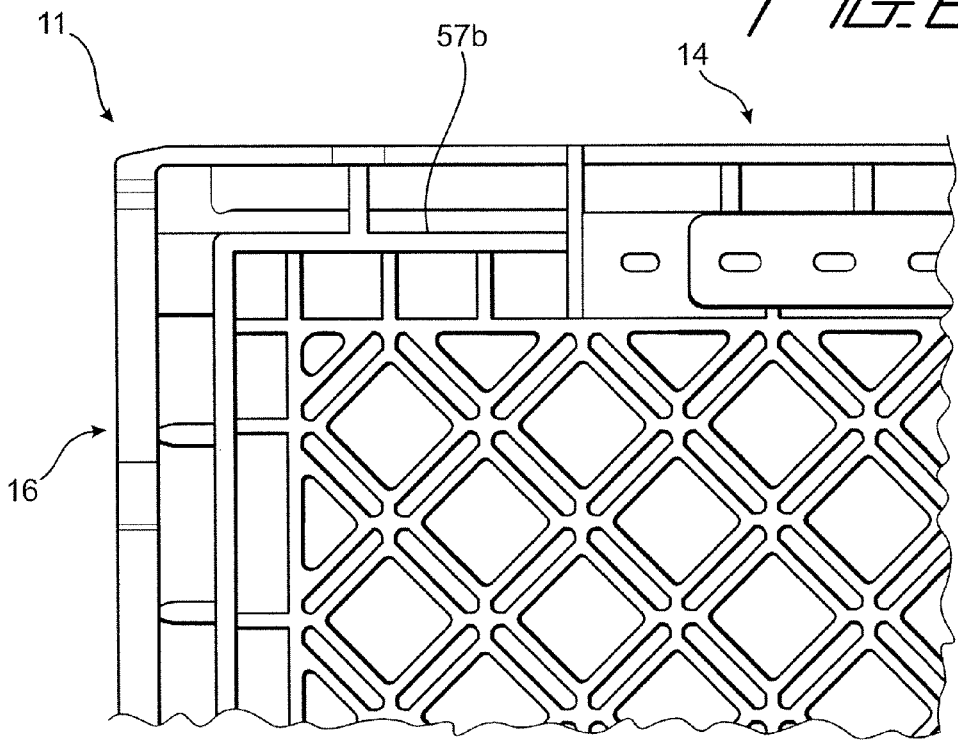

BREADBASKET WITH MERCHANDISER WINDOW AND FLAPS

CLAIM FOR PRIORITY

This application claims benefit under 35 U.S.C. §120 from co-pending U.S. Non-provisional Design patent application, Ser. No. 29/243,824, filed Dec. 1, 2005, the entire contents of which are hereby incorporated herein by reference.

This application is a CIP of Ser. No. 29/243,824 filed Dec. 1, 2005, now design Pat. No. D598,684.

BACKGROUND OF THE INVENTION

1. Field of the Invention

The invention relates to stacking breadbaskets, and storing and retrieving breadbaskets. More particularly, the invention relates to a system and method for storing baked products from the breadbasket in a retail environment such that consumers can readily access the stored baked product, but during transit, loss of the baked good(s) is substantially reduced or eliminated.

2. Background Art

It is now well-known in the operation of bakeries to provide a rigid supporting container or basket to protect baked good(s) from damage incident to handling and transport thereof. In most recent years, bakeries have produced a variety of different baked good(s), such as loaves, cakes, and hamburger buns. Each of these products is conventionally produced in different product heights, resulting in the need to economically protect those goods while avoiding the necessity for having different baskets for each product.

As a result, there have been developed a number of different multi-level stacking baskets which are advantageously designed to stack or nest at different levels according to the height of the product contained therein. For example, a second basket could be superposed over a first basket at a first, lower level for hamburger buns, and at a second, upper level for loaves of bread. The availability of multi-level baskets has reduced the need for an increased inventory of specialty baskets for each product. Examples of different stacking baskets include those shown in the following: U.S. Pat. No. 3,387,740 to Bockenstette; U.S. Pat. No. 3,420,402 to Frater et al.; U.S. Pat. No. 3,392,875 to Bockenstette; U.S. Pat. No. 4,093,070 to Stahl; U.S. Pat. No. 4,106,623 to Carroll et al.; U.S. Pat. No. 4,106,624 to Thurman; U.S. Pat. No. 4,106,625 to Carroll et al.; U.S. Pat. No. 4,189,052 to Carroll et al.; U.S. Pat. No. 4,211,327 to Stahl et al.; U.S. Pat. No. 4,320,837 to Carroll et al.; U.S. Pat. No. 4,440,302 to Ehrman et al.; U.S. Pat. No. 4,426,001 to Stahl et al.; U.S. Pat. No. 4,520,928 to Wilson; U.S. Pat. No. 4,523,681 to Kreeger; U.S. Pat. No. 4,600,103 to Tabler; U.S. Pat. No. 4,601,393 to Veenman et al.; U.S. Pat. No. 4,619,366 to Kreeger; U.S. Pat. No. 4,643,310 to Deaton et al.; and U.S. Pat. No. 4,759,451 to Apps.

As one of ordinary skill in the art of the present invention can appreciate, multi-level baskets or containers that are used to transport the baked products can also be used to display them in grocery stores, so that consumers can obtain the desired product directly from the container used to ship the baked product to the grocery store. A need quickly arose, however, for there to be an improvement to the known baked products container. The known baked products shipping containers had two equally high sidewalls and two equally high end walls. This contained the baked product during shipping, but made it difficult for the consumer to access the baked product once displayed in the grocery store. The consumer could access the upper filled container with relatively little effort, but once the upper shipping container was emptied, then the consumer either had to move the empty container out of the way, or get an employee of the grocery store to assist in moving the empty container from the stack of shipping containers with baked product in them. Only then could consumers access the baked good(s) remaining in the lower shipping containers. The problem with this approach, however, was that either the grocery store employees were kept busy moving empty storage containers, or the consumers moved the empty containers themselves, leaving the shipping containers strewn about the floor, or, the consumer would select an alternative product or even a different store.

An improvement was made, then, to the baked product shipping container. A window was added to one of the sidewalls, allowing the consumer access to the baked product. A window is a cut away portion of the sidewall, providing the consumer room to stick their hand and/or arm through the sidewall to reach baked good(s) throughout the entire area of the shipping container. Consumers could obtain the desired baked product, generally starting with the upper shipping container, and when empty, proceed to the lower levels. Now the consumer could access the baked product without having to move empty shipping containers stacked on top of the lower ones that still contained the baked product. While this was a significant improvement over the previously known baked product shipping container, a problem still existed. When transporting the shipping containers filled with baked good(s) from a storage area to the display/purchase area, baked good products would slide out the window area, and fall to the floor, where they would damaged and have to be discarded. This wasted product cost the producers and/or grocers a substantial amount of money in both lost product and labor to clean up the spilled baked product.

Thus, a need exists for a breadbasket shipping container that substantially inhibits or prevents baked product from spilling out of the container when being transported in the shipping container, yet still allows consumers easy access to the baked good(s) for purchase.

SUMMARY OF THE INVENTION

It is therefore a general object of the invention to provide a breadbasket shipping container that will obviate or minimize problems of the type previously described.

According to a first aspect of the present invention, a basket for shipping and storing goods is provided, comprising a base; a left sidewall and right sidewall, each of the left sidewall and the right sidewall joined to and substantially perpendicular to the base, and each of the left sidewall and the right sidewall substantially parallel to each other; a front wall and rear wall, wherein, the front wall and rear wall are joined to, and substantially perpendicular to, the base, and further wherein the front wall and rear wall are substantially parallel to each other, and further wherein the front wall and rear wall are joined to, and substantially perpendicular to, the left sidewall and right sidewall, and still further wherein, the front wall and rear wall each include a top surface, and wherein, the front wall further includes a window flap area configured to allow a user access to the stored goods, and wherein the front wall further includes a movable window flap located in the window flap area, wherein the movable window flap is movable between a closed position for shipping and an open position for display and retrieval of stored goods.

According to a second aspect of the present invention a method for displaying goods in a basket is provided, comprising storing the goods in one or more baskets, wherein each of the one or more baskets includes: a window flap area located in a front wall of the basket; and a window flap in the window flap area; moving the movable window flap from an open position to a closed position such that the goods are substantially inhibited from spilling out of the one or more of the baskets; stacking one or more of the baskets in a first stacking configuration in an area accessible by consumers of the goods; and moving the movable flap window from the closed position to the open position as necessary to obtain access to the goods.

According to a third aspect of the present invention, a basket for shipping and storing goods is provided, comprising a base; a left sidewall and right sidewall, each of the left sidewall and the right sidewall joined to and substantially perpendicular to the base, and each of the left sidewall and the right sidewall substantially parallel to each other; a front wall and rear wall, wherein, the front wall and rear wall are joined to, and substantially perpendicular to, the base, and further wherein the front wall and rear wall are substantially parallel to each other, and further wherein the front wall and rear wall are joined to, and substantially perpendicular to, the left sidewall and right sidewall, and still further wherein, the front wall and rear wall each include a top surface, and wherein the front wall further includes a first window flap area configured to allow a user access to the goods, and wherein the front wall further includes a movable bail arm located in the window flap area, wherein the movable bail arm is movable from a substantially closed position for shipping and a substantially open position for retrieval of the goods.

According to a fourth aspect of the present invention, a basket for shipping and storing goods is provided, comprising a base; a left sidewall and right sidewall, each of the left sidewall and the right sidewall joined to and substantially perpendicular to the base, and each of the left sidewall and the right sidewall substantially parallel to each other; a front wall and rear wall, wherein, the front wall and rear wall are joined to, and substantially perpendicular to, the base, and further wherein the front wall and rear wall are substantially parallel to each other, and further wherein the front wall and rear wall are joined to, and substantially perpendicular to, the left sidewall and right sidewall, and still further wherein, the front wall and rear wall each include a top surface, and wherein the front wall further includes a first window flap area configured to allow a user access to the goods, and wherein the front wall further includes a movable side flap located in the window flap area, wherein the movable side flap is movable from a substantially closed position for shipping and a substantially open position for retrieval of goods.

According to a fifth aspect of the present invention, a basket for shipping and storing goods is provided, comprising a base; a left sidewall and right sidewall, each of the left sidewall and the right sidewall joined to and substantially perpendicular to the base, and each of the left sidewall and the right sidewall substantially parallel to each other; a front wall and rear wall, wherein, the front wall and rear wall are joined to, and substantially perpendicular to, the base, and further wherein the front wall and rear wall are substantially parallel to each other, and further wherein the front wall and rear wall are joined to, and substantially perpendicular to, the left sidewall and right sidewall, and still further wherein, the front wall and rear wall each include a top surface, and wherein, the front wall further includes a plurality of front wall stacking support areas configured to provide additional stacking support for increased loads when an upper, substantially similar basket containing goods is stacked upon a lower basket, wherein each of the plurality of front wall stacking support areas includes a first load bearing channel and a second load bearing channel, the first and second load bearing channels separated by a first load bearing ridge located on an outer portion of the front wall, a second load bearing ridge located on an outer portion of the front wall and adjacent to the second load bearing channel, and a third load bearing ridge located on an inner wall portion of the front wall and substantially directly opposite to the second load bearing ridge.

According to a sixth aspect of the present invention, a basket for shipping and storing goods is provided, comprising a base; a left sidewall and right sidewall, each of the left sidewall and the right sidewall joined to and substantially perpendicular to the base, and each of the left sidewall and the right sidewall substantially parallel to each other; a front wall and rear wall, wherein, the front wall and rear wall are joined to, and substantially perpendicular to, the base, and further wherein the front wall and rear wall are substantially parallel to each other, and further wherein the front wall and rear wall are joined to, and substantially perpendicular to, the left sidewall and right sidewall, and still further wherein, the front wall and rear wall each include a top surface, and wherein, the rear wall further includes a plurality of rear wall stacking support areas configured to provide additional stacking support for increased loads when an upper, substantially similar basket containing goods is stacked upon a lower basket, wherein each of the plurality of rear wall stacking support areas includes a third load bearing channel and a fourth load bearing channel, the third and fourth load bearing channels separated by a fourth load bearing ridge located on an outer portion of the rear wall, a fifth load bearing ridge located on an outer portion of the real wall and adjacent to the fourth load bearing channel, and a sixth load bearing ridge located on an inner wall portion of the rear wall and substantially directly opposite to the fifth load bearing ridge.

BRIEF DESCRIPTION OF THE DRAWINGS

The novel features and advantages of the present invention will best be understood by reference to the detailed description of the preferred embodiments which follows, when read in conjunction with the accompanying drawings, in which:

FIG. 59 illustrates view of a rear wall of the basket shown in FIG. 56.

FIG. 60 illustrates a close up bottom plan view of the basket shown in FIG. 56.

DETAILED DESCRIPTION OF THE PREFERRED EMBODIMENTS

Figure 1:
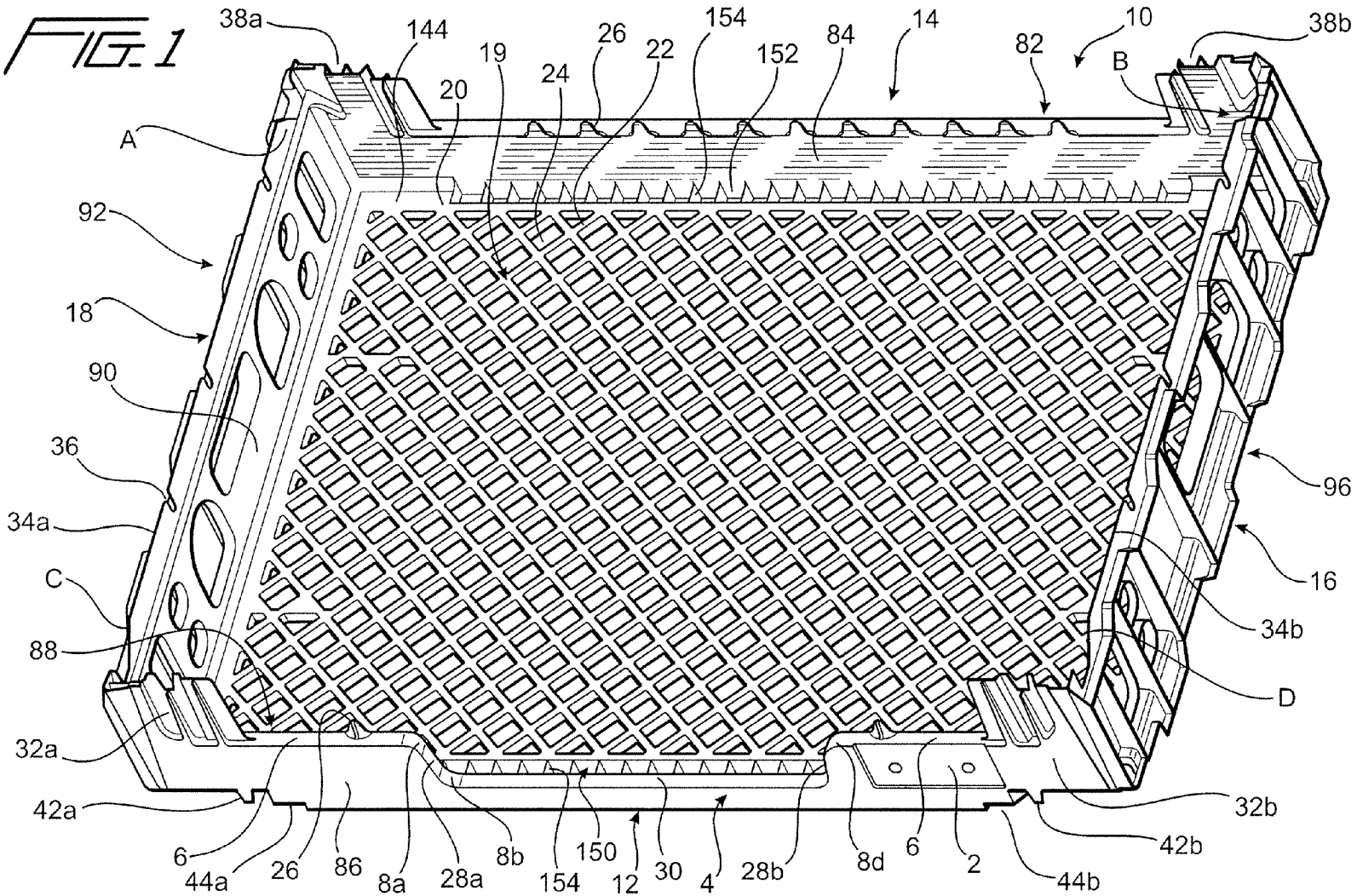
FIG. 1 illustrates a top perspective view of a breadbasket (basket) for use with a merchandiser flap according to an embodiment of the present invention.

The various features of the preferred embodiments will now be described with reference to the drawing figures, in which like parts are identified with the same reference characters. The following description of the presently contemplated best mode of practicing the invention is not to be taken in a limiting sense, but is provided merely for the purpose of describing the general principles of the invention.

I. Introduction

According to a first aspect of the present invention with respect to FIG. 1, a bread basket (basket) 10 is provided comprising several stacking, anti-sliding, and merchandiser window (window) features. Stacking features of basket 10 comprise the capability to stack two or more like baskets 10 in a 0° stacking configuration (wherein each like basket 10 is oriented the same way (i.e. front wall-to-front wall etc.), to stack two or more like baskets in a 90° stacking configuration (wherein an upper basket 10' is placed on a lower basket 10 such that the left sidewall of the upper basket faces the same direction of the front wall of the lower basket (though, as one of ordinary skill in the art of present invention can readily appreciate, the right sidewall of the upper basket can face the same direction as the front wall of the lower basket), and to stack two or more baskets in a 180° stacking configuration (wherein the upper basket is orientated such that the rear wall of the upper basket is aligned with the front wall of the lower basket (or vice versa)).

When two or more like baskets are stacked in any of the three stacking configurations, several features enable such stacking, substantially preventing or inhibiting sliding, and provide the ability to pivot, rotate and slide an upper basket with respect to a lower basket. Stacking features comprise left and right side wall stacking feet 54,52, left and right side wall lower stacking receptacles 122, 102, left and right sidewall stacking projections 126, 106, and left and right upper stacking receptacles 124, 104. Further stacking and slide-inhibiting features comprise side wall ridges 34*a, b*, left and right side wall ridge grooves 37, 36, 180° first stacking receptacle 128, 180° front stacking receptacle 130, 180° second stacking receptacles 134, left and right base channels 138, 136, base channel projections 142, 140, teeth 26, 90° stacking barrier 46, 90° stacking receptacle 46, inner stacking lateral rail 45, inner stacking forward rail 50, inner stacking rearward rail 56, rear wall lower mounting support 58, front wall stacking support area 32, rear wall stacking support area 38, and front wall lower mounting support 42.

According to another aspect of the present invention, several window flaps are provided to substantially prevent or reduce the loss of baked products container within the basket 10 during transit. These window flaps comprise bail arm (168) (see FIGS. 27-36), lift gate (184) (see FIGS. 37-41), and side flap (196) (see FIGS. 42-52).

II. Basket 10—General Description

Referring now to the drawings, a multi-level breadbasket (basket) 10 with a merchandiser window (window) 4 is shown in FIG. 1. Basket 10 comprises a front wall 12, a rear wall 14, a right side wall 16, a left side wall 18 and a base 20. Preferably, the right side wall 16 and left side wall 18 are substantially mirror images of one another, whereby similarly configured baskets 10' may be placed on basket 10 in different stacking orientations to enable alternative high-level stacking or nesting. The basket 10 hereof can advantageously be constructed by injection molding whereby the entire basket 10 may be formed as a unitary article from a synthetic resin such as polyethylene. Other materials that can be used to manufacture basket 10 comprise polypropylene co-polymer. The front wall 12 has, among other components, a window 4 through which consumers can retrieve baked good(s) when loaded thereupon. According to an exemplary embodiment of the present invention, window 4 can comprise one of several different exemplary flaps to substantially inhibit or prevent inadvertent loss of baked good(s) during transport of the baskets 10 loaded with the same. The front wall 12, window 4 and flaps shall all be discussed in greater detail below. Further, basket 10 comprises interior area 19 that is an area substantially enclosed by base 20, front wall 12, rear wall 14, left sidewall 18 and right sidewall 16.

As discussed above basket 10 can be stacked with one or more like baskets 10' by use of the various stacking features discussed in greater detail below. When two or more baskets 10 are stacked such that they all face the same way, that is referred to as a 0° stacking configuration. The "0°" refers to the angle upper basket 10' has been rotated with respect to lower basket 10. For the purpose of simplifying this discussion, the view of lower basket 10 will be that of front wall 12. As one of ordinary skill in the art can appreciate, however, this need not always be the case. In a 90° stacking configuration, upper basket 10' has been rotated 90° counter-clockwise, and stacked on lower basket 10. As one of ordinary skill in the art can appreciate, of course, upper basket 10' can also be rotated 90° clockwise and stacked on lower basket 10. In a 180° stacking configuration, upper basket 10' is rotated 180° and stacked on lower basket 10.

A. Front Wall 12

Referring now to FIGS. 1, 2, 3, and 4, a front wall 12 is shown, wherein the front wall 12 extends substantially vertically from base 20, and is substantially perpendicular to left and right sidewalls 18, 16. Preferably, front wall 12 is substantially parallel to rear wall 14, which too extends substantially vertically from base 20, and is substantially perpendicular to left and right sidewalls 18, 16. Front wall 12 and rear wall 14 are substantially similar in terms of height and length, and comprise certain similar features, but also comprise many different features according to several exemplary embodiments of the present invention, as discussed herein.

Front wall 12 comprises a front wall inner surface 86 and front wall outer surface 88, between which are spaced a plurality of ribs 80. Ribs 80 can be seen in FIG. 11, which is a bottom view of the basket 10, and several of the ribs 80 extend to the bottom of front wall channel 150, and several of the ribs 80 extend only partially down from the bottom of the window 4. Front wall channel 150 is discussed below in regard to base 20. Front wall 12 preferably further comprises a front wall stacking support area 32a, b, window 4, and a plurality of teeth 26. Teeth 26 substantially inhibits or prevents baked good(s) from sliding out of the basket 10 when they are stacked two layers high within basket 10. Front wall 12 preferably further comprise a tag holder 2, which, according to an exemplary embodiment of the present invention, can hold a radio frequency (RF) identification (RFID) tag (not shown). RFID tags are well known to those of ordinary skill in the art, and detailed discussion of them has been omitted for the purpose of brevity. Tag holder 2 preferably comprises a recessed area from the front wall outer surface 86, is substantially rectangular, and further comprises a plurality of mounting holes 40*a, b*. Front wall 12 preferably further comprises, according to an exemplary embodiment of the present invention, several features that assist in stacking basket 10 with other like baskets 10' in 0°, 90°, and 180° stacking configurations. The stacking features shall be discussed here generally, and in greater detail below.

Figure 2:
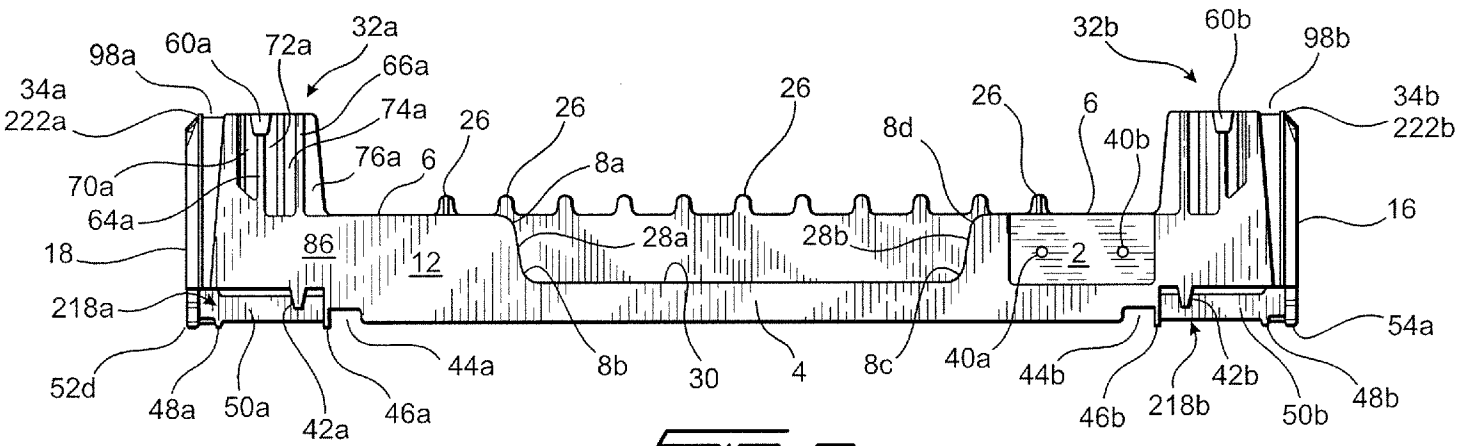
FIG. 2 illustrates a front view of the basket shown in FIG. 1.

As seen in FIGS. 1 and 2, front wall 12 preferably comprises several stacking features which are generally located on the lower left and lower right portions of front wall 12. Stacking features that are located at the lower portions of the front wall 12 comprise, according to an exemplary embodiment of the present invention, inner stacking forward rails 50*a, b*, front wall lower mounting supports 42*a, b*, 90° stacking receptacles 44*a, b*, 90° stacking barriers 46*a, b*, and inner stacking lateral rails 48*a, b*. Seen also in FIG. 2 are left sidewall stacking feet 52*d*, and right sidewall stacking foot 54*a*. Stacking features that are located in the upper portions of front wall 12 comprise lateral rail channel 98*a, b*, sidewall ridges 34*a, b*, and front wall stacking support areas 32*a, b*.

Figure 3:
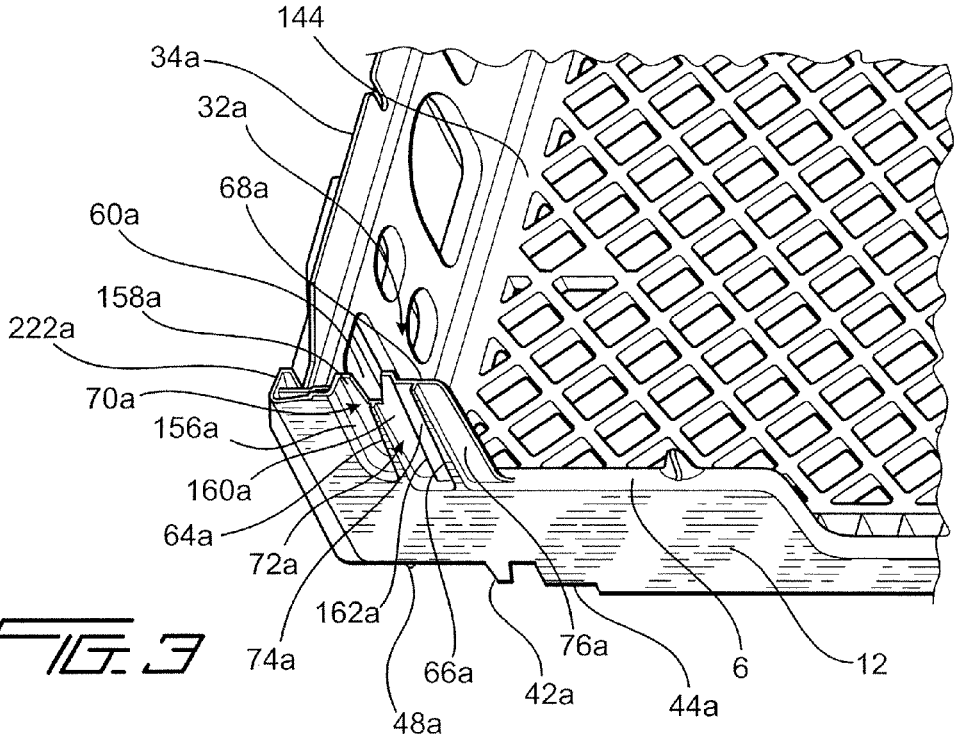
FIG. 3 illustrates an expanded perspective view of a front left corner of the basket shown in FIG. 1.
Figure 4:
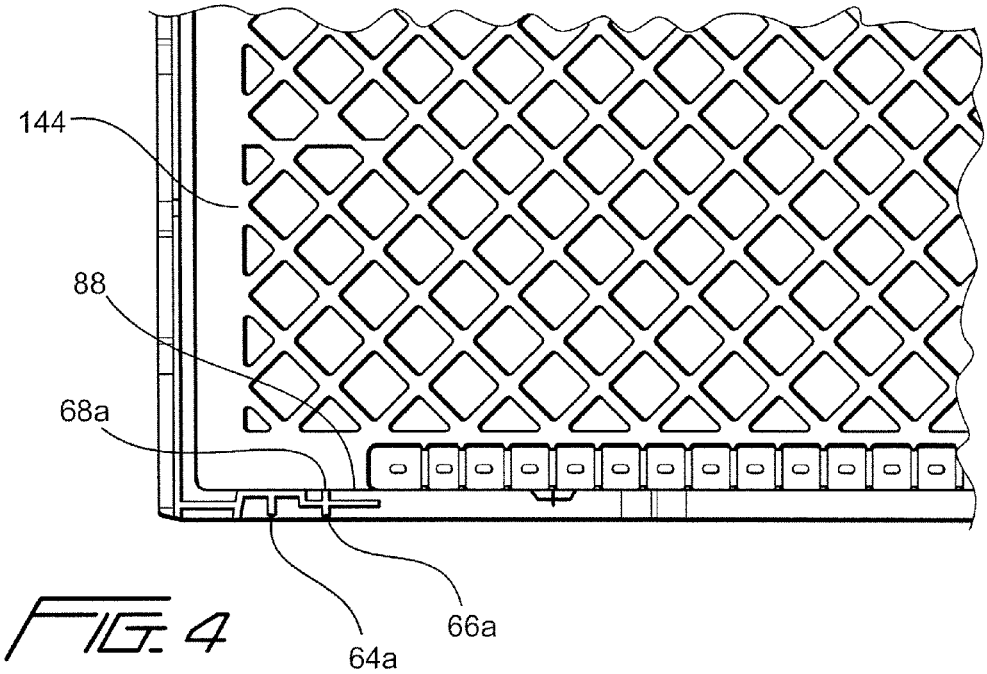
FIG. 4 illustrates a top view of the front left corner of the basket shown in FIG. 1.

Front wall stacking support areas 32*a, b* are located on the upper left portion of front wall 12 and the upper right portion of front wall 12, respectively, and comprise several individual components. Since each of front wall stacking support areas 32*a, b* are substantially similar, for the purpose of this discussion, reference shall only be made to front wall stacking support area 32*a*. As shown in FIG. 3, front wall stacking support area 32*a* comprises a stacking support outer wall 222, first load bearing channel 70*a*, second load bearing channel 72*a*, first load bearing ridge 64*a* located between and part of first and second load bearing channels 70*a*, 72*a*, and 180° front wall stacking receptacle 60*a*. First and second load bearing channels 70*a*, 72*a* can each be generally described as comprising three surfaces (although second load bearing channel does have two additional surfaces): a first surface that is substantially perpendicular to the front wall outer surface 86 and recesses in away from front wall outer surface 86, a second surface that is substantially parallel to front wall outer surface 86, and a third surface that is substantially perpendicular to the second surface, thereby forming a substantially square load bearing channel.

In first load bearing channel 70*a*, first surface 156*a* extends substantially perpendicularly inward (towards interior area 19 of basket 10) from front wall outer surface 86, to join with second surface 158*a*, which, as described above, is substantially parallel to front wall outer surface 86. The third surface for first load bearing channel 70*a* is first load bearing ridge 64*a*. Preferably, first load bearing ridge 64*a* extends substantially perpendicularly from second surface 158*a* and is substantially even with front wall outer surface 86. Substantially centered above first load bearing ridge 64*a* is 0° front wall stacking receptacle 60*a*, which, according to an exemplary embodiment of the present invention, is substantially U-shaped. As seen in FIG. 3, 0° front wall stacking receptacle 60 is co-joined with first and second load bearing channels 70*a*, 72*a*.

Preferably, second load bearing channel 72*a* is similarly constructed as first load bearing channel 70*a* but comprises several additional surfaces. The first surface of second load bearing channel 72*a* is first load bearing ridge 64*a*. Second surface 160*a* of second load bearing channel 72*a* is substantially similar to first surface 156*a*. Third surface 162*a* of second load bearing channel 72*a* is substantially perpendicular to second surface 160*a*, but does not reach outer surface 86 of front wall 12. Instead, second channel vertical ledge 74*a* joins third surface 162*a*, and second channel vertical ledge 74*a* is substantially parallel to front wall outer surface 86.

Stacking support area 32*a* further comprises second load bearing ridge 66*a* which is substantially perpendicular to second channel vertical ledge 74*a* and terminates second channel vertical ledge 74*a* and completes second load bearing channel 72. Located generally opposite to second load bearing channel 72 (i.e., on the interior side of stacking support surface area 32*a*) is third load bearing ridge 68*a*. Stacking support wall 76*a* joins both second and third load bearing ridges 66*a*, 68*a*, and is substantially parallel to the outer surface 86 of front wall 12, and is substantially centrally located on a top surface 6 of front wall 12.

Front wall 12 also comprises window 4 (FIG. 2). Window 4 comprises a first curved surface 8*a*, which curves downward from substantially horizontal front wall top surface 6 to form first window vertical surface 28*a*. According to a preferred embodiment of the present invention, first window vertical surface 28*a* is formed between about 95° and about 100° with respect to the substantially horizontal top surface 6 of front wall 12. First window vertical surface 28*a* then joins second curved surface 8*b*, which then forms substantially horizontal surface window surface 30, which is substantially parallel to top surface 6 of front wall 12 (i.e. horizontal). Window surface 30 then forms third curved surface 8*c*, which joins also with second window vertical surface 28*b*. Second window surface 28*b* is formed between about 95° and about 100° with respect to the substantially horizontal top surface 6 of front wall 12. Second window surface 28*b* forms fourth curved surface 8*d*, which joins top surface 6 of front wall 12, thereby completing window 4. As discussed in greater detail below, according to several exemplary embodiments of the present invention, several flap assemblies are provided for window 4 so that baked goods are not lost, especially in transit, when basket container 10 is loaded with baked products.

Figure 61:
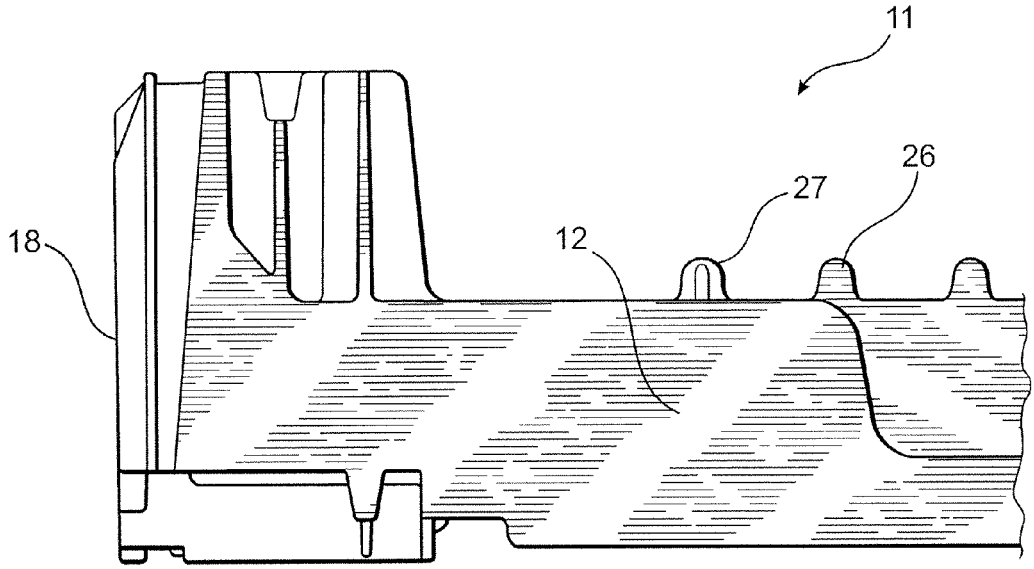
FIG. 61 illustrates a front view of a basket shown in FIGS. 56 and 57.

FIG. 61 is a front view of basket 11 according to an alterative embodiment of the present invention. FIG. 61 illustrates modified teeth 27, which are, preferably, located only on front wall 12. As one of ordinary skill in the art can appreciate, however, modified teeth 27 can be located on rear wall 14 in an alternative embodiment of the present invention, or can replace some or all of teeth 26 on both front wall 12 and rear wall 14. Modified teeth 27 preferably has a significantly greater radius at a top portion than teeth 26. The larger radius substantially reduces the possibility of ripping and/or tearing of baked good packages when being retrieved from container 11.

B. Rear Wall 14

Figure 5:
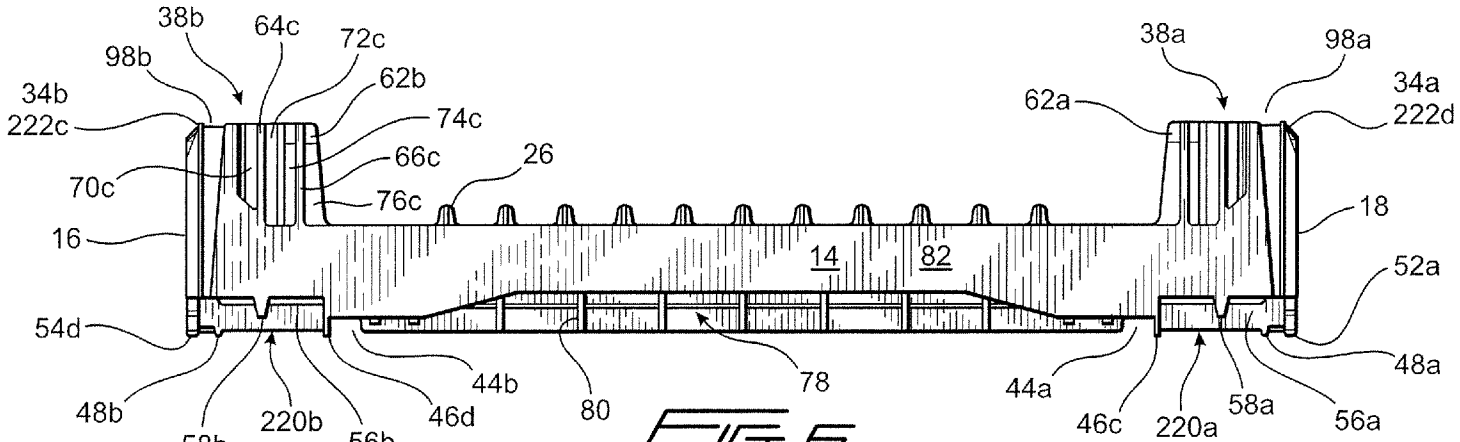
FIG. 5 illustrates a back view of the basket shown in FIG. 1.
Figure 6:
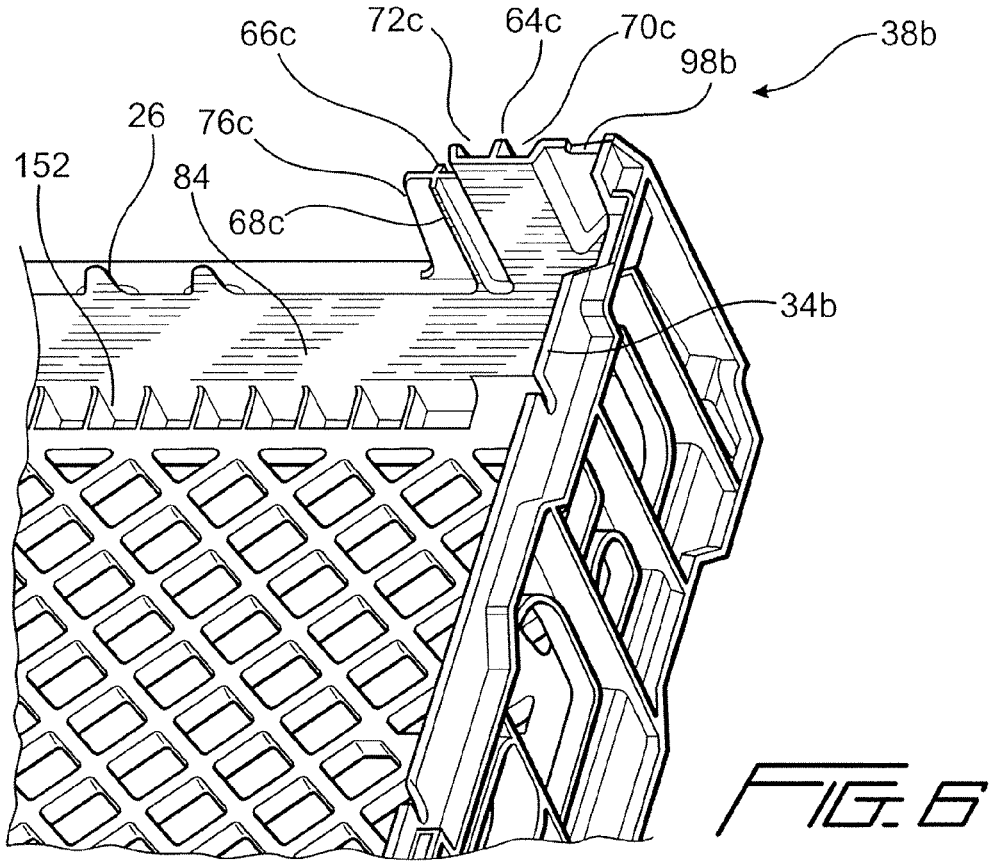
FIG. 6 illustrates an expanded view of a right rear corner of the basket shown in FIG. 1.

Referring now to FIGS. 1, 5, and 6, rear wall 14 comprises an inner and outer surface 84, 82, between which are spaced a plurality of ribs 80. Ribs 80 can be seen in FIGS. 5 and 11. Preferably, several of the ribs 80 extend to the bottom of rear wall channel 152, and several of the ribs 80 extend to the bottom of base 20. The bottom of base 20 preferably does not extend as far down as the bottom of front and rear channels 150, 152. Rear wall channel 152 is discussed in greater detail below in regard to base 20. Rear wall 14 further comprises rear wall stacking support areas 38*a, b*, window 4, and a plurality of teeth 26. Teeth 26 substantially inhibits or prevents baked good(s) from sliding out of the basket 10 when they are stacked two layers high within basket 10. Rear wall 14 further comprises, according to an exemplary embodiment of the present invention, several features that assist in stacking basket 10 with other like baskets 10' in a 0°, 90°, and 180° stacking configuration. The stacking features shall be discussed here generally, and in greater detail below.

As seen in FIGS. 1, 5 and 6, rear wall 14 comprises several stacking features which are generally located on the lower left and lower right portions of front wall 12. Stacking features that are located at the lower portions of the rear wall 14 comprise, according to an exemplary embodiment of the present invention, inner stacking rearward rails 56*a, b*, rear wall lower mounting supports 58*a, b*, 90° stacking receptacles 44*a, b*, 90° stacking barriers 46*c,d*, and inner stacking lateral rails 48*a, b*. Seen also in FIG. 5 are left sidewall stacking feet 52*a*, and right sidewall stacking feet 54*d*. Stacking features that are located in the upper portions of front wall 12 comprises lateral rail channel 98*a, b*, sidewall ridges 34*a, b*, and rear wall stacking support areas 38*a, b*. Preferably, rear wall stacking support areas 38*a, b* are substantially similar to front wall stacking support areas 32*a, b*, except for the addition of rear wall stacking support recess 220*a, b*, and 180° rear wall stacking receptacles 62*a, b*. 180° rear wall stacking receptacles 62*a, b* preferably comprise a substantially rectangular cut-away portion of stacking support area wall 76*c,d*, and is located at the top of the walls 76*c,d*. As discussed above, the stacking features of basket 10 will be discussed in greater detail below. Therefore, since the balance of rear wall stacking support areas 38*a, b* are substantially similar to front wall stacking support areas 32*a, b* they will not be described further for the purpose of brevity.

Rear wall 14 further comprises rear wall cut away area 78. Providing rear wall cut away area 78 eliminates a substantial amount of material that is not needed for strength and rigidity, because of ribs 80, thereby reducing the cost to manufacture basket 10.

C. Sidewalls (Left and Right) 18, 16

Figure 9:
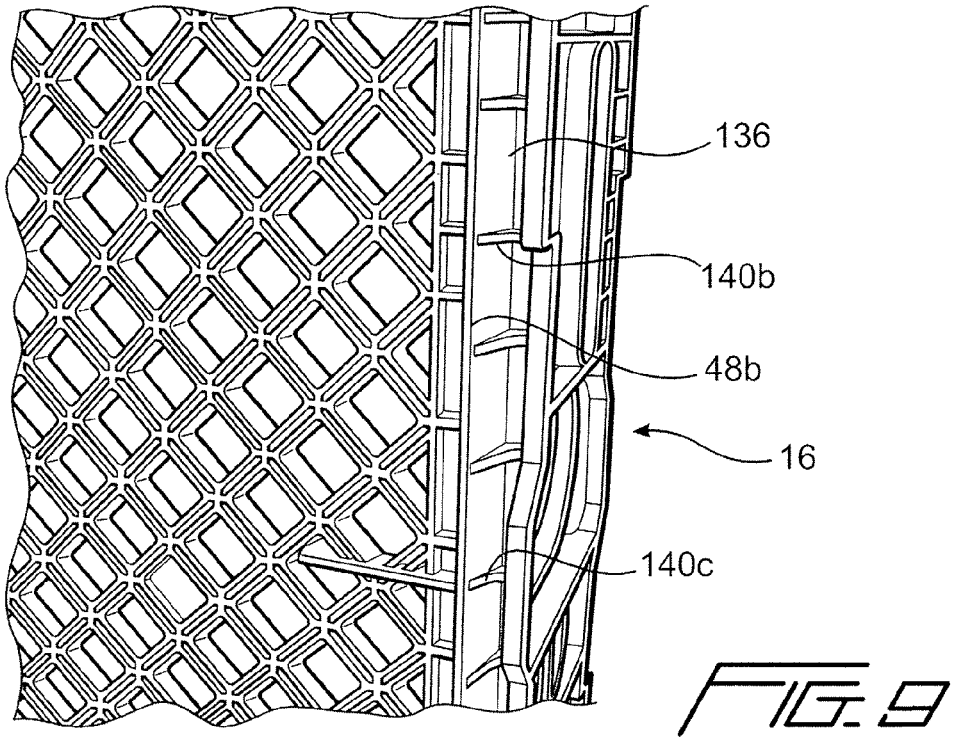
FIG. 9 illustrates a bottom perspective view of the right sidewall of the basket shown in FIG. 1.
Figure 7:
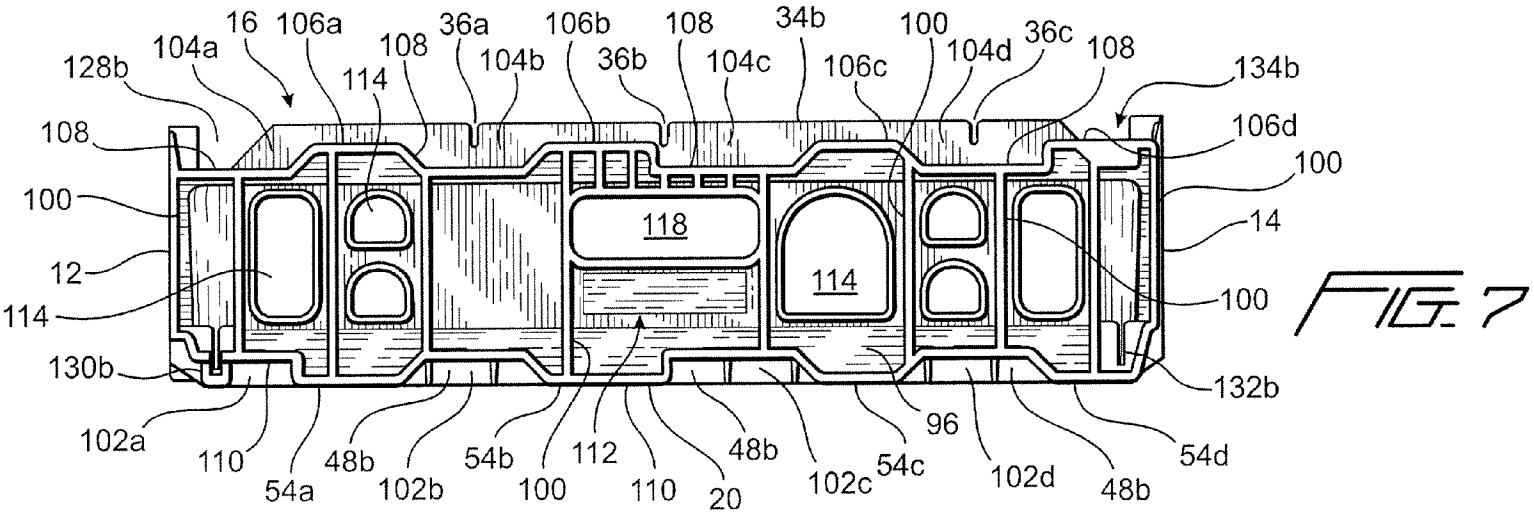
FIG. 7 illustrates a right side view of the basket shown in FIG. 1.

In regard to right side wall 16, attention is directed towards FIGS. 1, 7, and 9. Right side wall 16 preferably comprises a substantially smooth inner surface 94, and a substantially irregular outer surface 96. Right side wall 16 further comprises a plurality of right sidewall apertures (apertures) 114 that proceed from the outer surface 96 to inner surface 94, a handle 118, nameplate area 112, a plurality of sidewall stiffeners 100, an upper right side wall surface 108, and a lower right side wall surface 110.

Right side wall 16 further comprises several stacking features. These stacking features are generally described here, and in greater detail below.

On the lower portion of right side wall 16 are a plurality of right sidewall stacking feet 54*a-d*. Adjacent to each right side wall stacking feet 54 is a right sidewall lower stacking receptacle 102*a-d*. Preferably, right sidewall lower stacking receptacles 102*a-d* are designed to mate with left side wall stacking projections 126*a-d* when an upper basket 10' is stacked in an 180° configuration with respect to a lower basket 10 (See FIG. 24).

On the upper portion of right side wall 16 are a plurality of right side wall stacking projections 106*a-d* that are designed to mate with left side wall lower stacking receptacles 122*a-d* when an upper basket 10' is stacked in an 180° stacking configuration with respect to a lower basket 10. Adjacent to each right side wall stacking projection 106*a-d* is a right sidewall upper stacking receptacle 104*a-d*. Right sidewall upper stacking receptacles 104*a-d* are preferably designed to mate with left side wall stacking feet 52*a-d* when an upper basket 10' is stacked in an 180° stacking configuration with respect to a lower basket 10.

Right sidewall 16 further comprises a 180° first stacking projection 130*b* on the lower left portion of right side wall 16, and a 180° second stacking projection 132*b* on the lower right portion of right side wall 16. The mating of the projections and receptacles is discussed in greater detail below.

As previously mentioned, right side wall 16 preferably comprises a substantially irregular outer surface 96 and substantially smooth inner surface 94. The lower portion of the right side wall 16 outer surface 96 and inner stacking lateral rail 48*b* comprise a right base channel 136. This can be seen in FIG. 9. On the upper portion of right side wall 16 is side wall ridge 34*b*, which extends substantially across the length of right side wall 16. As seen in FIG. 7, however, side wall ridge 34*b* is interrupted on the left side of right side wall 16 by 180° first stacking receptacle 128*b*, and on the right side, by 180° second stacking receptacle 134*b*. Located along side wall ridge 34*b* are a plurality of side wall ridge grooves 36*a-c*, which, according to a preferred embodiment of the present invention, will mate with a plurality of left base channel projections 142*a-c* when stacking two baskets 10, 10' in a 180° stacking configuration. The right base channel projections 140*a-c* can be seen in FIG. 9.

Figure 8:
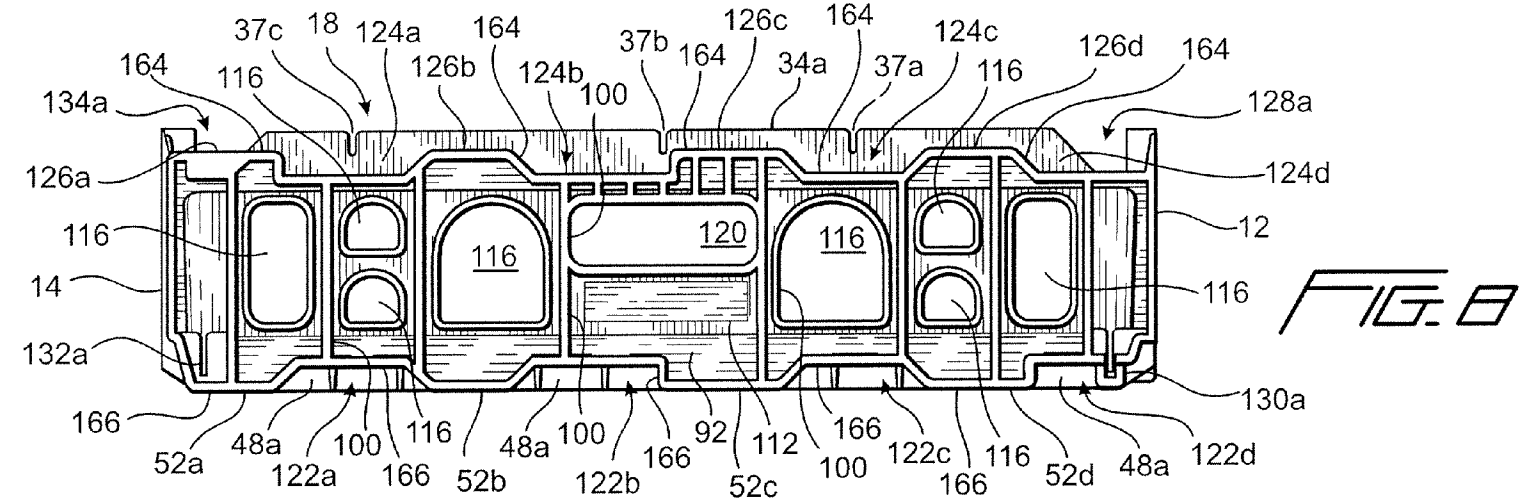
FIG. 8 illustrates a left side view of the basket shown in FIG. 1.
Figure 10:
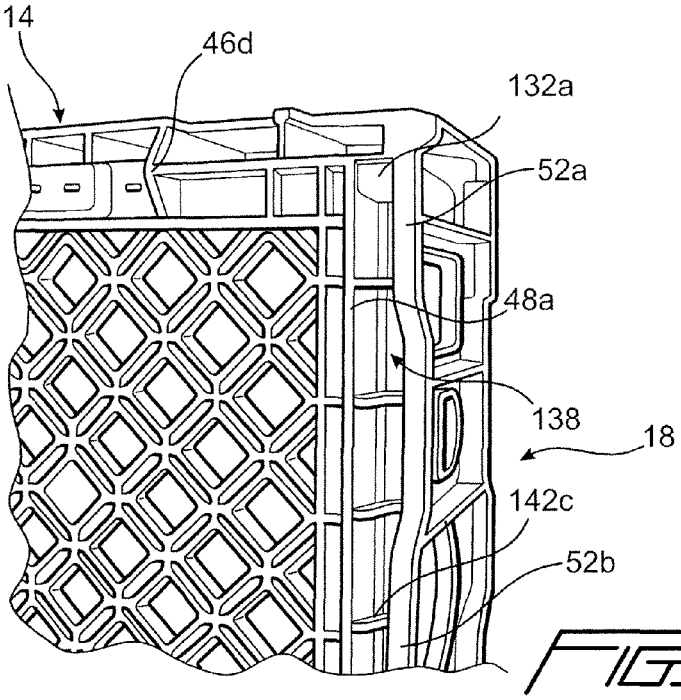
FIG. 10 illustrates a bottom perspective view of a left sidewall of the basket shown in FIG. 1.

In regard to the left side wall 18, attention is directed towards FIGS. 1, 8, and 10. Left side wall 18 preferably comprises a substantially smooth inner surface 90, and a substantially irregular outer surface 92. Left side wall 18 further preferably comprises a plurality of left sidewall apertures (apertures) 116 that proceed from the outer surface 92 to inner surface 90, a handle 120, nameplate area 112, a plurality of sidewall stiffeners 100, an upper right side wall surface 164, and a lower right side wall surface 166.

Left side wall 18 further comprises several stacking features. These stacking features are generally described here, and in greater detail below.

On the lower portion of left side wall 18 are a plurality of left sidewall stacking feet 52*a-d*. Adjacent to each left side wall stacking feet 52 is a left sidewall lower stacking receptacle 122*a-d*. Left sidewall lower stacking receptacles 122*a-d* are preferably designed to mate with right side wall stacking projections 106*a-d* when an upper basket 10' is stacked in an 180° stacking configuration with respect to a lower basket 10.

On the upper portion of left side wall 18 are a plurality of left side wall stacking projection 126*a-d* that are preferably designed to mate with right side wall lower stacking receptacles 102*a-d* when an upper basket 10' is stacked in a 180° stacking configuration with respect to a lower basket 10. Adjacent to each left side wall stacking projection 126*a-d* is a left sidewall upper stacking receptacle 124*a-d*. Left sidewall upper stacking receptacles 124*a-d* are preferably designed to mate with right side wall stacking feet 54*a-d* when an upper basket 10' is stacked in an 180° configuration with respect to a lower basket 10.

Left sidewall 18 further comprises a 180° rear stacking projection 132*a* on the lower left portion of left side wall 18, and a 180° front stacking projection 130*a* on the lower right portion of left side wall 18. The mating of the projections and receptacles is discussed in greater detail below.

As previously mentioned, left side wall 18 preferably comprises a substantially irregular outer surface 92 and substantially smooth inner surface 90. The lower portion of the left side wall 18 outer surface 92 and inner stacking lateral rail 48*a* comprise a left base channel 138, which can be seen in FIG. 10. On the upper portion of left side wall 18 is side wall ridge 34*a*, that preferably extends substantially across the length of left side wall 18. As seen in FIG. 8, however, side wall ridge 34*a* is interrupted on the right side of left side wall 18 by 180° first stacking receptacle 128*a*, and on the left side, by 180° second stacking receptacle 134*a*. Located along side wall ridge 34*a* are a plurality of left side wall ridge grooves 37*a-c*, which will preferably mate with a plurality of right base channel projections 140*a-c* when stacking two baskets 10, 10' in an 180° stacking configuration. The left base channel projections 142*a-c* can be seen in FIG. 10.

D. Base 20

Referring now to FIGS. 1, 9, and 10-15, base 20 includes a series of selectively spaced ribs 22 to define uniformly spaced openings 24 therebetween. The openings 24 are preferably spaced at pre-selected intervals which correspond to the spacing of teeth 26 projecting upwardly from the front end wall 12 and rear end wall 14, when a substantial similar second basket 10' is placed at a 90° stacking orientation with respect to a first basket 10. Teeth 26 assist in substantially preventing or reducing spillage of baked good(s) from basket 10 in response to the problems of the previously known baskets.

Base 20 preferably comprises a substantially smooth upper surface 144 (see FIG. 1), and a lower surface 146. The upper surface 144 and lower surface 146 form, in an interior portion of base 20, selectively spaced ribs 22, wherein the lower side comprises U-shaped channels 148. Base 20 further comprises front wall channel 150, and rear wall channel 152. Both front wall channel 105 and rear wall channel 152 comprise a lower portion that is substantially planar with the remainder of base 20 (i.e., the selectively spaced ribs 22), and four walls that are substantially perpendicular to the channel's lower portion. On the lower portion of both the front wall channel 150 and rear wall channel 152 there are a plurality of holes, interspaced between which are channel ribs 154, that extend up from the lower portion of the front wall and rear wall channels 150, 152, to a point just below upper surface 144 of base 20. The front and rear channels 150, 152 are preferably substantially similar to each other, and are preferably substantially centrally located on base 20 substantially adjacent to the front wall 12 and rear wall 14 respectively. Each of the front and rear wall channels 150, 152 runs between about 85% to about 100% of the width of basket 10.

Figure 13:
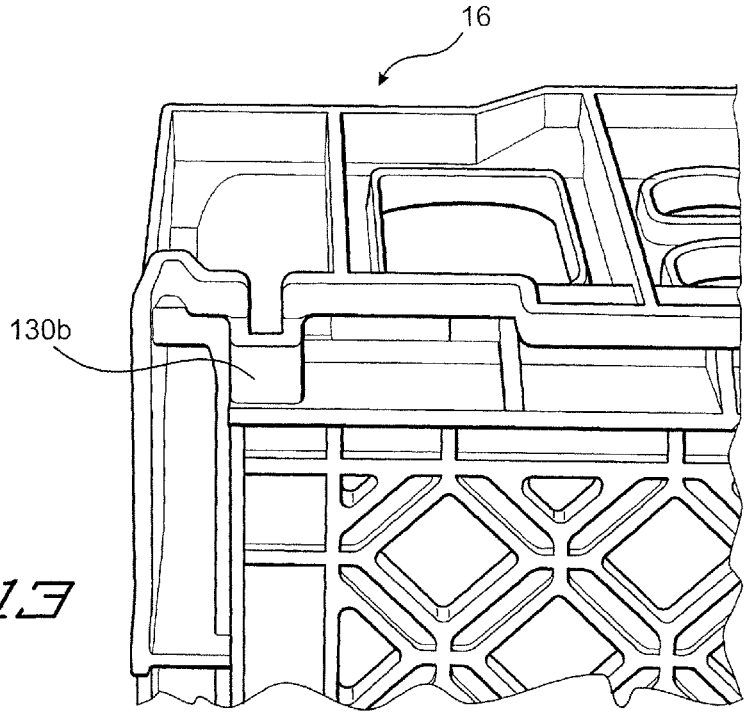
FIG. 13 illustrates a close up perspective view of a bottom corner of the basket shown in FIG. 1.
Figure 14:
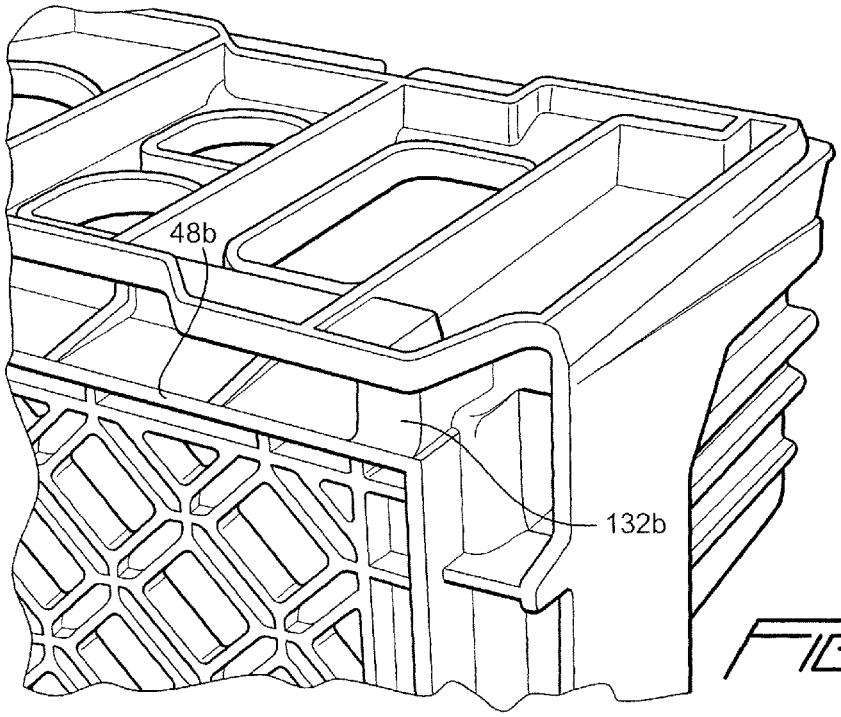
FIG. 14 illustrates a close up perspective view of a second bottom corner of the basket shown in FIG. 1.
Figure 15:
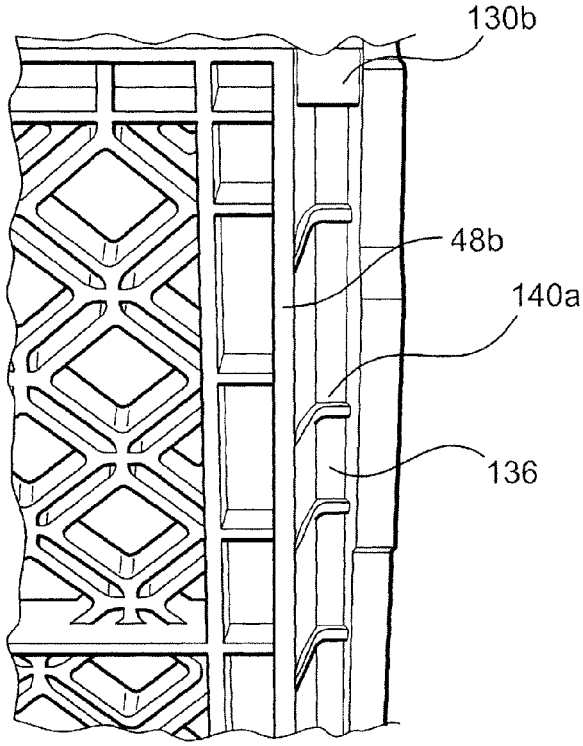
FIG. 15 illustrates a close up perspective view of a right base channel of the basket shown in FIG. 1.

Right base channels 136 and left base channel 138 are illustrated in FIGS. 9, 10, and 11-15. In regard to right base channel 136, attention is directed toward FIGS. 9 and 13-15. Right base channel 136 preferably extends from 180° rear stacking projection 132*b* (FIG. 14) to 180° front stacking projection 130*b* (FIG. 13). Right base channel 136 is formed by inner stacking lateral rail 48*b* (FIGS. 9, 14 and 15) and right sidewall stacking feet 54*a-d*. Located within right base channel 136 are a plurality of right base channel projections 140*a-c* (FIGS. 9 and 15). Right base channel projections 140*a-c* project downwardly from the top portion of right base channel 136 such that when a second basket 10' is placed in a 180° stacking configuration with respect to a first basket 10, right base channel projections 140*a-c'* of upper basket 10' mate with left side wall ridge grooves 37*c-a*, respectively (and left base channel projections 142*a-c'* mate with right side wall ridge grooves 36*c-a*, respectively).

Figure 11:
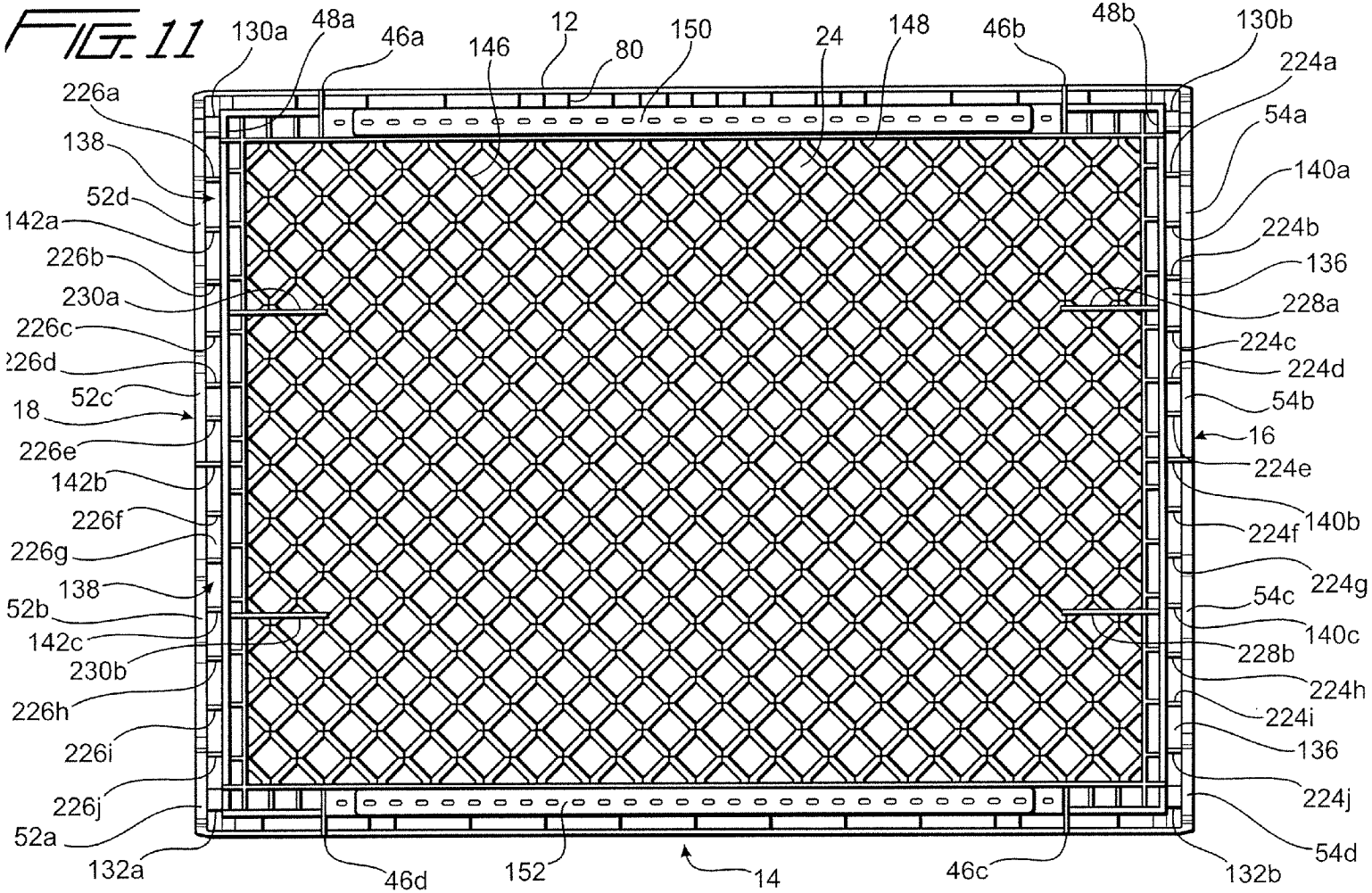
FIG. 11 illustrates a bottom view of the basket shown in FIG. 1.
Figure 12:
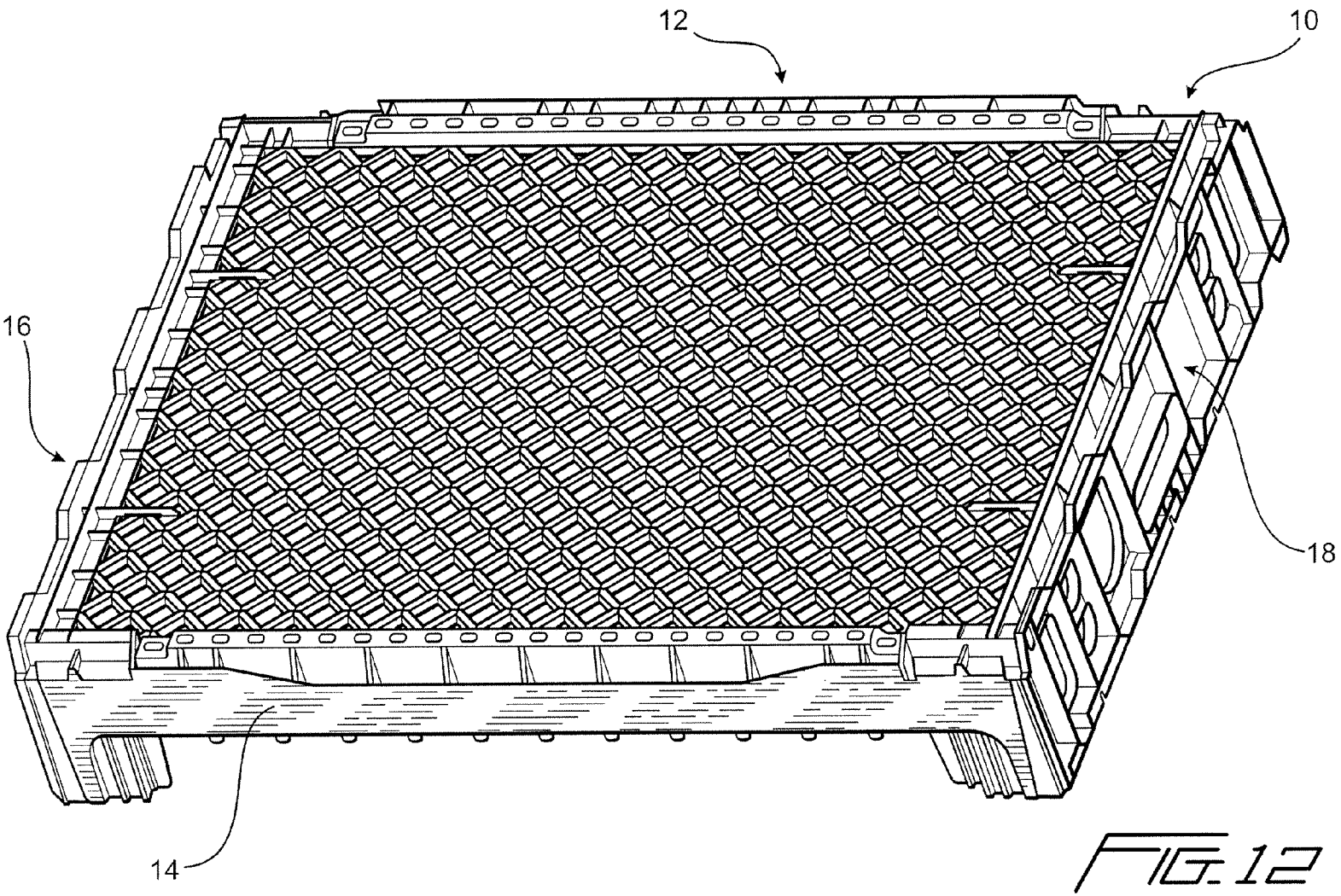
FIG. 12 illustrates a bottom perspective view of the basket shown in FIG. 1.

In regard to left base channel 138, attention is directed toward FIGS. 10 and 11. Left base channel preferably 138 extends from 180° rear stacking projection 132*a* (FIG. 10) to 180° front stacking projection 130*a* (FIG. 11). Left base channel 138 is formed by inner stacking lateral rail 48*a* (FIGS. 10 and 11) and left sidewall stacking feet 52*a-d* (FIG. 8). Located within left base channel 138 are a plurality of left base channel projections 142*a-c* (FIG. 10). Left base channel projections 142*a-c* project downwardly from the top portion of left base channel 138 such that when a second basket 10' is placed in a 180° stacking configuration with respect to a first basket 10, left base channel projections 142*a-c'* of upper basket 10' mate with right side wall ridge grooves 36*c-a*, respectively (and right base channel projections 140*a-c* mate with left side wall ridge grooves 37*c-a*, respectively).

III. Stacking of Baskets

A. 0° Stacking of Baskets 10 and 10'

Figure 16:
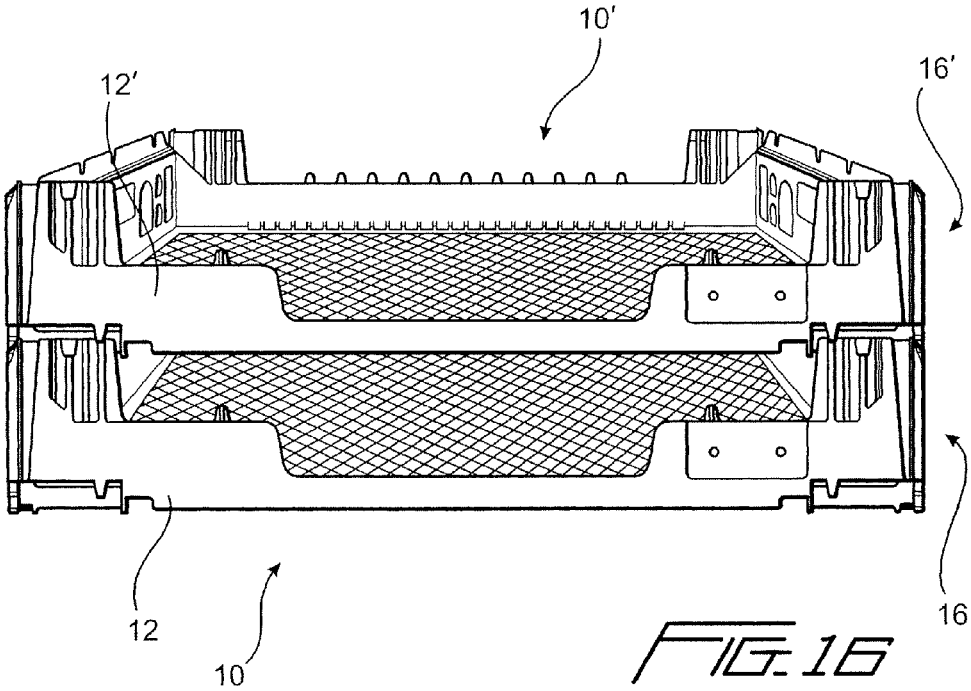
FIG. 16 illustrates a front view of two baskets of FIG. 1 stacked in a 0° stacking configuration according to an embodiment of the present invention.
Figure 17:
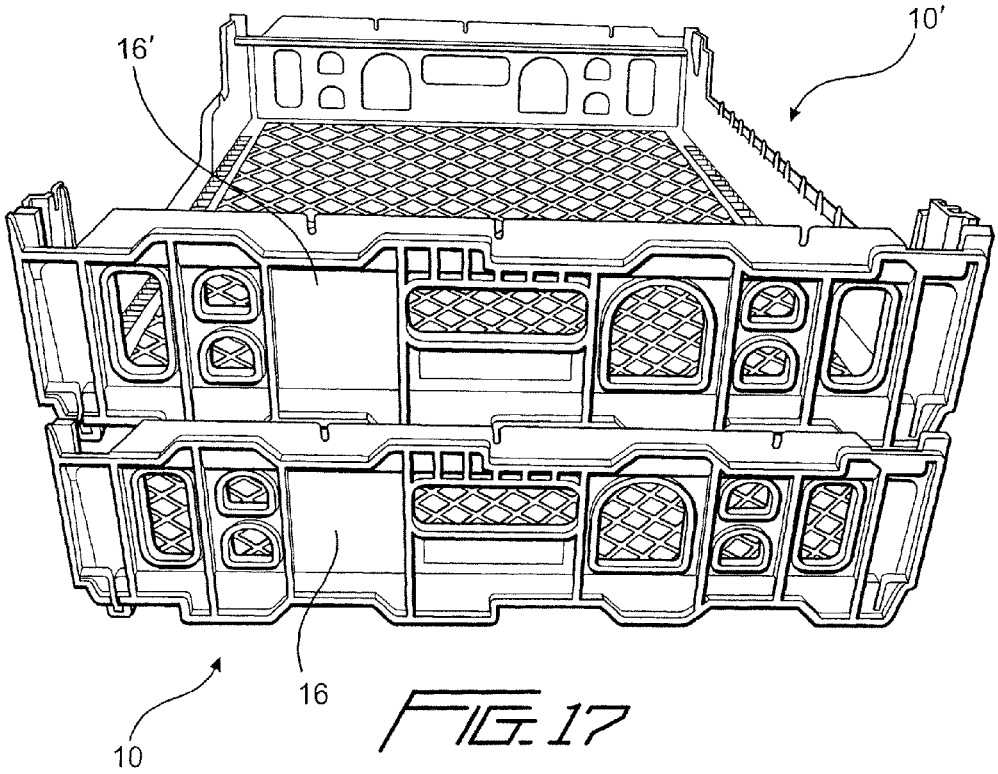
FIG. 17 illustrates a left side view of the two baskets shown in FIG. 16 stacked in a 0° stacking configuration according to an embodiment of the present invention.

FIG. 16 illustrates a front view of two baskets 10 (lower) and 10' (upper) of FIG. 1 stacked in a 0° stacking configuration according to an embodiment of the present invention, and FIG. 17 illustrates a side view of the two baskets 10 (lower) and 10' (upper) shown in FIG. 16 stacked in a 0° stacking configuration according to an embodiment of the present invention. In the 0° stacking configuration, upper basket 10', which is substantially similar to lower basket 10, rests on lower basket 10 in the same orientation as lower basket 10. The 0° stacking configuration provides the maximum distance between the upper surface 144 of base 20 of lower basket 10, and lower surface 146' of base 20' of upper basket 10'. In the 0° stacking configuration, baked good(s) can be stacked in interior area 19 two or more levels high; use of window 4 and the window flaps, described in greater detail below, allow consumers to access the baked good(s) from the interior area 19, which now comprises the inner surfaces of front wall 12, right side wall 16, rear wall 14, left side wall 16, upper surface 144 of lower basket 10, and lower surface 146' of upper basket 10'.

FIGS. 1-12, and 15-19 illustrate the various features of baskets 10 and 10' when stacked in a 0° stacking configuration. When stacked in the 0° stacking configuration, upper basket 10' fits securely onto lower basket 10 such that it is substantially difficult to inadvertently move upper basket 10' laterally, frontwardly or rearwardly with respect to lower basket 10. Furthermore, in the 0° stacking configuration, there is a great deal of support provided by lower basket 10 of the weight of upper basket 10' and its contents (and other baskets 10" stacked upon upper basket 10'). These features are accomplished by several unique aspects of basket 10. Referring especially to FIGS. 1, 2, 5, and 16, inner stacking forward rail 50*a, b* and inner stacking rearward rail 56*a, b* operate in conjunction with front wall stacking support areas 32*a, b* and rear wall stacking support areas 38*a, b* to substantially inhibit or prevent forward and rearward shifting of baskets 10, 10' with respect to each other. Referring to FIGS. 3, 5, and 16, it can be seen that inner stacking forward rail 50*a'* of upper basket 10' is preferably located inwardly from front wall stacking support 32*a*. The same is true for inner stacking forward rail 50*b'* of upper basket 10' and front wall stacking support area 36*b*, inner stacking rearward rail 56*a'* of upper basket 10' and rear wall stacking support area 38*a*, and inner stacking rearward rail 56*b'* of upper basket 10' and rear wall stacking support area 38*b*.

To substantially inhibit or prevent lateral shifting of upper basket 10' with respect to lower basket 10, inner stacking lateral rails 48*a, b* are preferably provided to interface with sidewall ridges 34*a, b* respectively. Inner stacking lateral rails 48*a, b* are preferably part of left base channel 138 and right base channel 136, respectively. Right base channel 136 is preferably formed by inner stacking lateral rail 48*b* (FIGS. 9, 14 and 15) and right sidewall stacking feet 54*a-d*, and left base channel 138 is preferably formed by inner stacking lateral rail 48*a* (FIGS. 10 and 11) and left sidewall stacking feet 52*a-d*. The left and right base channel 138, 136 preferably fit over and on top of sidewall ridges 34*a, b*, thereby substantially inhibiting or preventing any lateral motion between upper and lower baskets 10', 10.

Although left sidewall stacking feet 52*a-d* and right sidewall stacking feet 54*a-d* form left and right base channels 138, 136, they also provide a significant component of the load bearing capability of basket 10 for upper basket 10' (and other baskets 10" stacked on top of basket 10'. As shown in FIGS. 7 and 17, right sidewall stacking feet 54*a-d'* of upper basket 10' fit on top of right sidewall stacking projections 106*a-d*, respectively, in the 0° stacking configuration. FIG. 8 illustrates that in the 0° stacking configuration, left sidewall stacking feet 52*a-d* of upper basket 10' fit on top of left sidewall stacking projections 126*a-d*. The stacking feet and stacking projections are preferably substantially similarly sized and shaped and provide a sturdy platform for the stacking of additional baskets 10. Loads that are present in upper baskets 10', 10" are substantially transferred through left and right side wall stacking feet 52*a-d'*, 54*a-d'* and left and right side wall stacking projections 126*a-d*, 106*a-d*, as well as the left and right side walls 18-16, and the plurality of side wall stiffeners 100.

In the front and rear of upper basket 10', front wall lower mounting supports 42*a, b*, and rear wall lower mounting supports 58*a, b* preferably rest upon front wall stacking support areas 32*a, b* and rear wall stacking support areas 38*a, b* respectively. Specifically, when upper basket 10' is in the 0° stacking configuration with respect to lower basket 10, front wall lower mounting support 42*a'* of upper basket 10' preferably rests upon the junction of second and third load bearing ridges 66*a*, 68*a*, second channel vertical ledge 74*a*, and stacking support area wall 76*a*. This same configuration is preferably provided for front wall lower mounting support 42*b'*, and rear wall stacking supports 58*a, b'* of upper basket 10'. Second and third load bearing ridges 66*a*, 68*a*, second channel vertical ledge 74*a*, and stacking support area wall 76*a* are substantially orthogonal to each other, and thereby form a substantially strong stacking support interface for upper basket 10'. Because of the configuration of the front wall lower mounting support 42*a'* of upper basket 10' resting upon the junction of second and third load bearing ridges 66*a*, 68*a*, second channel vertical ledge 74*a*, and stacking support area wall 76*a* of lower basket 10, and the other load bearing features discussed above, basket 10 can support substantially more weight than it could without these features.

Figure 18C:
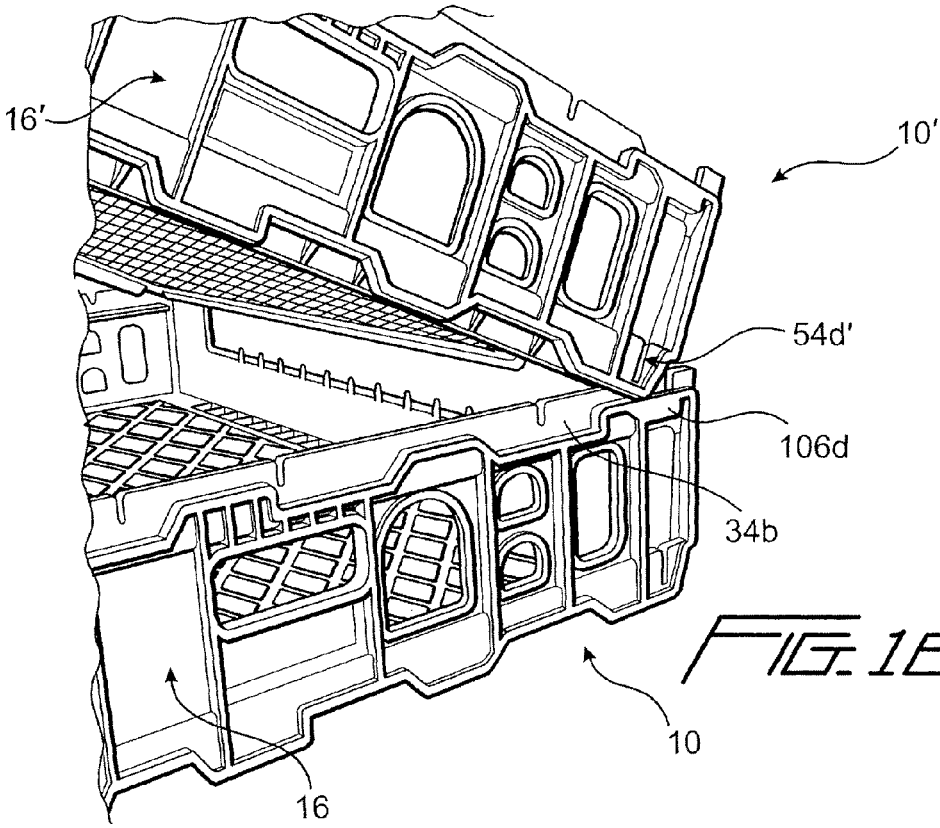
FIGS. 18A-18C illustrate several perspective views of the two baskets shown in FIG. 16 after the upper basket has been pivoted up from the lower basket according to an embodiment of the present invention.
Figure 18A:
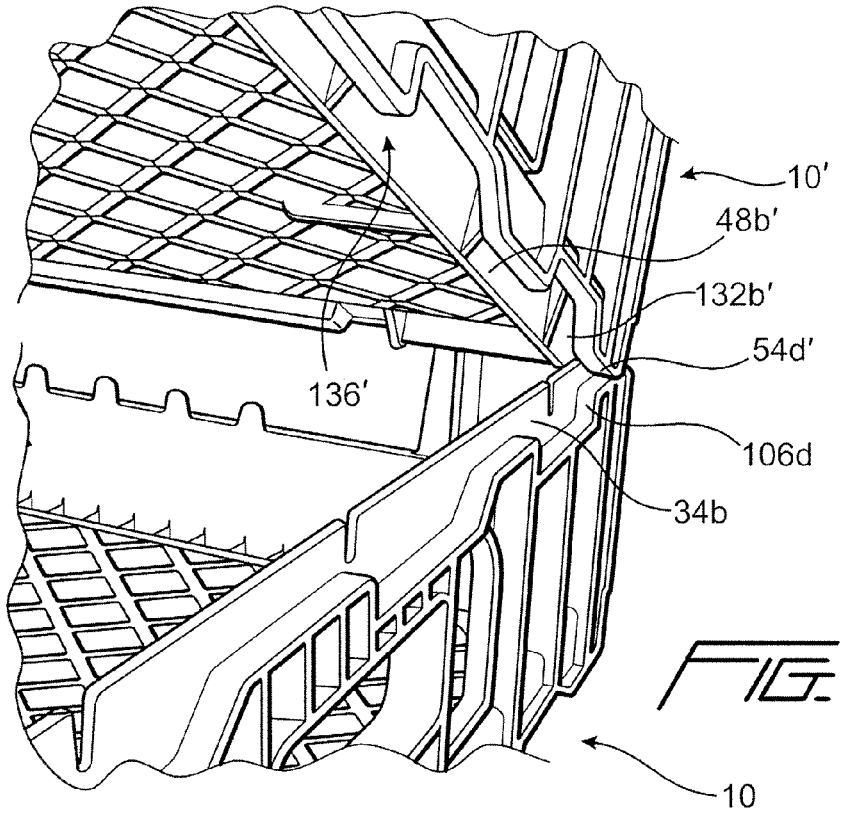
Figure 18B:
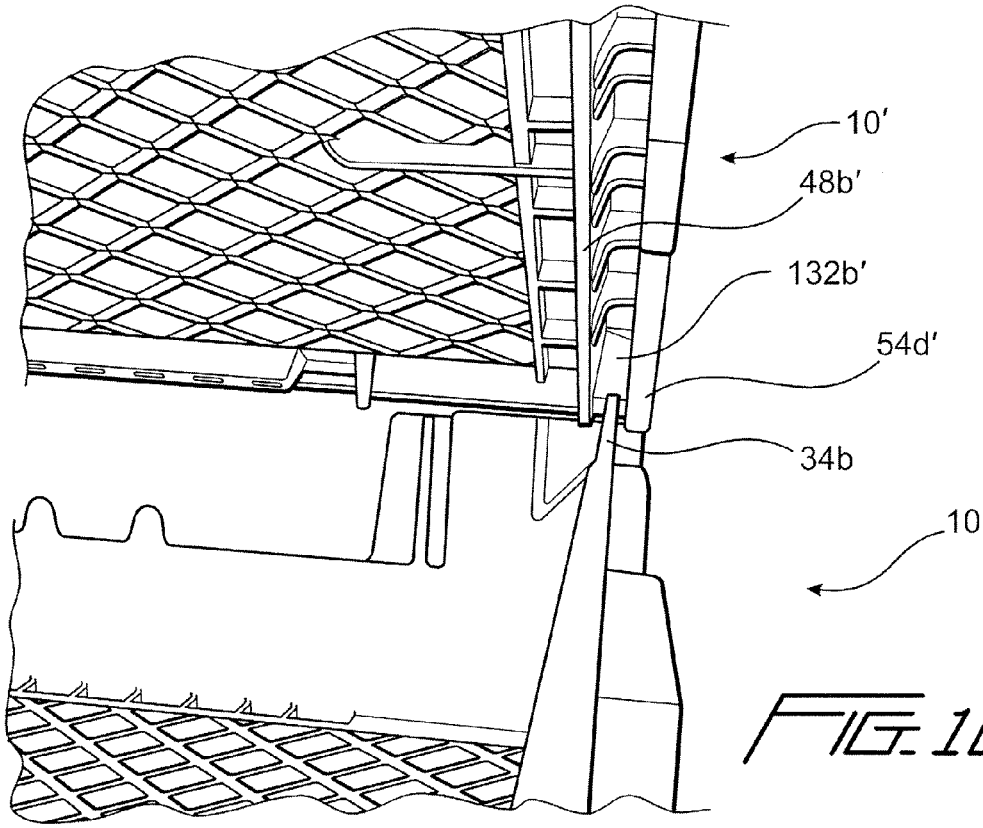

FIGS. 18A-18C illustrate several perspective views of the baskets 10 and 10' shown in FIG. 16 after upper basket 10' has been pivoted up from lower basket 10 according to an embodiment of the present invention. Pivoting allows a user to slide an upper basket 10' that may be loaded with baked goods out towards the user, so that the user can carry or transport the fully loaded basket 10'. Pivoting and sliding upper basket 10' makes it substantially easier to pick up and carry the fully or partially loaded baskets 10.

Figure 19:
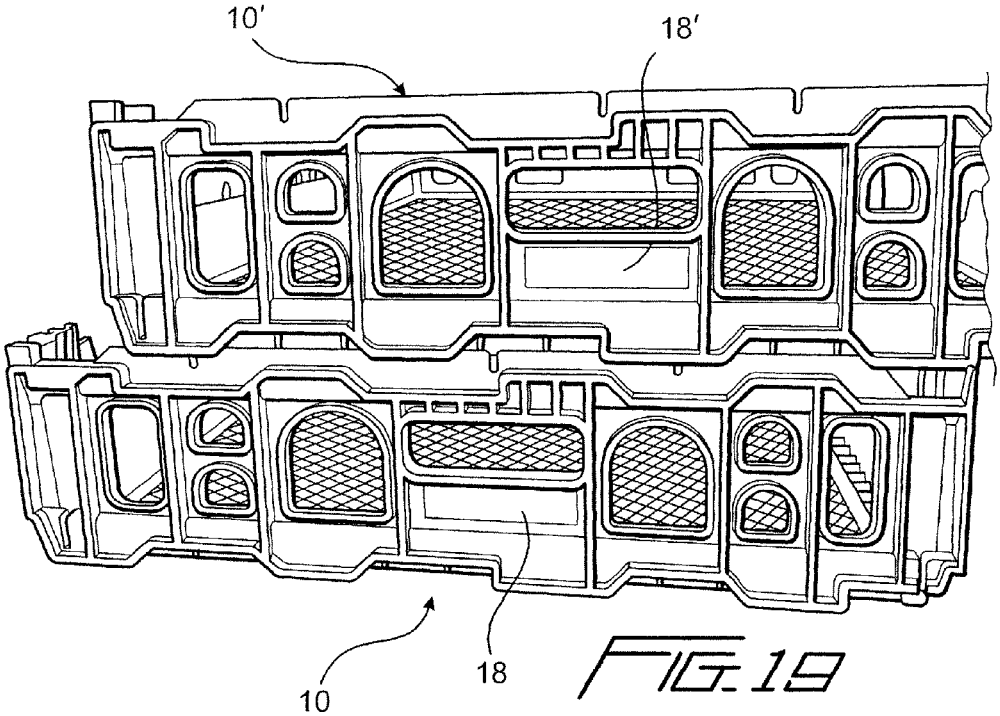
FIG. 19 illustrates a left side view of the two baskets shown in FIG. 16 after the upper basket has been pivoted up from the lower basket and then lowered onto the lower basket to be slid out according to an embodiment of the present invention.

To pivot upper basket 10' about lower basket 10, the user preferably lifts the upper basket 10' at any point along the front wall 12 to an angle of about 30°. At that point, the rear wall 16' of basket 10' will slide slightly forward such that 180° rear stacking projections 132*a, b* come into contact with the rear most portion of sidewall ridges 34*a, b*. The side wall ridges 34*a, b* at the rear most point is preferably sloped downward at an angle between about 30° and about 45°, as illustrated in FIG. 1, at points marked A and B. The slope of the rearmost portion of sidewall ridges 34*a, b* is optimized to provide substantially easier removal of upper basket 10' from lower basket 10. FIG. 19 illustrates a side view of the two baskets 10 and 10' shown in FIG. 16 after upper basket 10' has been pivoted up from lower basket 10 and then lowered onto lower basket 10' to be slid out according to an embodiment of the present invention. After upper basket 10' is pivoted up, slid forward slightly, and then lowered back onto lower basket 10', left and right base channels 136, 138 ride on sidewall ridges 34*a, b*.

B. 90° Stacking of Baskets 10 and 10'

FIGS. 1, 2, 3, 5, and 20-22 illustrate the features of basket 10 when placed in a 90° stacking configuration according to an embodiment of the present invention. The 90° stacking configuration is preferably used after all the baked product has been extracted from baskets 10, and the grocery store or retail outlet wants to return them to the bakery distributor for re-use. By stacking baskets 10 in a 90° stacking configuration, the maximum amount of baskets 10 can be located in a given three dimensional space. The 90° stacking configuration provides the lowest stacking height of the three stacking configurations (0°, 90° and 180°). When stacked in the 90° stacking configuration, baskets 10 are securely stacked against each other. The center of gravity of stacked baskets 10 is lowest when using the 90° stacking configuration, and when a substantial amount of baskets 10 are stacked upon each other, because of the stacking features discussed below, stacked baskets 10 will remain substantially uniform upon each other and there will be very little leaning of the baskets 10.

Figure 20:
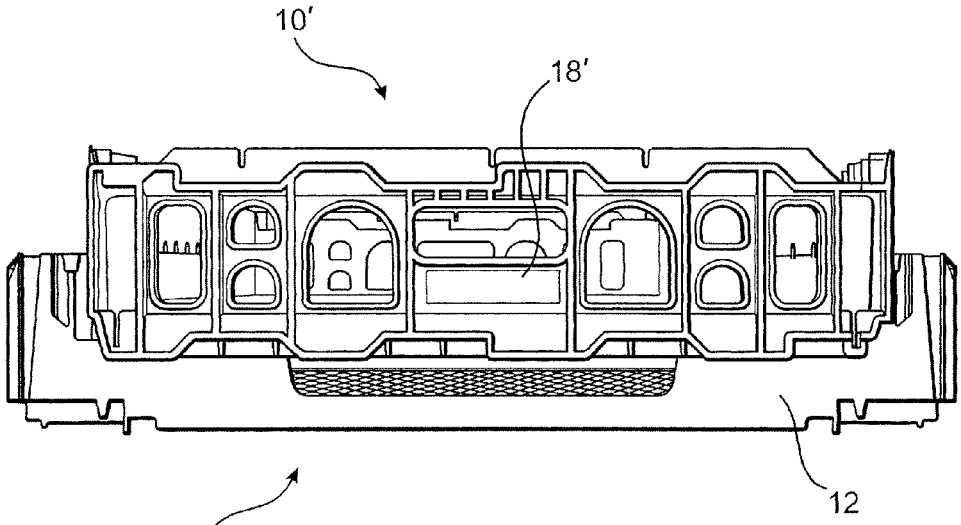
FIG. 20 illustrates a front view of two baskets of FIG. 1 stacked in a 90° stacking configuration according to an embodiment of the present invention.
Figure 21:
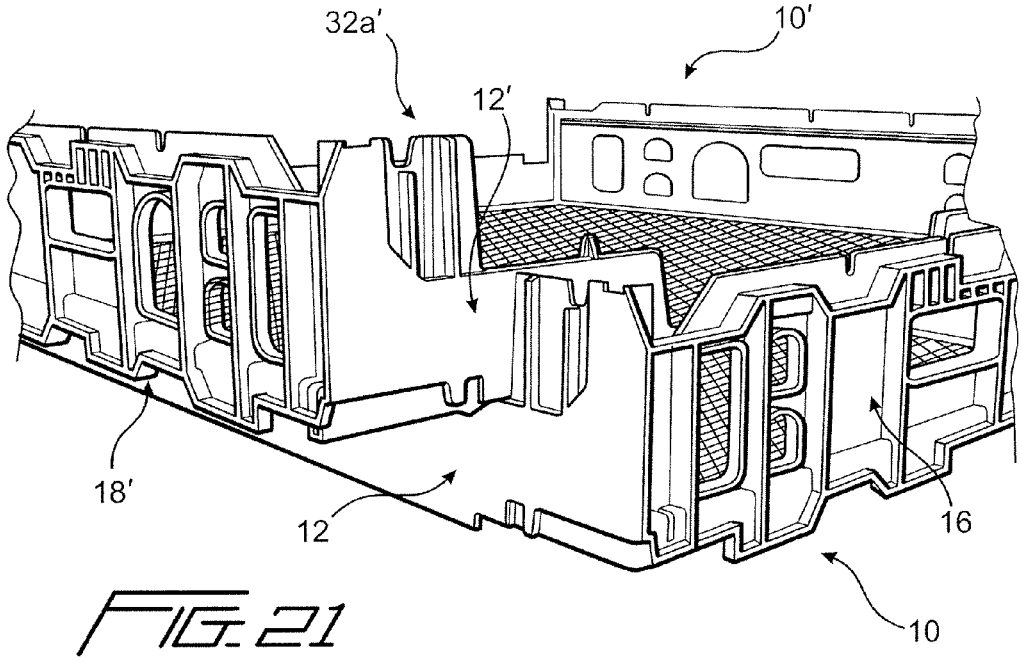
FIG. 21 illustrates a perspective view of the two baskets shown in FIG. 20 stacked in a 90° stacking configuration according to an embodiment of the present invention.
Figure 22:
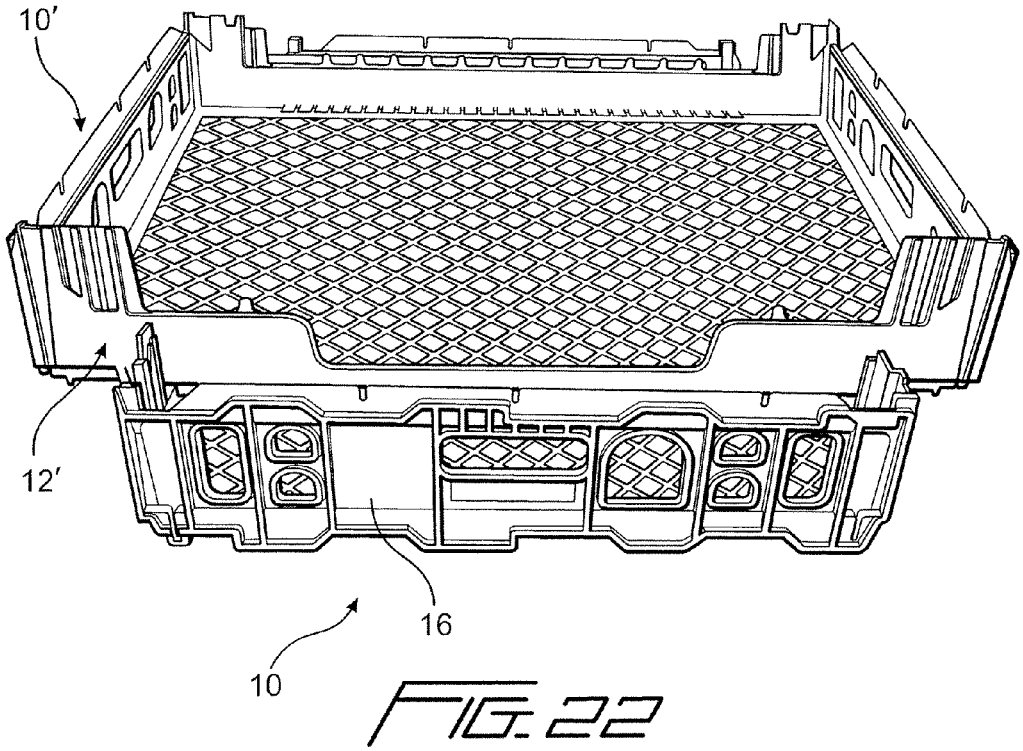
FIG. 22 illustrates a right side perspective view of the two baskets shown in FIG. 20 stacked in a 90° configuration according to an embodiment of the present invention.

When upper basket 10' is stacked upon a lower basket 10 (or when a user goes to stack upper basket 10' upon lower basket 10), upper basket 10' can be lifted, rotated 90° or 180° in either a clockwise or counterclockwise direction with respect to lower basket 10, and stacked again onto lower basket 10. In FIGS. 20-22, upper basket 10' is stacked such that front wall 12' of upper basket 10' faces right side wall 16 of lower basket 10. FIG. 20 illustrates a front view of two baskets 10, 10' of FIG. 1 stacked in a 90° configuration according to an embodiment of the present invention. FIG. 21 illustrates a perspective side view of baskets 10, 10' of FIG. 20 stacked in a 90° configuration according to an embodiment of the present invention, and FIG. 22 illustrates a side view of baskets 10, 10' of FIG. 20 stacked in a 90° configuration according to an embodiment of the present invention.

To place upper basket 10' upon lower basket 10, in a 90° stacking configuration, the user rotates upper basket ' 90° (in this example, counter-clockwise), and then places it upon lower basket 10. When the baskets are stacked in the 90° stacking configuration, 90° stacking receptacle 44*a-d'* and 90° stacking barriers 46*a-d'* (FIGS. 2, 5) of upper basket 10' mounts upon and about upper surface 6 of front wall 12 and rear wall 14. 90° stacking barriers 46*a,d'* are preferably located about front wall outer surface 86, and 90° stacking barrier 46*b,c* are located about rear wall outer surface 82. The combination of 90° stacking barriers 46*a-d'* and 90° stacking receptacles 44*a-d'* of upper basket 10 securely locates upper basket 10' on lower basket 10, so that a substantial amount of force is needed to inadvertently knock upper basket 10' from lower basket 10. A plurality of teeth 26 are sized and located such that they fit within openings 24 of base 20. According to an exemplary embodiment of the present invention, teeth 26 do not extend through openings 24, but are substantially flush with upper surface 144 of base 20.

As well known to those of ordinary skill in the art of the present invention, three or more baskets 10, 10', and 10" and so on can be stacked upon each other in the 90° stacking configuration. In these situations, when multiple baskets 10 are stacked and/or un-stacked with respect to each other, the upper baskets 10" can be stacked and/or un-stacked in a vertical up-and-down motion. The upper basket 10" can be placed in either a 0° or 180' stacking configuration with respect to the lowest basket 10 without and change in stacking height.

C. 180° Stacking of Breadbaskets 10 and 10'

Figure 23:
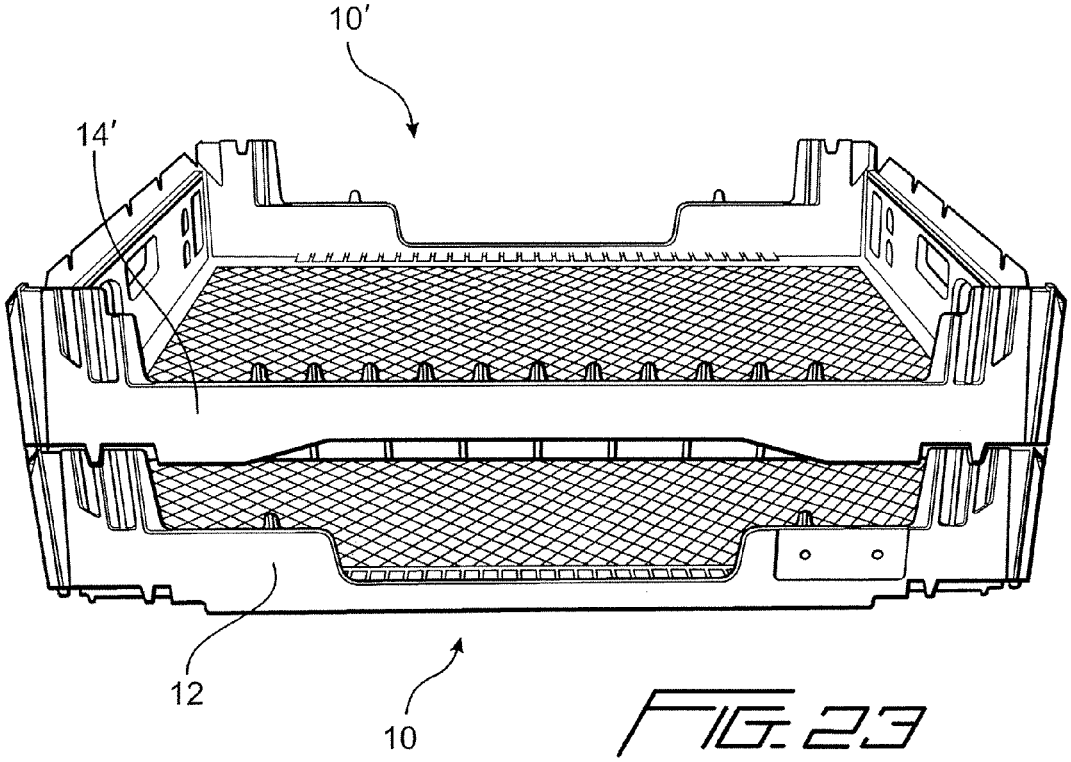
FIG. 23 illustrates a front perspective view of two baskets of FIG. 1 stacked in a 180° stacking configuration according to an embodiment of the present invention.
Figure 24:
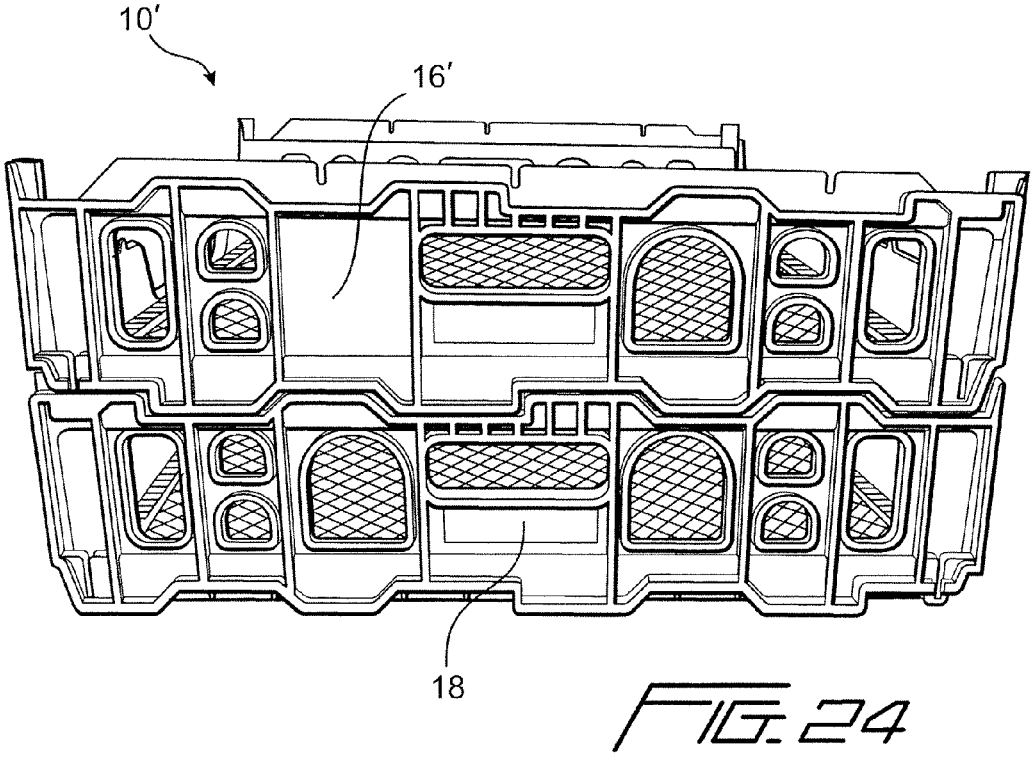
FIG. 24 illustrates a side perspective view of the two baskets shown in FIG. 23 stacked in a 180° stacking configuration according to an embodiment of the present invention.

FIG. 23 illustrates a front view of a lower basket 10 and an upper basket 10' of FIG. 1 stacked in a 180° stacking configuration according to an embodiment of the present invention, and FIG. 24 illustrates a side view of lower basket 10 and an upper basket 10' shown in FIG. 23 stacked in a 180° stacking configuration according to an embodiment of the present invention. In the 180° stacking configuration, upper basket 10', which is substantially similar to lower basket 10, rests on lower basket 10 in an opposite orientation as lower basket 10. Thus, as shown in FIG. 23, front wall 12 of lower basket 10 is visible, and rear wall 14' of upper basket 10 rests upon front wall 12 of lower basket 10. The 180° stacking configuration represents a medium distance between the upper surface 144 of base 20 of lower basket 10, and lower surface 146' of base 20' of upper basket 10'. In the 180° stacking configuration, baked goods can be stacked in interior area 19 one or more levels high: use of window 4 and the window flaps, described in greater detail below, allows consumers to access the baked goods from the interior area 19, which now comprises the inner surfaces of front wall 12, right side wall 16, rear wall 14, left side wall 16, upper surface 144 of lower basket 10, and lower surface 146' of upper basket 10'.

When baskets 10 and 10' are stacked in the 180° stacking configuration, several features provide stacking support and stability such that lateral, frontward, and rearward motion is substantially prevented or reduced. Referring now to FIGS. 1-5, 24, and especially 23 (which shows a front view of lower basket 10 and upper basket 10'), stacking support area 32*a* of lower basket 10 meshes with rear wall stacking support recess 220*b'* of upper basket 10'. Rear wall stacking support recess 220*b'* (and 220*a'*) of upper basket 10' comprises an area defined by inner stacking rearward rail 56*b*+, 90° stacking barrier 46*d'*, and an inner portion of right sidewall stacking feet 54*d'*. Rear wall lower mounting support 58*b'* of upper basket 10' preferably fits into 180° front wall stacking receptacle 60*a* of lower basket 10. The meshing of stacking support area 32*a* of lower basket 10 with rear wall stacking support recess 220*b'* of upper basket 10' and rear wall lower mounting support 58*b'* of upper basket 10' fitting into 180° front wall stacking receptacle 60*a* of lower basket 10 provides not only stacking support, so that lower basket 10 can securely hold additional weight of upper basket 10, but also provide lateral and front-to-back stability to substantially inhibit or prevent shifting of lower and upper baskets 10, 10' with respect to each other. The same features also apply to stacking support area 32*b* of lower basket 10, rear wall stacking support recess 220*a'* of upper basket 10', rear wall lower mounting support 58*b'* of upper basket 10', and 180° front wall stacking receptacle 60*b* of lower basket 10.

Referring again to FIGS. 1-5, and 23, and in particular to the left side of the baskets 10, 10', stacking support area 38*b* of lower basket 10 meshes with front wall stacking support recess 218*a'* of upper basket 10'. Front wall stacking support recess 218*a'* (and 218*b'*) of upper basket 10' comprises an area defined by inner stacking forward rail 50*a'*, 90° stacking barrier 46*a'*, and an inner portion of left sidewall stacking feet 52*d'*. Front wall lower mounting support 42*a'* of upper basket 10' fits into 180° rear wall stacking receptacle 62*b* of lower basket 10. The meshing of stacking support area 38*b* of lower basket 10 with front wall stacking support recess 218*a'* of upper basket 10' and front wall lower mounting support 42*a'* of upper basket 10' fitting into 180° rear wall stacking receptacle 62*b* of lower basket 10 provides not only stacking support, so that lower basket 10 can securely hold additional weight of upper basket 10', but also provides lateral and front-to-back stability to substantially inhibit or prevent shifting of lower and upper baskets 10, 10' with respect to each other. The same features also apply to stacking support area 38*a* of lower basket 10, front wall stacking support recess 218*b'* of upper basket 10', front wall lower mounting support 42*b'* of upper basket 10', and 180° rear wall stacking receptacle 62*a* of lower basket 10.

Referring to FIGS. 1, 7-15 and especially 24, the 180° stacking configuration from a side view (in particular, when viewed from left side wall 18 of lower basket 10) will now be discussed. In FIG. 24, right side wall 16' of upper basket 10' is shown with left side wall 18 of lower basket 10. As can be seen in FIG. 24, right side wall stacking feet 54*a-d'* of upper basket 10' preferably fits into or meshes with left side wall upper stacking receptacles 124*a-d*, and left sidewall stacking projections 126*a-d* fits into or meshes with right side wall lower stacking receptacles 102*a-d'* of upper basket 10'. Similarly, the opposite side of the view illustrated in FIG. 24 is left sidewall 18' of upper basket 10' with right side wall 16 of lower basket 10, and has the same components, fitting together in the same fashion as described above. For the purpose of brevity, therefore, discussion will be limited to the view illustrated in FIG. 24.

The design of right side wall stacking feet 54*a-d'* of upper basket 10' and left side wall upper stacking receptacles 124*a-d* of lower basket 10 is such that frontwardly and rearwardly motion is substantially prevented or reduced. Frontwardly and rearwardly motion between baskets 10, 10' is substantially prevented or reduced by the left side of right side wall stacking feet 54*a*, which is about a 90° vertical surface and the left side of left side wall upper stacking receptacle 124*a*, which is also about a 90° vertical surface. Similarly, the right side of right side wall stacking feet 54*b* is about a 90° vertical surface, and the right side of left side wall upper stacking receptacle 124*b* is also about a 90° vertical surface, and the two pairs of components substantially prevent or inhibit frontward and rearward motion of baskets 10, 10' with respect to each other.

FIGS. 7-15 illustrate additional features of baskets 10 and 10' that substantially prevent or inhibit front-to-back, back-to-front, and lateral motion. As discussed above, base 20 of upper basket 10' comprises right and left base channels 136', 138'. As discussed above, right base channel 136' is formed or defined by inner stacking lateral rail 48*b'*, (FIGS. 9, 14 and 15) and right sidewall stacking feet 54*a-d'* of upper basket 10'. Located within right base channel 136' are a plurality of right base channel projections 140*a-c'* (FIGS. 9, 11 and 15). Right base channel projections 140*a-c'* preferably project downwardly from the top portion of right base channel 136' such that when lower basket 10 is placed in a 180° stacking configuration with respect to upper basket 10', right base channel projections 140*a-c'* (of upper basket 10') mate with left side wall ridge grooves 37*c-a*, respectively (and left base channel projections 142*a-c'* (of upper basket 10') mate with right side wall ridge grooves 36*c-a*, respectively).

In regard to left base channel 138', attention is directed toward FIGS. 10 and 11. Left base channel 138' is formed by inner stacking lateral rail 48*a'* and left sidewall stacking feet 52*a-d'* of upper basket 10. Located within left base channel 138' are a plurality of left base channel projections 142*a-c'*. Left base channel projections 142*a-c'* preferably project downwardly from the top portion of left base channel 138' such that when lower basket 10 is placed in a 180° stacking configuration with respect to upper basket 10', the left base channel projections 142*a-c'* (of upper basket 10') mate with right side wall ridge grooves 36*c-a* of lower basket 10, respectively (and right base channel projections 140*a-c'* (of upper basket 10') mate with left side wall ridge grooves 37*c-a* of lower basket 10, respectively). Thus, because of the mating between left base channel projections 142*a-c'* and right side wall ridge grooves 36*c-a*, respectively, and the mating of right base channel projections 140*a-c*' with left side wall ridge grooves 37*c-a*, respectively, front-to-back motion between an upper basket 10' and lower basket 10 is substantially prevented or inhibited. Lateral motion is also substantially inhibited or prevented because right base channel 136' of upper basket 10' fits snugly over sidewall ridge 34*a* of lower basket 10, and left base channel 138' of upper basket 10' fits snugly over sidewall ridge 34*b* of lower basket 10.

An additional means for substantially inhibiting, preventing, or reducing lateral, frontward, and rearward motion are 180° front stacking projection 130*b*' of upper basket 10', which preferably fits into 180° second stacking receptacle 134*a*. The interaction between 180' front stacking projection 130*b*' of upper basket 10' and 180° second stacking receptacle 134*a* facilitates pivoting and subsequent sliding as discussed below. Further, 180° rear stacking projection 132*b*' of upper basket 10' fits within 180° first stacking receptacle 128*a* of lower basket 10. The same applies for the other side (not shown) of baskets 10-10' when stacked in a 180° stacking configuration, discussion of which is omitted for the purpose of brevity.

Figure 25:
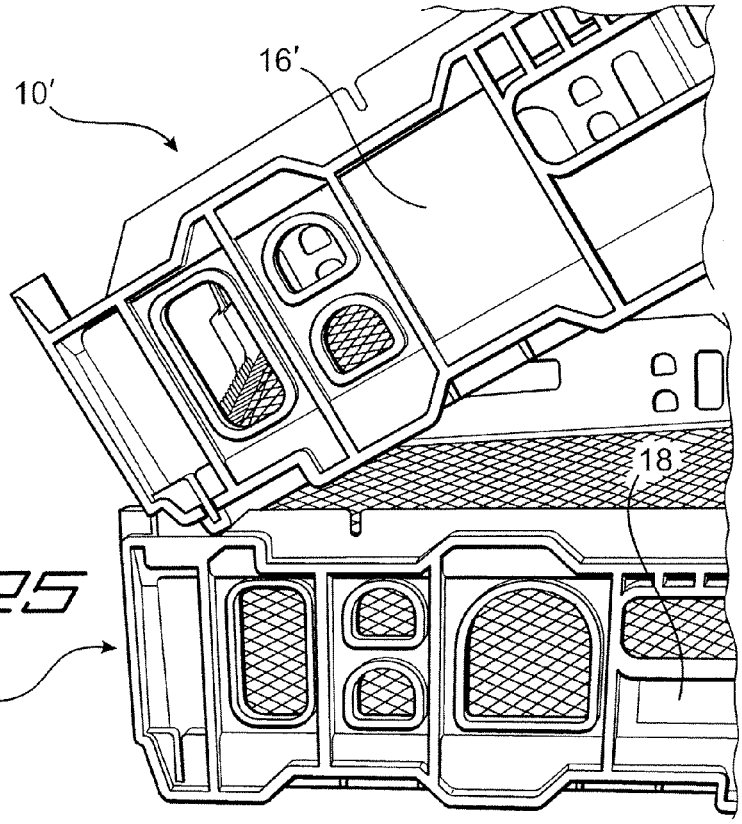
FIG. 25 illustrates a left perspective view of the two baskets shown in FIG. 23 after the upper basket has been pivoted up from the lower basket according to an embodiment of the present invention.

FIG. 25 illustrates a perspective view when pivoting upper basket 10' up from lower basket 10 such that upper basket 10' can then be lowered and slid forward and lifted off lower basket 10 according to an embodiment of the present invention. Pivoting allows a user to slide an upper basket 10' that may be loaded with baked goods out towards a worker that can carry or transport the fully loaded basket 10'. Pivoting and sliding makes it easier to pick up and carry the fully or partially loaded basket 10.

Figure 26:
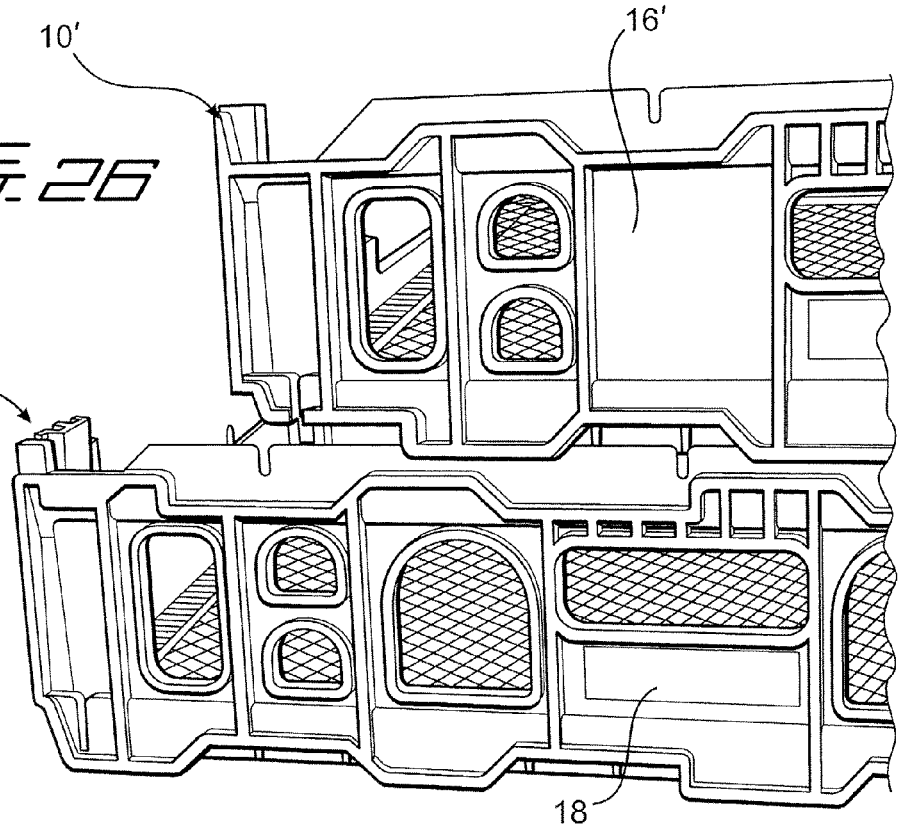
FIG. 26 illustrates a side perspective view of the two baskets shown in FIG. 23 after the upper basket has been pivoted up from the lower basket and then lowered onto the lower basket to be slid out according to an embodiment of the present invention.

To pivot upper basket 10' about lower basket 10 in the 180° stacking configuration, the user preferably lifts the upper basket 10' at any point along the rear wall 14' (FIG. 23) to an angle between about 10° and about 15°. At that point, front wall 12' of basket 10' will slide slightly forward such that 180° front stacking projections 130*a, b*' come into contact with the rear most portion of sidewall ridges 34*a, b*. The side wall ridges 34*a, b* at the rear most point is sloped downward at an angle between about 30° and about 45°, as illustrated in FIG. 1, at points marked A and B (and also C and D, if the user was pivoting upper basket 10 from front wall 12' versus rear wall 14'). The slope of the rearmost portion of sidewall ridges 34*a, b* is optimized to provide substantially easier removal of upper basket 10' from lower basket 10. FIG. 26 illustrates a side view of the two baskets 10 and 10' shown in FIG. 23 after upper basket 10' has been pivoted up from lower basket 10, slid forward, and then lowered onto lower basket 10 to be slid out according to an embodiment of the present invention. After upper basket 10' is pivoted up, slid forward slightly, and then lowered back onto lower basket 10, left and right base channels 136, 138 ride on sidewall ridges 34*a, b*. Furthermore, inner stacking lateral rails 48*a, b*' of upper basket 10 slide through lateral rail channels 98*b,a* of lower basket 10 respectively. The sliding of inner stacking lateral rails 48*a, b*' of upper basket 10 slide through lateral rail channels 98*b,a* of lower basket 10 substantially inhibits or prevents upper basket 10' from moving laterally when being slid off of lower basket 10.

IV. Window Flap

A. Bail Arm 168

Figure 27:
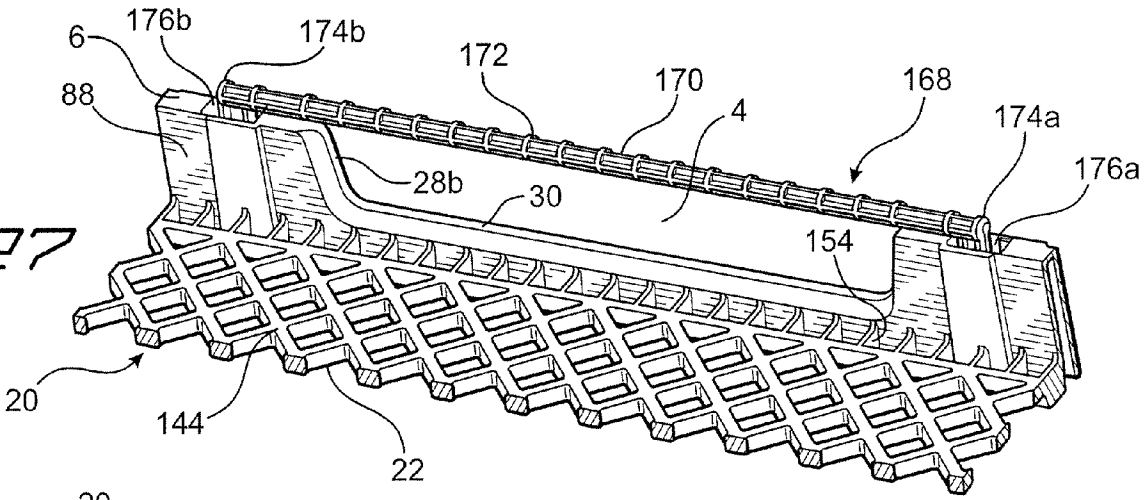
FIG. 27 illustrates a interior-to-exterior perspective view of a bail arm (bail arm) for use in the front wall (window) of the basket of FIG. 1, showing the bail arm in a closed position in the basket according to an embodiment of the present invention.

FIG. 27 is a interior-to-exterior perspective view of a bail arm (bail arm) 168 for use in the front wall window (window) 4 of the basket 10 of FIG. 1, showing the bail arm 168 in a closed position in the basket 10. Bail arm 168 is used to enclose baked goods in interior portion 19 of basket 10 when transported. After basket 10 is located in the place where consumers will obtain baked goods, bail arm 168 is preferably moved from a closed position for shipping (as shown in FIG. 27 as bail arm 168') to an open position (for retrieval of baked goods), as shown in FIGS. 29, and 30-33. Bail arm 168 comprises a central bail arm rod 170, upon which are a plurality of bail arm knobs 172, bail arm crank members 174*a, b*, bail arm outwardly turned portions 178*a, b*, and bail arm nipples 180*a, b*. According to an exemplary embodiment of the present invention, bail arm 168 is preferably made of plastic, such as crate-grade high density polyethylene, among other types. As one of ordinary skill in the art can appreciate, however, other high strength materials can also be used to make bail arm 168, including, preferably, a high strength steel.

Figure 28:
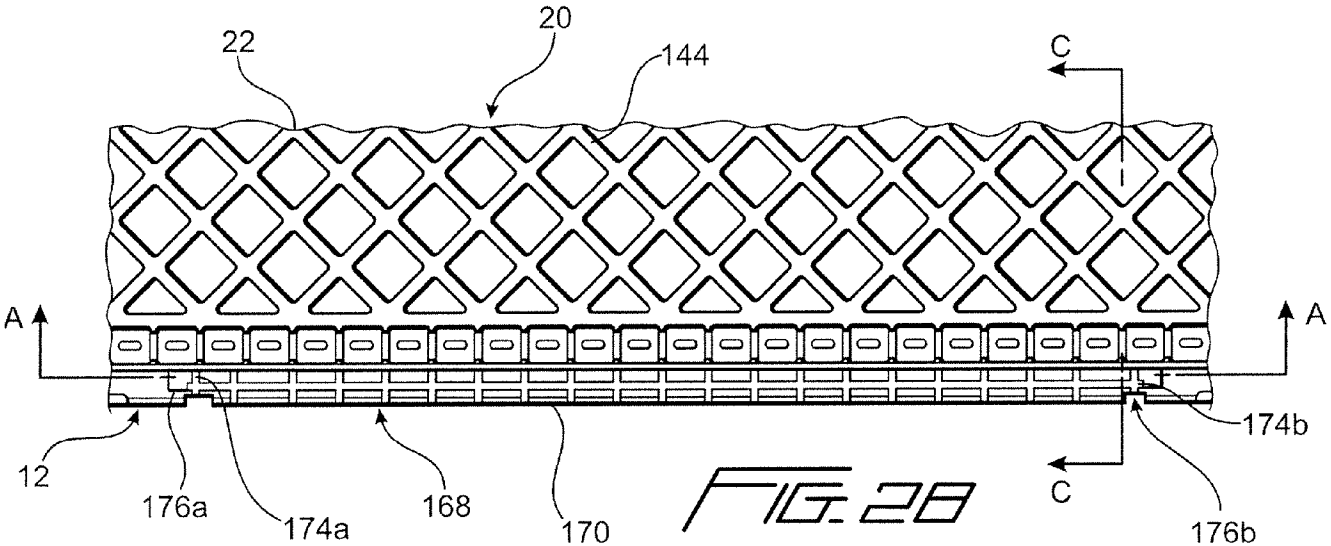
FIG. 28 illustrates a top view of the bail arm shown in FIG. 27 in the closed position.
Figure 29:
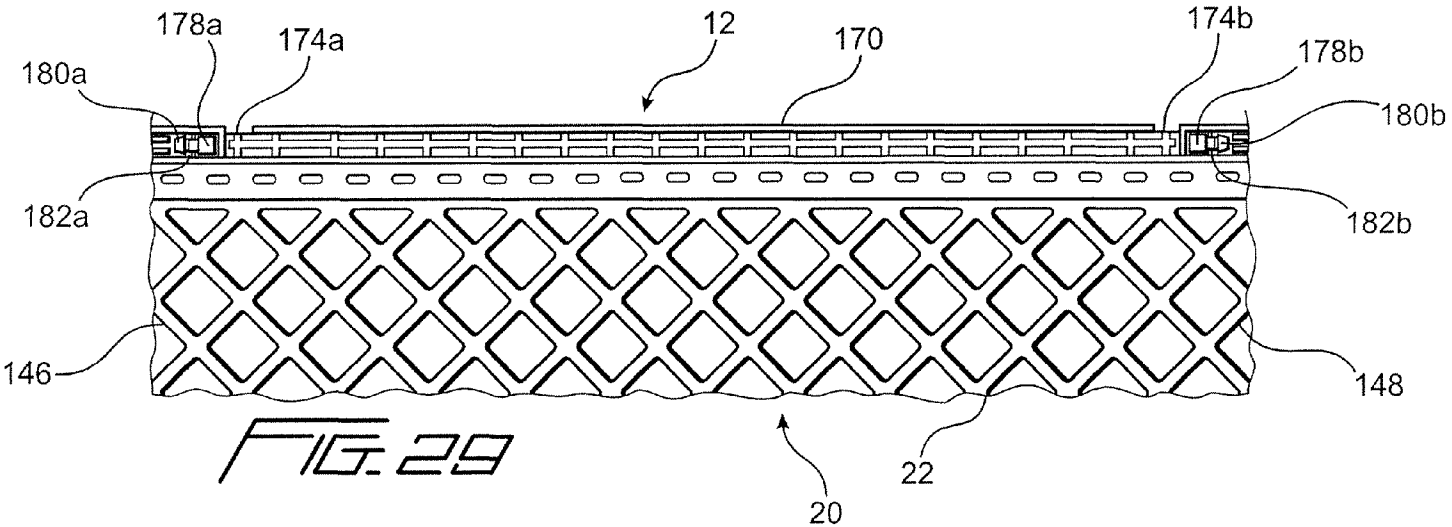
FIG. 29 illustrates a bottom view of the bail arm shown in FIG. 27 in the open position.
Figure 30:
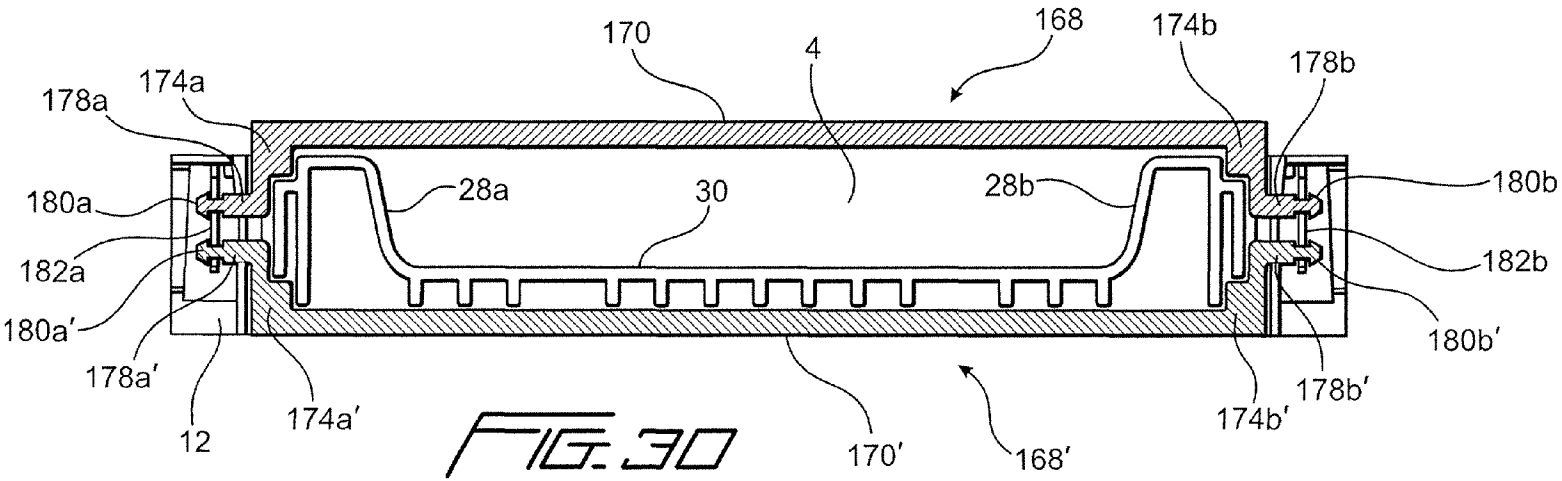
FIG. 30 illustrates a cross sectional view of the basket of FIG. 1 with the bail arm in both an open and closed position along lines A-A as shown in FIG. 28.

FIG. 30 is a cross sectional view of basket 10 of FIG. 1 with bail arm 168 in both an open and closed position along lines A-A as shown in FIG. 28. As seen in FIGS. 27 and 30, bail arm 168 fits into bail arm crank member receptacle 176*a, b* that is part of front wall 12. Preferably, bail arm crank member receptacle 176*a, b* is generally rectangular in shape, to match the shape of bail arm crank member 174*a, b*. Front wall 12 also has, as shown in FIG. 29 and FIG. 30, front wall bail arm nipple receptacle 182. The shape of bail arm nipple 180*a, b*, and the interaction between it and bail arm nipple receptacle 182*a, b* provide for bail arm 168 to be rotationally fixed to front wall 12 of basket 10. As shown in FIG. 30, bail arm outwardly turned portion 178 recesses into basket 10 when in both the open and closed position.

Figure 31:
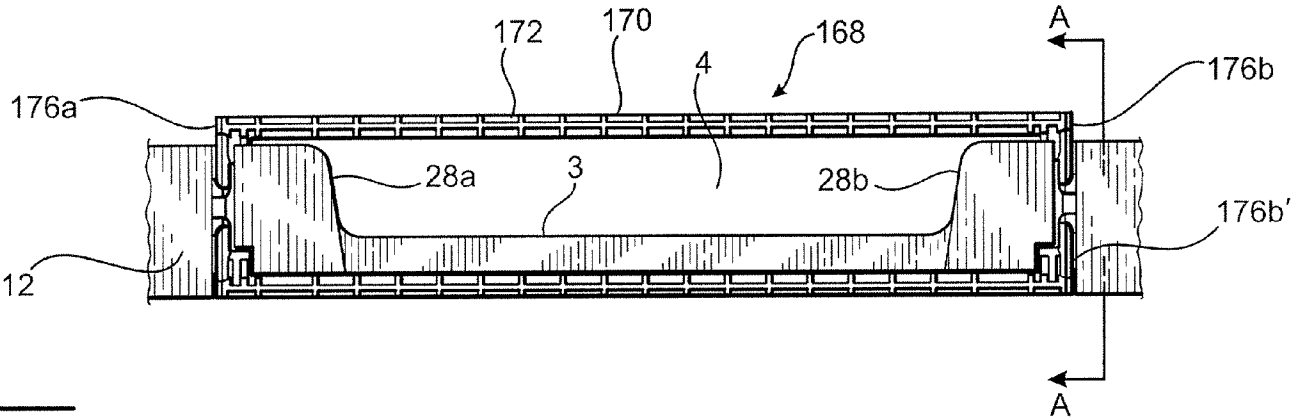
FIG. 31 illustrates a front view of the basket of FIG. 1 with the bail arm in both an open and closed position.
Figure 32:
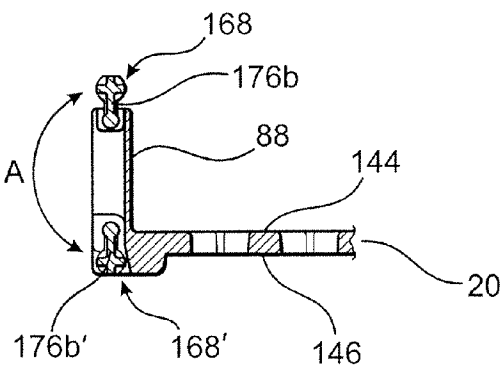
FIG. 32 illustrates a cross sectional view of the basket of FIG. 1 with the bail arm in both an open and closed position along lines C-C as shown in FIG. 28.

Bail arm 168 can rotate from its closed position to its open position as shown in FIGS. 30, 31, and 32. As shown in FIG. 32 bail arm 168 can rotate from a closed position (168) to an open position (168'), along arc A. Referring back to FIG. 30, when bail arm 168 is in the closed position, bail arm nipple 180*a, b* is in an upper location of bail arm nipple receptacle 182*a, b*, and when bail arm 168' is moved to the open position, bail arm nipples 180*a', b*' have moved to a lower portion of bail arm nipple receptacle 182*a, b*. In the open position, bail arm 168' fits flush, or recessed within, with the bottom of front wall 12, so that substantially all of bail arm 168' is contained within the perimeter of basket 10.

Operation of bail arm 168 proceeds as follows: A user grabs bail arm 168 about bail arm rod 170, and rotates bail arm 168 from either its open to closed position, or from its closed to open position. When closed (FIG. 27), bail arm rod 170 of bail arm 168 substantial sits upon, or above the top surface of front wall 12. Bail arm nipples 180*a, b* are in their upper position (FIG. 30) in front wall nipple receptacle 182*a, b*. Following rotation from the closed to open position, bail arm 168 is substantially flush with lower surface 146 of base 20, and front wall outer surface 86, so that substantially no portion of bail arm 168 extends beyond front wall 12 or base 20 of basket 10. In the open position, bail arm nipples 180*a, b* have moved to their lower position (FIG. 30) within front wall nipple receptacle 182. When moving from an open to a closed position, bail arm nipples 180*a, b* rotate and slide upwardly to the closed position. When moving from a closed to an open position, bail arm nipples 180*a, b* rotate and slide downwardly to the open position.

Figure 33:
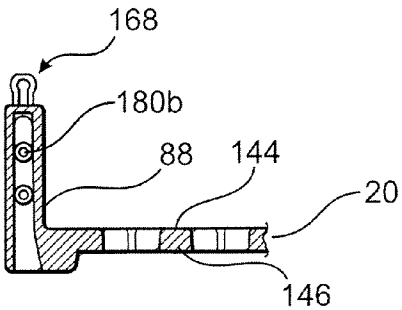
FIG. 33 illustrates another cross sectional view of the bail arm along line A-A as shown in FIG. 31.

FIG. 28 is a top view of bail arm 168 shown in FIG. 27 in the closed position. FIG. 29 is a bottom view of bail arm 168' shown in FIG. 27 in the open position. FIG. 31 is a front view of basket 10 of FIG. 1 with bail arm 168 in both an open (168') and closed (168) position. FIG. 32 is a cross sectional view of basket 10 of FIG. 1 with bail arm 168 in both an open (168') and closed (168) position along lines C-C as shown in FIG. 28. FIG. 33 is another cross sectional view of bail arm 168 along line A-A as shown in FIG. 31. Bail arm 168, as well as lift gate 184 and side flap 196 can be either automatically or manually inserted into basket 10.

B. Lift Gate 184

Figure 34:
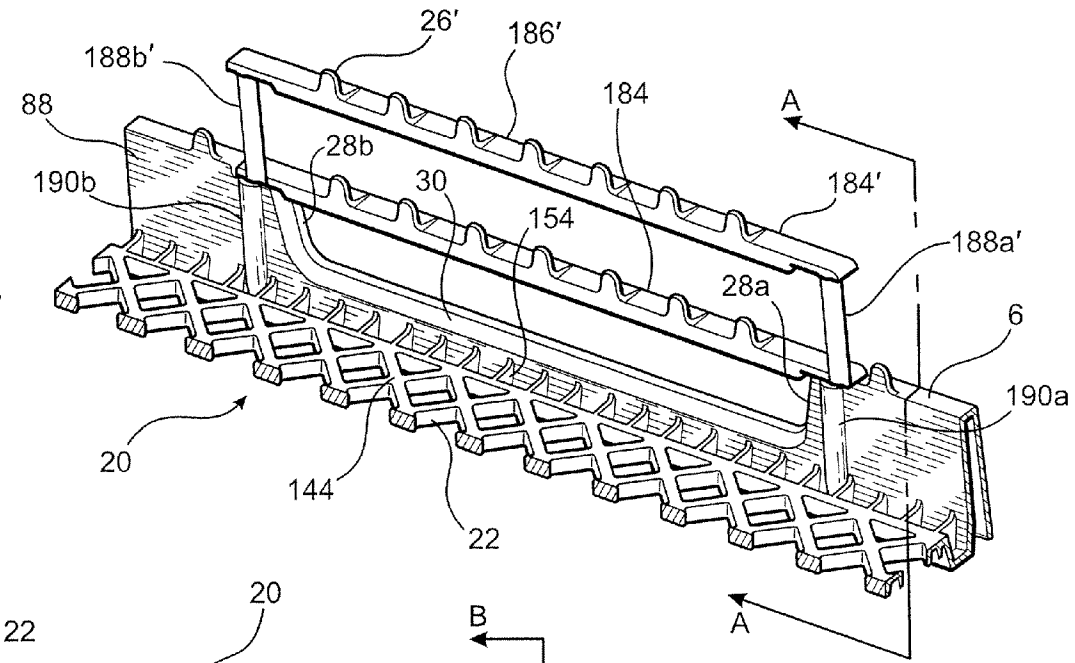
FIG. 34 illustrates a interior-to-exterior perspective view of a lift gate (lift gate) for use in the front wall window of the basket of FIG. 1, showing the lift gate in both an open and a closed position in the basket according to an embodiment of the present invention.

FIG. 34 is a interior-to-exterior perspective view of a lift gate (lift gate) 184 for use in window 4 of basket 10 of FIG. 1, showing the lift gate 184 in both an open and a closed position in basket 10. As with bail arm 168, lift gate 184 is used to enclose baked goods in interior area 19 of basket 10 when transported. After basket 10 is located in the place where consumers will obtain the baked goods, lift gate 184 is preferably moved from a closed position (as shown in FIG. 34 as lift gate 184) to an open position. When in the closed position, the top of lift gate 184 (i.e., lift gate cross member 186) is substantially flush with front wall 12. The lift gate is shown in the open position in FIGS. 34, and 38-41 as lift gate 184'. In the open position, lift gate cross member 186' is above the top surface of front wall 12.

Figure 37:
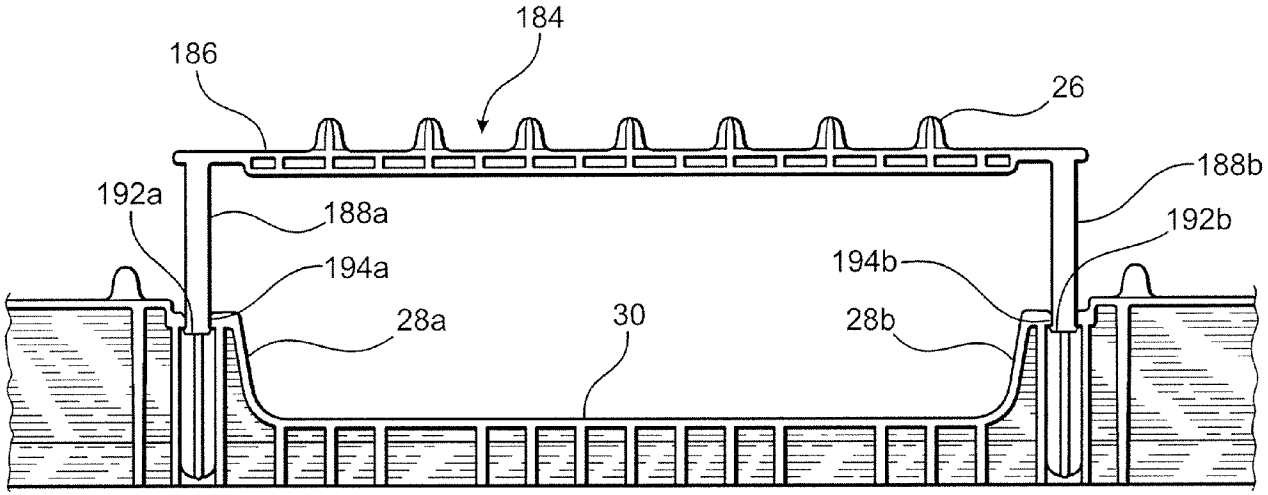
FIG. 37 illustrates a cross sectional view of the basket of FIG. 1 with the lift gate in an open position along lines A-A as shown in FIG. 35.

Lift gate 184 comprises a lift gate cross member 186, upon which are a plurality of teeth 26, and first and second lift gate posts 188*a, b*. Lift gate cross member 186, along with the plurality of teeth 26, substantially prevents or inhibits baked goods from spilling out from basket 10 during transit. Lift gate 184 further comprises first and second lift gate post nipples 192*a, b* at the bottom of lift gate posts 188*a, b* (FIG. 37). According to an exemplary embodiment of the present invention, lift gate 184 is preferably made of plastic, such as crate-grade high density polyethylene, among other types. As one of ordinary skill in the art can appreciate, however, other high strength materials can also be used to make lift gate 184, including, preferably, a high strength steel. Furthermore, as shown in FIG. 34, basket 10, and more specifically front wall 12, comprises first and second post housing 190*a, b* to house lift gate posts 188*a, b* respectively, and function to lock lift gate 184 in an upper open position (184') and a lower closed position (184), as more fully described below.

Operation of lift gate 184 proceeds as follows: A user grasps lift gate 184 about lift gate cross member 186, and either lifts it up from the closed to the open position, or pushes it down from the open to closed position. When closed, lift gate cross member 186 of lift gate 184 is substantially flush with the top surface 6 of front wall 12. When open, there is ample room for a consumer to reach through extended window 4 (now defined to encompass the area bordered by first and second lift gate posts 188*a, b*, lift gate cross member 186, window vertical surfaces 28*a, b*, and window surface 30) and obtain the baked products/goods that are stored in the interior area 19 of basket 10.

Lift gate 184 is separately made from basket 10, and inserted into post housings 190*a, b*. The user of basket 10 pushes lift gate posts 188*a, b*, into post housings 190*a, b* respectively, with lift gate post nipples 19*a, b* inserted into post housing 190*a, b* first. Lift gate posts 188*a, b* can either be solid or hollow, but are preferably substantially circular. Post housings 190*a, b* are also preferably substantially circular (though that need not always be the case), and are sized to allow lift gate posts 188*a, b* to slidingly engage or travel within them. When lift gate post nipples 19*a, b* are forcible pushed into post housing openings 194*a, b* of post housings 190*a, b* (lift gate post nipples 192*a, b* have a larger outer diameter than the inner diameter of post housing openings 194*a, b*), lift gate post nipples 19*a, b* "pop" into post housings 190*a, b* and then slidingly frictionally engage an interior surface of post housings 190*a, b*, providing sufficient frictional force to allow lift gate 184 to remain in whatever position the user desires, from fully closed (substantially flush with top surface 6 of front wall 12), to substantially open (wherein lift gate 184' is lifted to its uppermost position, as defined by when lift gate post nipples 190*a, b* reach the uppermost position of travel within post housing 190*a, b*, as shown in cross section view FIG. 37), or any position there between.

Figure 35:
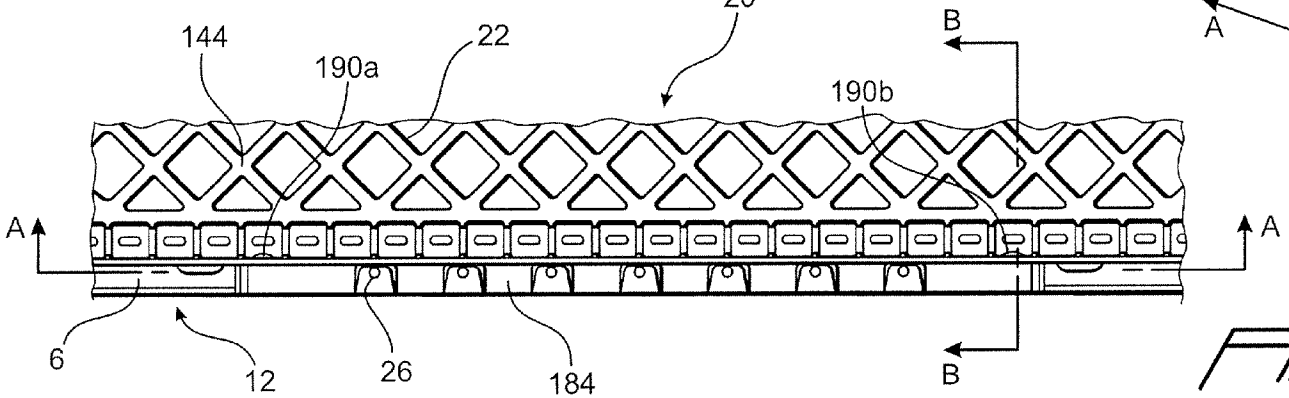
FIG. 35 illustrates a top view of the lift gate shown in FIG. 34 in the closed position.
Figure 36:
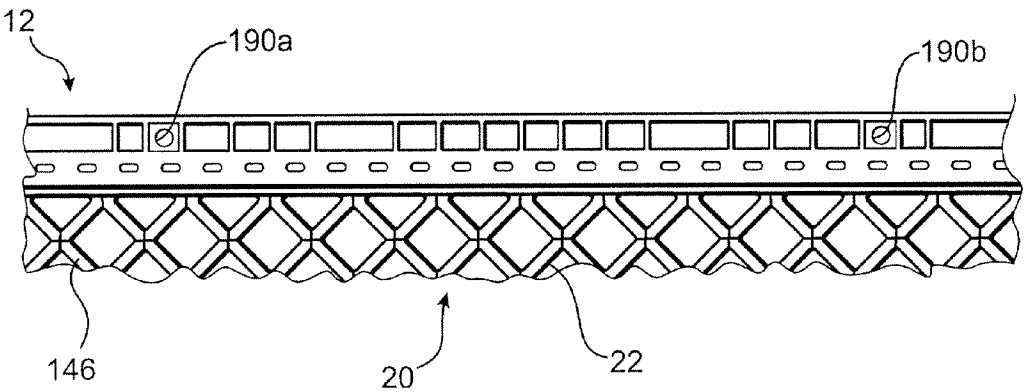
FIG. 36 illustrates a bottom view of the lift gate shown in FIG. 34.
Figure 38:
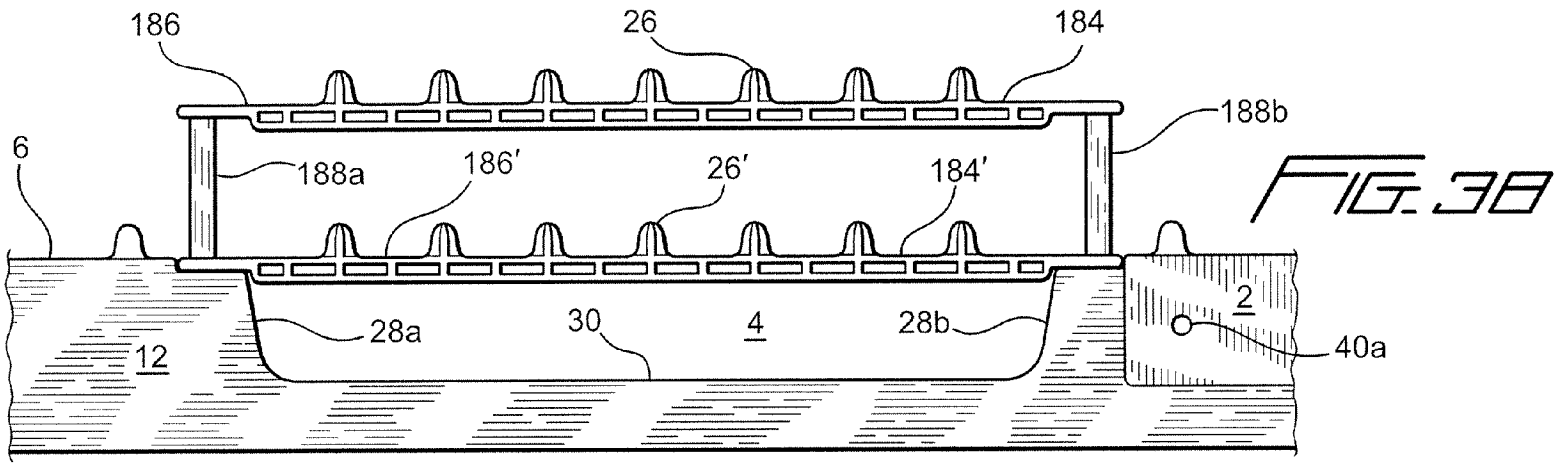
FIG. 38 illustrates a front view of the basket of FIG. 1 with the lift gate of FIG. 34 in both an open and closed position.
Figure 39:
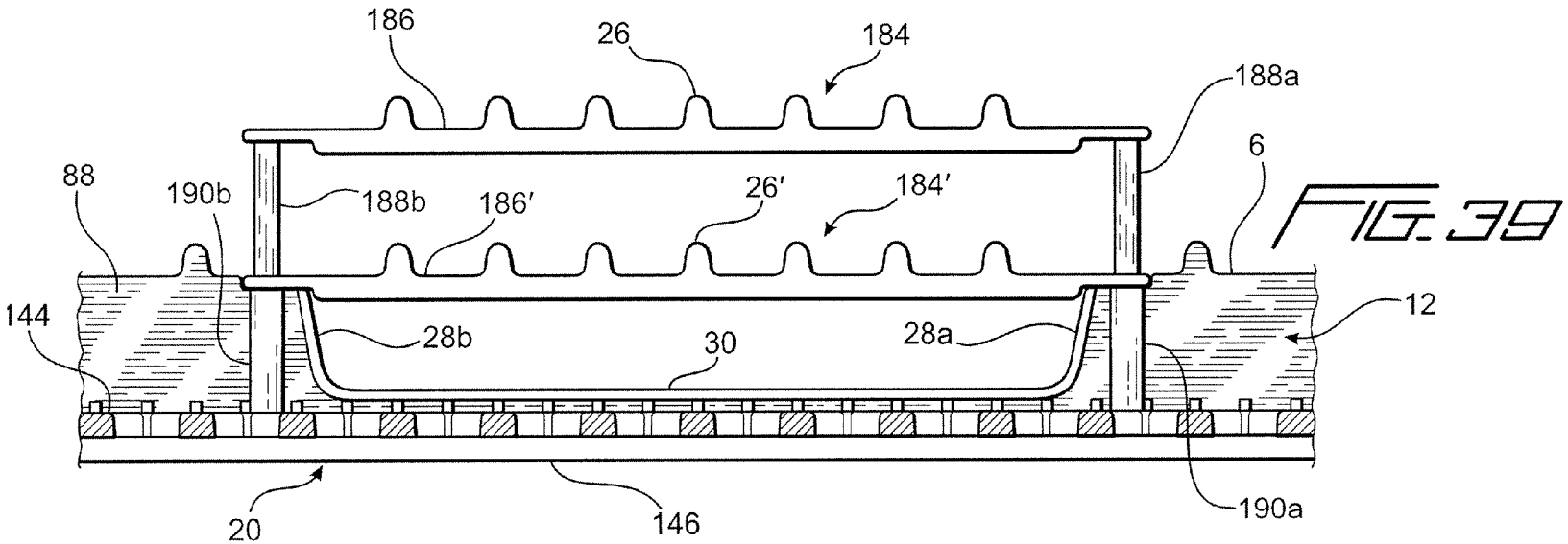
FIG. 39 illustrates an interior-to-exterior view of the basket of FIG. 1 with the lift gate of FIG. 34 in both an open and closed position.
Figure 41:
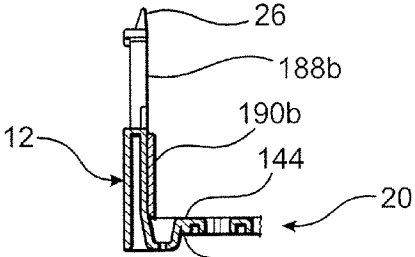
FIG. 41 illustrates another cross sectional view of the lift gate along line A-A as shown in FIG. 34.
Figure 40:
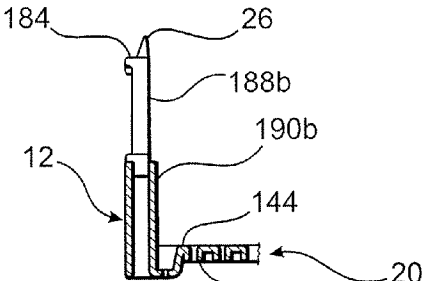
FIG. 40 illustrates a cross sectional view of the basket of FIG. 1 with the lift gate in a closed position along lines B-B as shown in FIG. 35.

FIGS. 35-41 illustrate a plurality of views of lift gate 184 and basket 10. FIG. 35 is a top view of the lift gate 184 shown in FIG. 34 in the closed position, and FIG. 36 is a bottom view of the lift gate 184 shown in FIG. 34. FIG. 37 is a cross sectional view of basket 10 of FIG. 1 with the lift gate 184' in an open position along lines A-A as shown in FIG. 35. FIG. 38 is a front view of the basket 10 of FIG. 1 with the lift gate 184 of FIG. 34 in both an open (184') and closed (184) position. FIG. 39 is an interior-to-exterior view of basket 10 of FIG. 1 with lift gate 184 of FIG. 34 in both an open and closed position. FIG. 40 is a cross sectional view of basket 10 of FIG. 1 with lift gate 184' in an open position along lines B-B as shown in FIG. 35, and FIG. 41 is another cross sectional view of lift gate 184 along line A-A as shown in FIG. 34.

C. Side Flap 196

Figure 42:
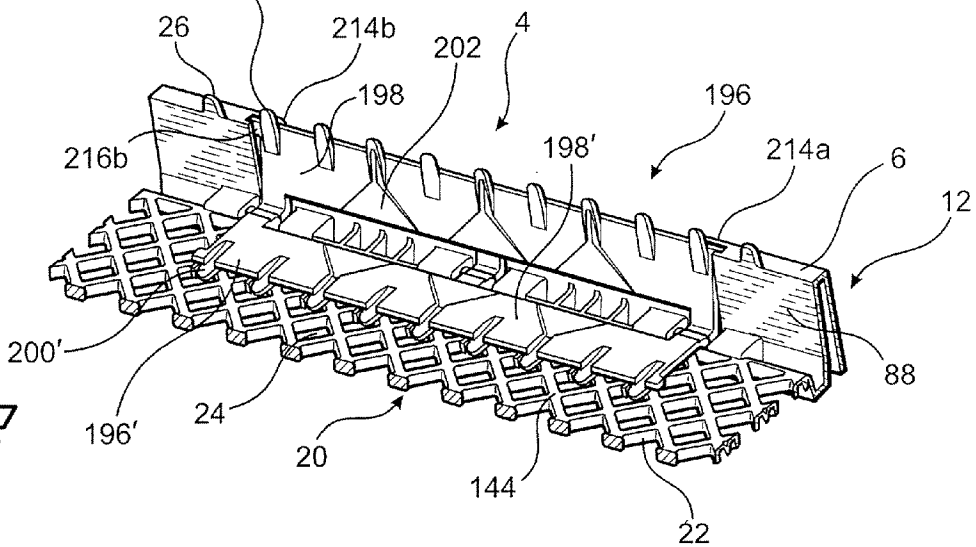
FIG. 42 illustrates a interior-to-exterior perspective view of a merchandiser window side flap (side flap) for use in the front wall merchandiser window (window) of the basket of FIG. 1, showing the side flap in both an opened and closed position in the basket according to an embodiment of the present invention.
Figure 47:
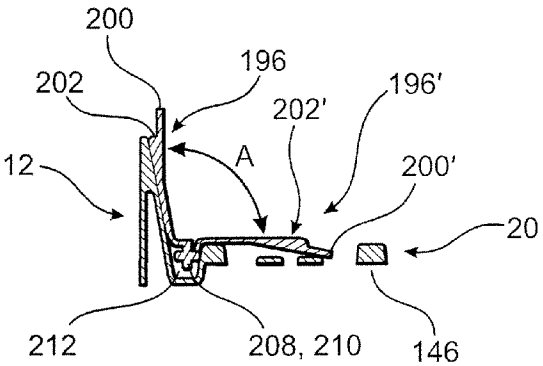
FIG. 47 illustrates a cross sectional view of the basket of FIG. 1 with the side flap of FIG. 42 in both an open and a closed position along lines E-E as shown in FIG. 43.
Figure 46:
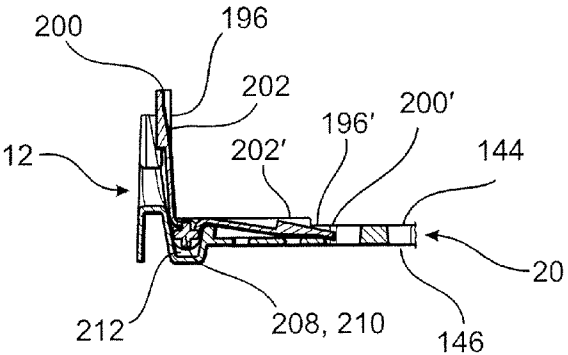
FIG. 46 illustrates a cross sectional view of the basket of FIG. 1 with the side flap of FIG. 42 in both an open and a closed position along lines B-B as shown in FIG. 43.

FIG. 42 is a interior-to-exterior perspective view of a side flap (side flap) 196 for use in window 4 of basket 10 of FIG. 1, showing the side flap 196 in both an opened (196) and closed (196') position in the breadbasket 10. As with bail arm 168 and lift gate 184, side flap 196 is used to enclose baked goods in interior area 19 of basket 10 when transported. After basket 10 is located in the place where consumers will obtain the baked goods, side flap 196 is preferably moved from a closed position (as shown in FIG. 42 as side flap 196) to an open position, as shown in FIGS. 42, 46, and 47 as side flap 196'.

Side flap 196 preferably comprises a side flap wall 198, which is substantially planar (except as otherwise noted below), side flap teeth 200, side flap wedge 202, side flap retainers 216*a, b*, side flap hinge assembly 208, and hinge rod 210. To utilize side flap 196, basket 10 further comprises side flap teeth recess 204, side flap wedge recess 206, side flap closed retention lip 214*a, b*, and side flap hinge recess 212 that interacts with several components of side flap 196 including, for example, side flap teeth 200, side flap wedge 202, side flap retainers 216*a, b*, side flap hinge assembly 208, and hinge rod 210, to allow side flap 196 to rotate from an opened to closed position, and visa-versa, and to recess side flap 196 into base 20 of basket 10, as shall be described in greater detail below.

Figure 43:
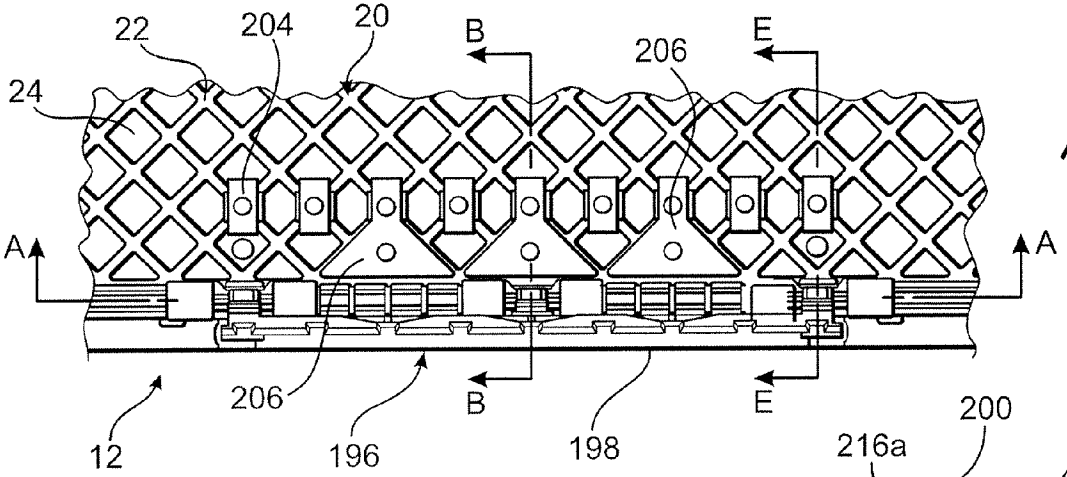
FIG. 43 illustrates a top view of the side flap of FIG. 42 in the closed position.
Figure 44:
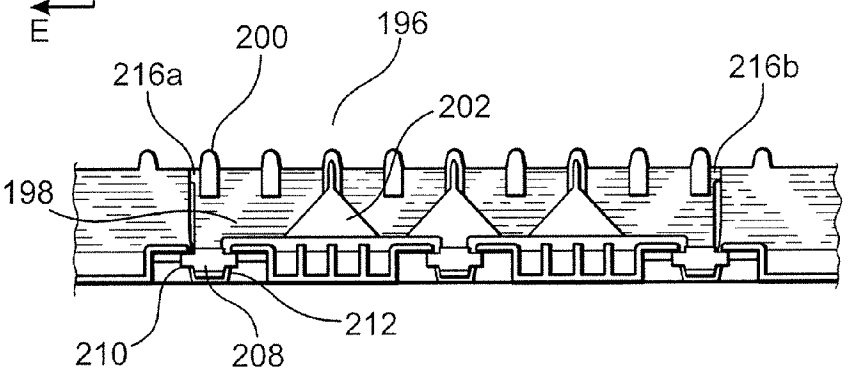
FIG. 44 illustrates a cross sectional view of the side flap of FIG. 42 along lines A-A as shown in FIG. 43.

FIG. 43 is a top view of side flap 196 shown in FIG. 42 in the closed position, and FIG. 44 is a cross sectional view of side flap 196 along lines A-A as shown in FIG. 43. As shown in FIG. 44, base 20, according to an exemplary embodiment of the present invention, comprises a plurality of side flap hinge recesses 212. Each of the plurality of side flap hinge assemblies 208 and hinge rods 210 preferably snaps into a correspondingly sized and shaped side flap hinge recess 212. The fitting of the side flap hinge assemblies 208 and hinge rods 210 into side flap hinge recess 212 allows side flap 196 to pivot about the hinge rods 210, from a closed position, to an open position, and visa-versa. When open, as shown in FIGS. 42, 46, and 47, side flap wedges 202' and side flap teeth 200' preferably fit into side flap wedge recesses 206 (shown in FIG. 43), and side flap teeth recess 204 (also shown in FIG. 43), respectively, which as FIGS. 46 and 47 illustrate, allows the outer surface of side flap wall 198' to be substantially planar with the base upper surface 144. In the open position, side flap 196' lies substantially parallel and adjacent to an upper level of base 20 of basket 10. Once the side flap 196' is in this open position, baked good(s) can be freely retrieved from the interior area 19 of basket 10. When a user wants to close side flap 196', side flap 196' is pushed up from the bottom surface of base 20 through openings 24 and up to a substantially vertical position, where side flap 196 is substantially planar (i.e., flush and even) with front wall 12. Side flap retainer 216*a, b* (shown in FIGS. 42, 44, 48, 49, 50, and 52) preferably interfaces with side flap closed retention lips 214*a, b* (shown in FIGS. 42 and 45) so that side flap 196 cannot extend too far forward from basket 10. Side flap closed retention lips 214*a, b* ensure that side flap 196 is substantially planar with front wall 12. When closed, side flap 196 substantially occupies all of window 4 of front wall 12.

The design of side flap 196 provides several unique advantages. First, side flap 196 comprises a plurality of side flap teeth 200 that retain baked goods when stored in an interior area 19 of breadbasket 10. Second, side flap 196 is able to effectively recess into base 20, thereby providing an unimpeded area for a consumer to retrieve baked goods when desired. Additionally, because of the plurality of side flap hinge assemblies 208 and side flap hinges recesses 212, side flap 196 moves efficiently, without binding or twisting. Side flap hinge assemblies 208 provide a frictional rotational engagement between side flap 196 and basket 10 (i.e., side flap hinge recess 212), such that side flap 196 remains in an open position, closed position, or any position there between. Further, side flap 196 can easily be restored to its closed position with substantially minimal effort.

Figure 45:
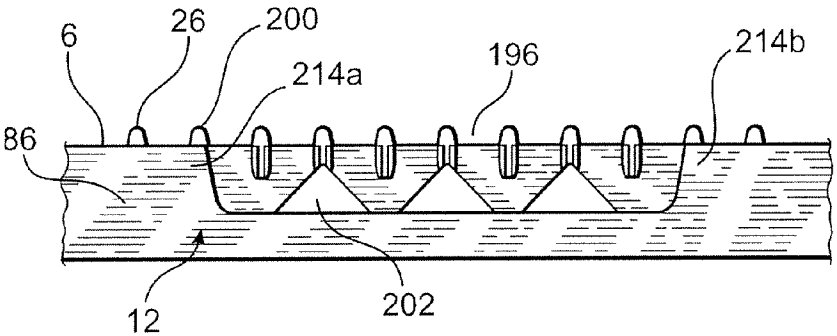
FIG. 45 illustrates a front view of the basket of FIG. 1 with the side flap of FIG. 42 in a closed position.
Figure 48:
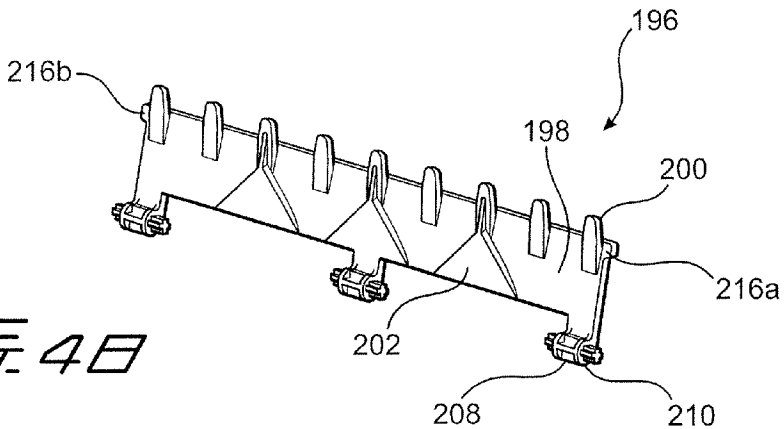
FIG. 48 illustrates a back perspective view of the side flap shown in FIG. 42.
Figure 49:
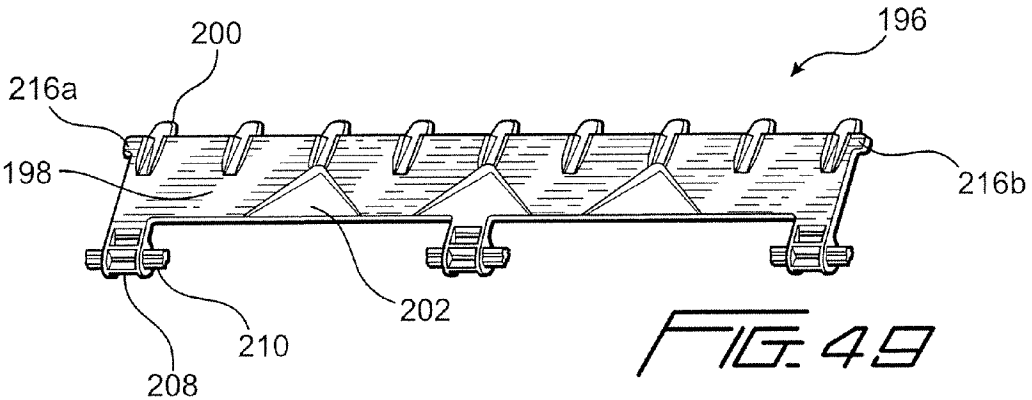
FIG. 49 illustrates a front perspective view of the side flap shown in FIG. 42.
Figure 50:
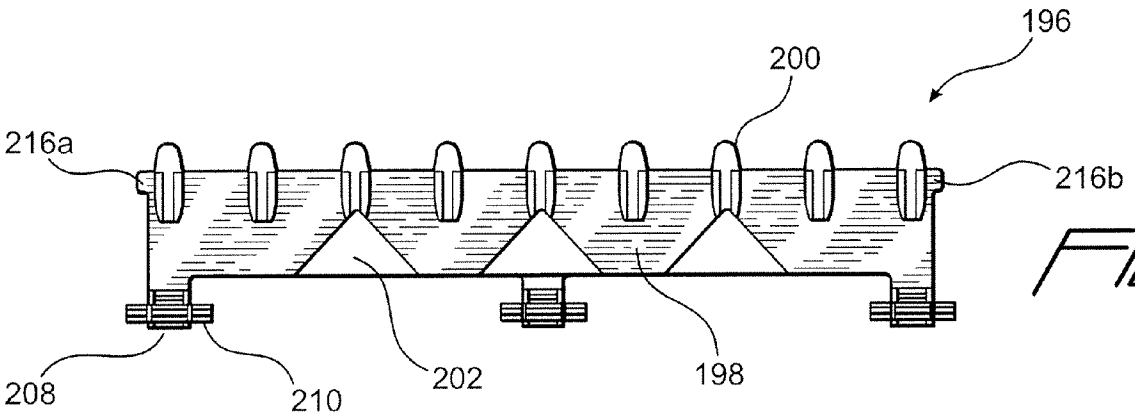
FIG. 50 illustrates a front view of the side flap shown in FIG. 42.
Figure 51:
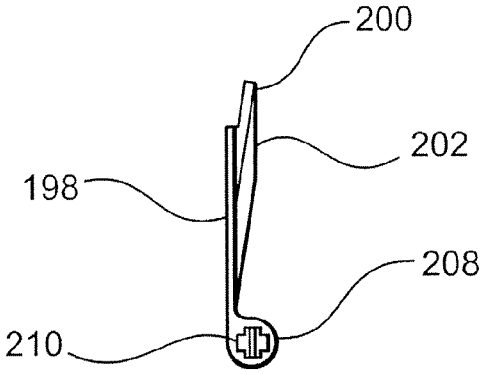
FIG. 51 illustrates a side view of the side flap shown in FIG. 42.
Figure 52:
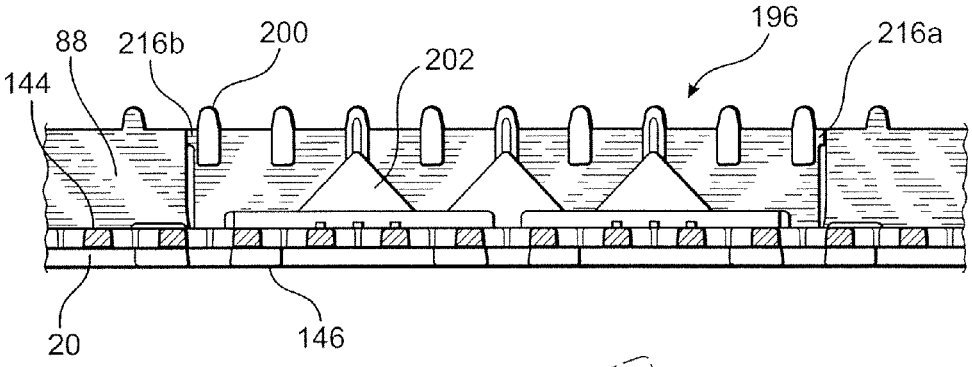
FIG. 52 illustrates an interior-to-exterior view of the basket of FIG. 1, showing the side flap of FIG. 42 in a closed position in the basket.

FIGS. 45-52 illustrate several perspective, front, and side views of side flap 196. FIG. 45 is a front view of basket 10 of FIG. 1 with the side flap 196 of FIG. 42 in a closed position (196), and FIG. 46 is a cross sectional view of basket 10 of FIG. 1 with the side flap 196 in both an open (196') and a closed position (196) along lines B-B as shown in FIG. 43. FIG. 47 is a cross sectional view of basket 10 of FIG. 1 with side flap 196 in both an open (196') and a closed (196) position along lines E-E as shown in FIG. 43, and FIG. 48 is a back perspective view of the side flap 196 shown in FIG. 42. FIG. 49 is a front perspective view of the side flap 196 shown in FIG. 42, and FIG. 50 is a front view of side flap 196 shown in FIG. 42. FIG. 51 is a side view of side flap 196 shown in FIG. 42, and FIG. 52 is an interior-to-exterior view of basket 10 of FIG. 1, showing side flap 196 in a closed position in basket 10.

D. Multiple Window and Flap Embodiments of the Present Invention

According to another embodiment of the present invention, basket 10 can be manufactured with one or more windows 4. In this case, second window 4' is located on rear wall 14. In second window 4', a second bail arm 168', a second lift gate 184' or a second side flap 196' can be inserted and used to substantially inhibit or prevent baked goods from spilling out of basket 10 during transit. According to still a further embodiment of the present invention, any combination of bail arms 168, lift gate 184 or side flaps 196 can be used together. Thus, for example, a bail arm 168 can be in window 4 in front wall 12, while either a second bail arm 168', second lift gate 184' or a second side flap 196' can be inserted in second window 4'. The same is equally true if a lift gate 184 is in window 4 of front wall 12, or a side flap 196 is in window 4 of front wall 12.

V. Anti-Slip Features

A. Gator Jaw

Figure 56:
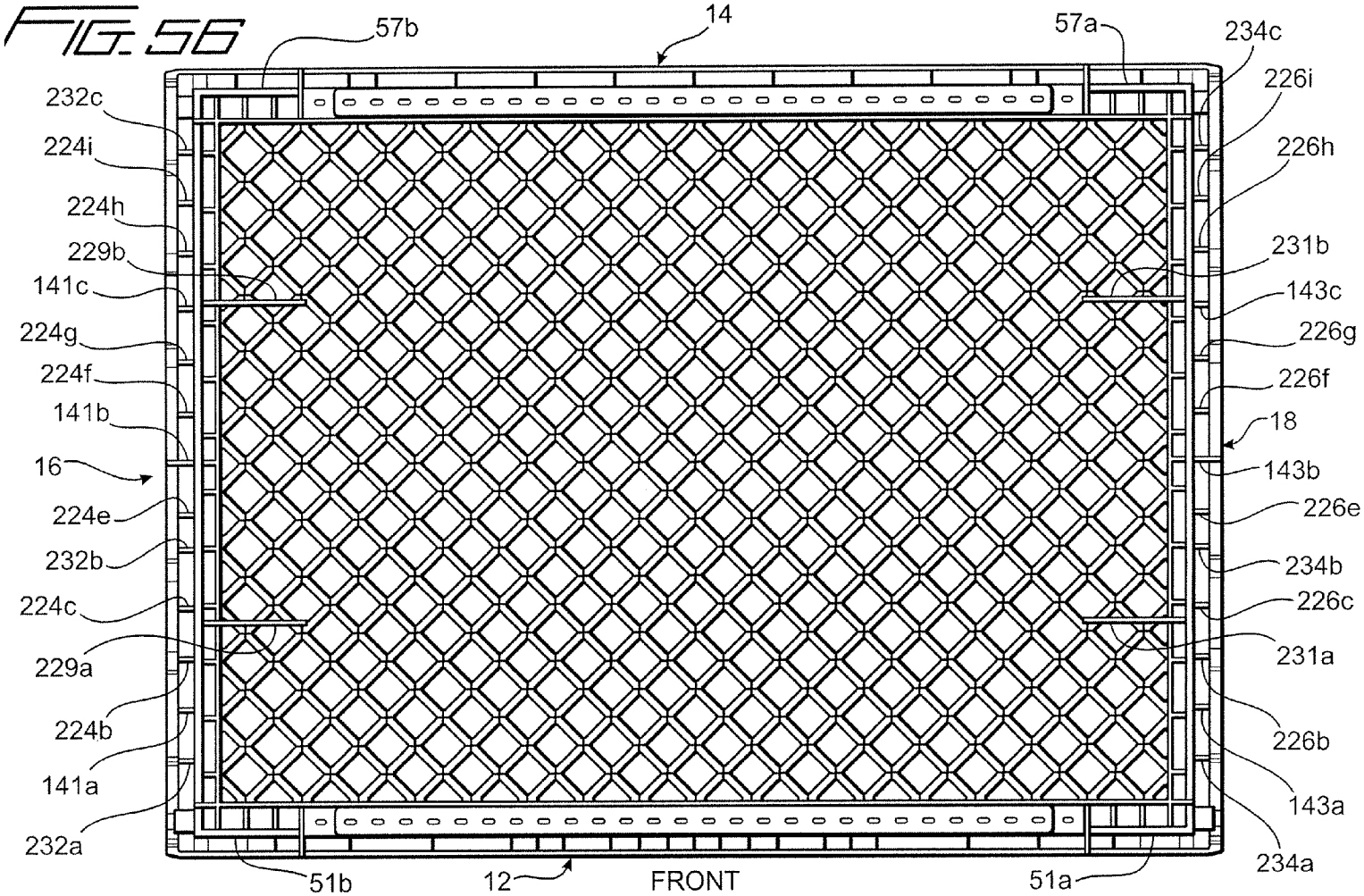
FIG. 56 illustrates a bottom plan view of a basket according to an alternative embodiment of the present invention.

FIG. 56 illustrates a bottom plan view of a basket according to an alternative embodiment of the present invention. The basket of FIG. 56, which contains several additional different features than described above, shall hereinafter be referred to as basket 11. It should be understood, however, that any of the features that will now be described in reference to basket 11 can be combined with the features of basket 10 in many different combinations, and basket 11 shall not be considered to be mutually exclusive of basket 10. In other words, a continuum of baskets can be manufactured using any combination of features of basket 10 described above, and the features described in alterative embodiment basket 11, described below.

Figure 55:
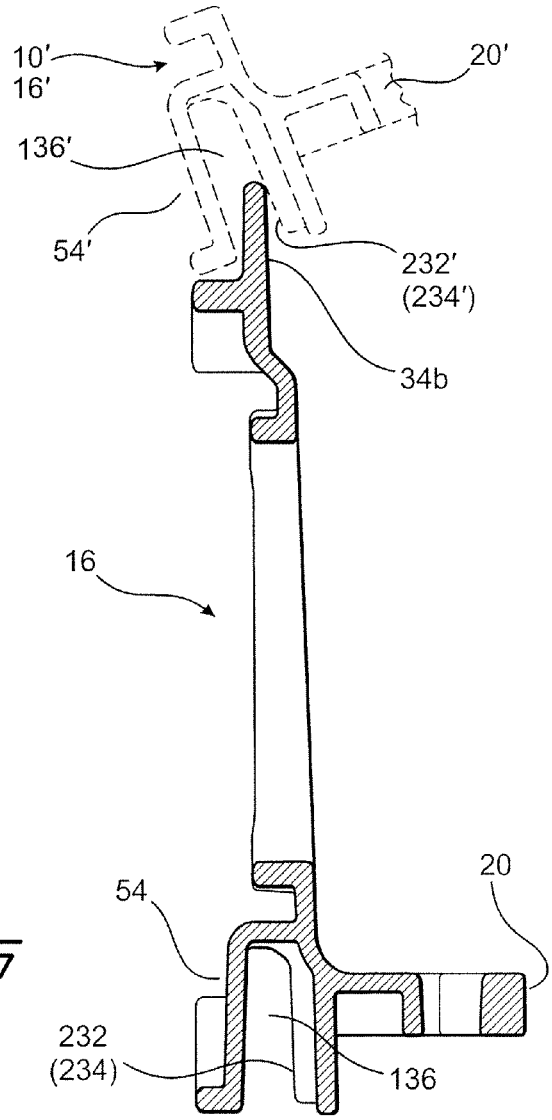
FIGS. 53-55 illustrate several cross sectional views of a right sidewall of a basket according to an alternative embodiment of the present invention.
Figure 53:
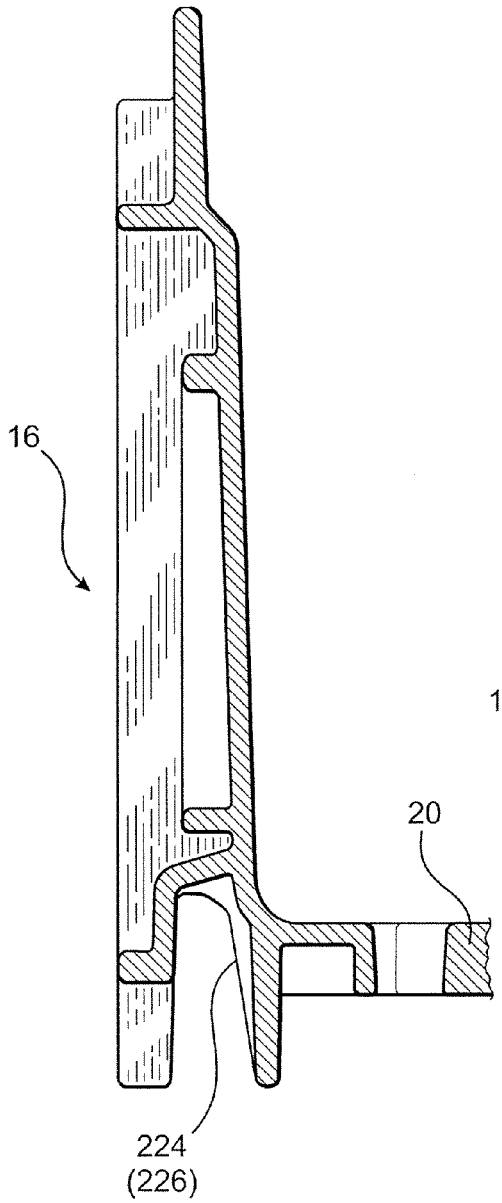
Figure 54:
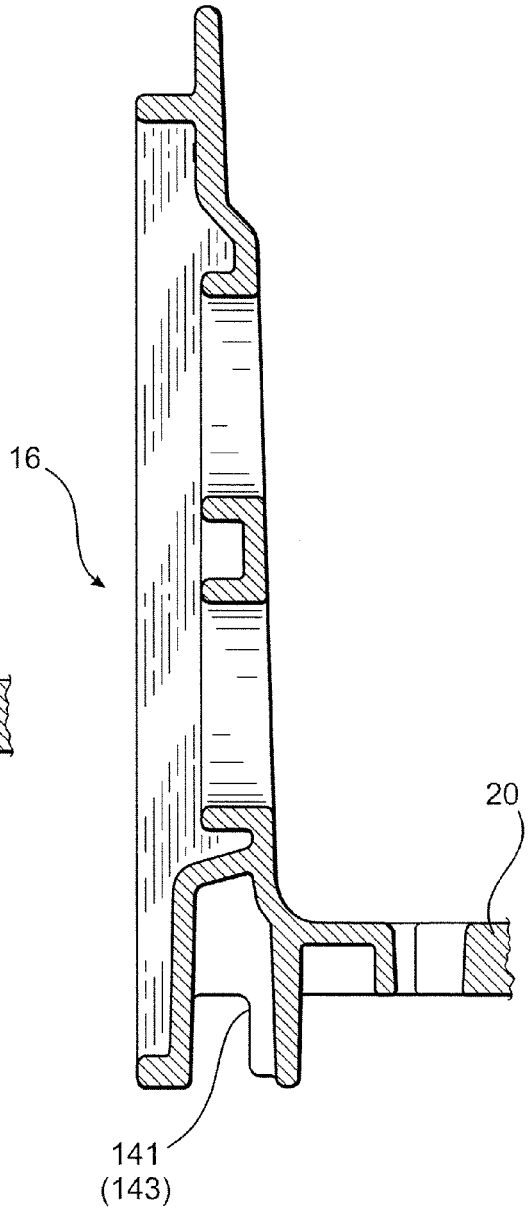

FIGS. 53-55 illustrate several cross sectional views of right sidewall 16 of basket 11, showing existing right channel rib 224 (which is substantially similar to left channel rib 226) in FIG. 53, revised right base channel projection 141 (which is substantially similar to revised left base channel projection 143) in FIG. 54, and right channel gator rib 232 (which is substantially similar to left channel gator rib 234) in FIG. 55.

The novel combination of ribs and projections (left and right channel ribs 226, 224; revised left and right base channel projections 141, 143; and left and right gator ribs 234, 236; hereinafter, collectively referred to as "rib collection"), substantially inhibits or prevents slipping of an upper basket 11' with respect to a lower basket 10 or 11 (when stacked in a 0° stacking configuration) especially when "checking in" or "gator jaw" is performed.

As known to those of ordinary skill in the industry of baked goods delivery, when baked goods are delivered, delivery personnel will sometimes carry 6-12 (and even more) baskets 10, 11 filled with baked goods. All of the baskets 10, 11 can each contain the same baked goods, or different baskets 10 can contain different baked goods. For example, in the latter case, a delivery person might make a delivery with ten baskets 10, 11: three contain packages of hot dog buns, three contain packages of hamburger buns, and the last four baskets 10, 11 contain packages of dinner rolls. The store owner will want to confirm the delivery, so the delivery person will tilt or lift each basket 10, 11 to show what is in the basket below the first one on top. This process is referred to as checking in, and the baskets in this position are referred to as being in the "gator jaw" position. Preferably, the delivery person will lift the baskets 10, 11 from either the left or right sides 18, 16. The storeowner can easily ascertain what is in the uppermost basket 10, 11, and then the delivery person "gator-jaws" the remaining ones, one at a time, to show what is in each basket. By the time the delivery person gets to the lowest basket 10, 11, he or she could be lifting 5, 6, 7 or even more baskets 10, 11 above that lowest one. Therefore, it is very important that the upper baskets 10', 11' do not slip off the lower (or lowest) baskets 10,11 during the checking-in process. Slipping, and therefore spillage of baked goods, is substantially inhibited or prevented during the checking-in process by interlocking the rib collection of upper basket 11' with left and right side wall ridges 34*a, b* of lower basket 10, 11.

FIG. 55 illustrates how right channel gator rib 232' substantially inhibits or prevents slippage when gator-jawing is taking place. FIGS. 53-55 are views from the rear of basket 10; in FIG. 55, upper basket 10', stacked in a 0° stacking configuration, is being lifted from left sidewall 18 (not shown) such that upper basket 10' pivots about lower basket 10 at lower right sidewall 16. If right channel gator rib 232' were not present on upper basket 10', then right sidewall ridge 34*b* of lower basket 10 would have a much greater space to move within upper right base channel 136', possibly causing upper basket 10' (and the additional upper baskets 10") to slip off of lower basket 10. Of course, as one of ordinary skill in the art of the present invention can appreciate, left channel gator rib 234' of upper basket 10' interfaces with left sidewall ridge 34*a* in substantially the same manner, inhibiting or preventing slipping and spillage if upper baskets 10" are lifted from right sidewall 16".

B. Dolly Transport

Referring back to FIGS. 11 and 56, a plurality of right bottom dolly ribs 228*a, b*, left bottom dolly ribs 230*a, b*, (hereinafter "dolly ribs"; see FIG. 11) and modified right bottom dolly ribs 229*a, b*, and modified left bottom dolly ribs 231*a, b* (hereinafter "modified dolly ribs") are shown (see FIG. 56). Dolly ribs 228, 230 interface with dolly 238 shown in FIGS. 67 and 68, upon which basket 10 can be placed, and substantially inhibit or prevent slipping of basket 10 with respect to the dolly. Similarly, modified dolly ribs 229, 231 are also designed to interface with dolly 238 to substantially inhibit or prevent slipping of basket 11 with respect to the dolly. According to a preferred embodiment of the present invention, modified ribs 229, 231 are about 33% longer in length than dolly ribs 228, 230.

Figure 69:
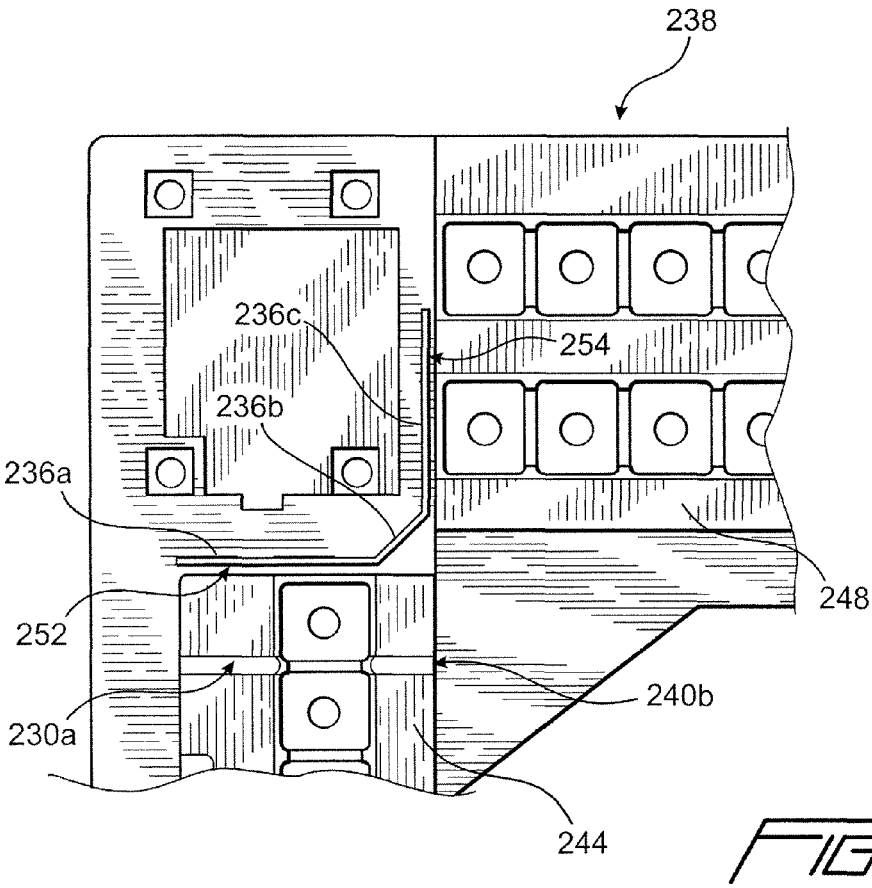
FIG. 69 illustrates a close-up top view of the dolly shown in FIG. 69 with several components of the baskets shown in FIGS. 1 and 62 super-imposed to illustrate stacking features according to an embodiment of the present invention.
Figure 66:
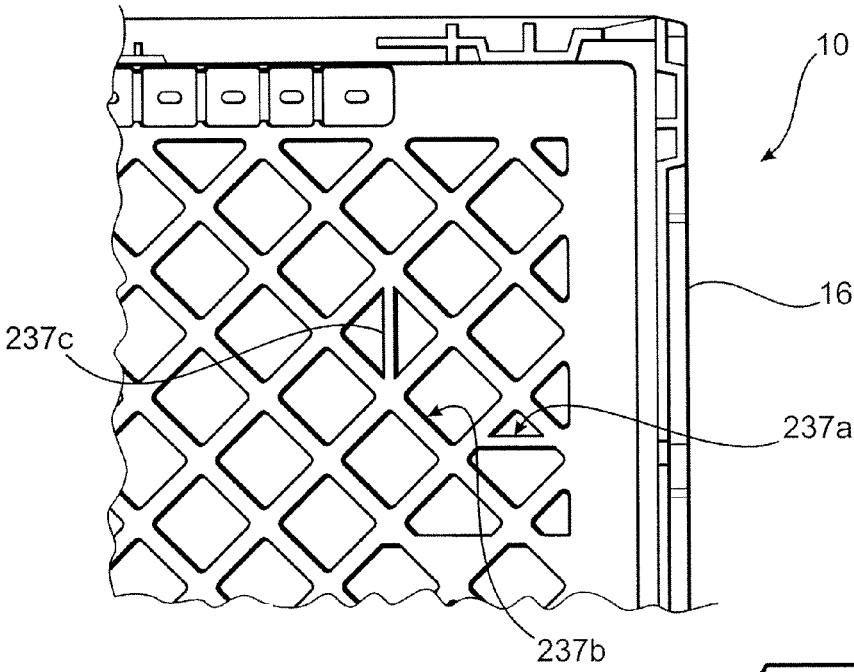
FIG. 66 illustrates a close-up top view of the basket shown in FIG. 62.
Figure 62:
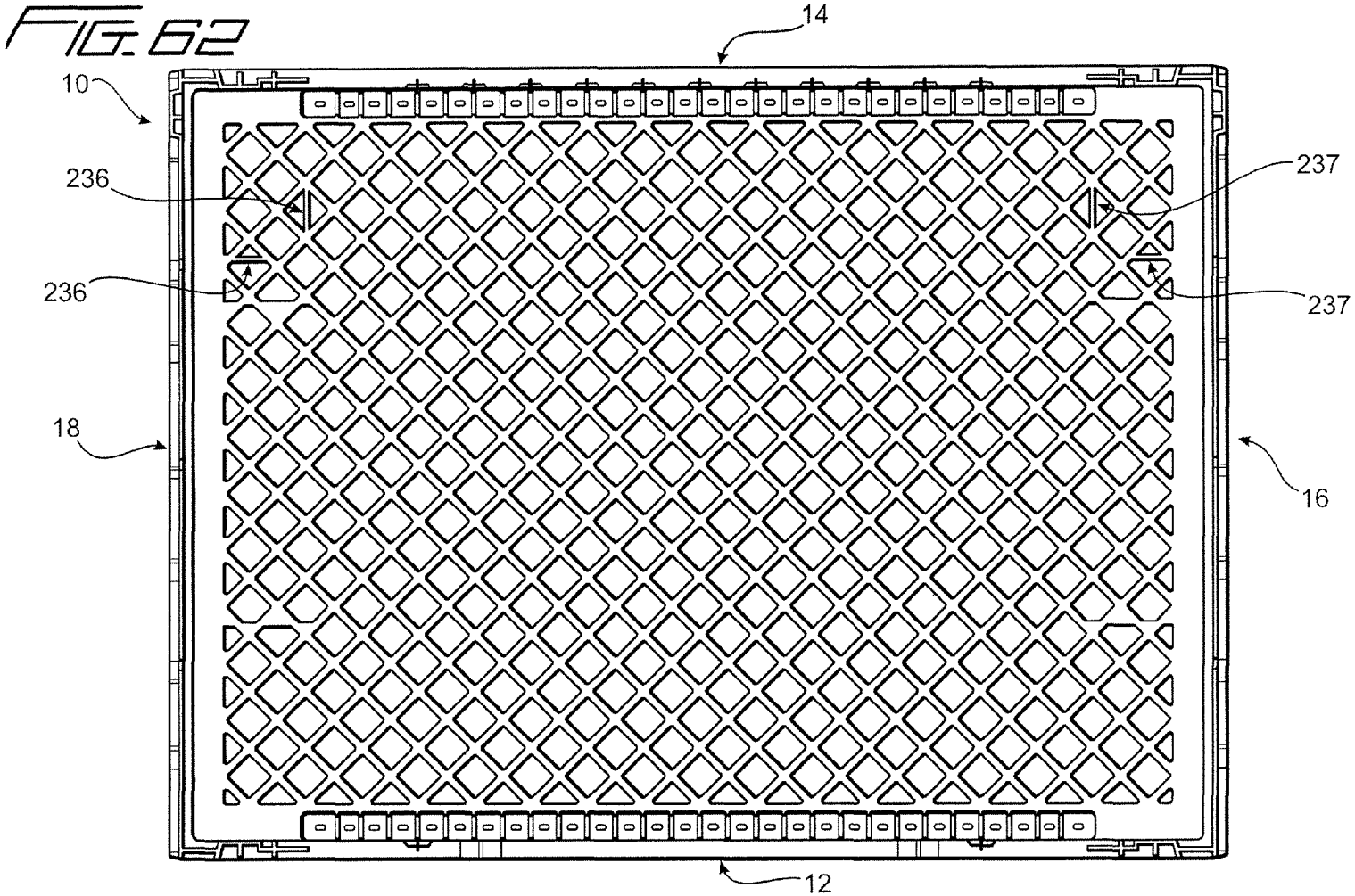
FIG. 62 illustrates a top view of the basket shown in FIG. 1 showing orthogonal dolly stacking ribs according to an alternative embodiment of the present invention.
Figure 63:
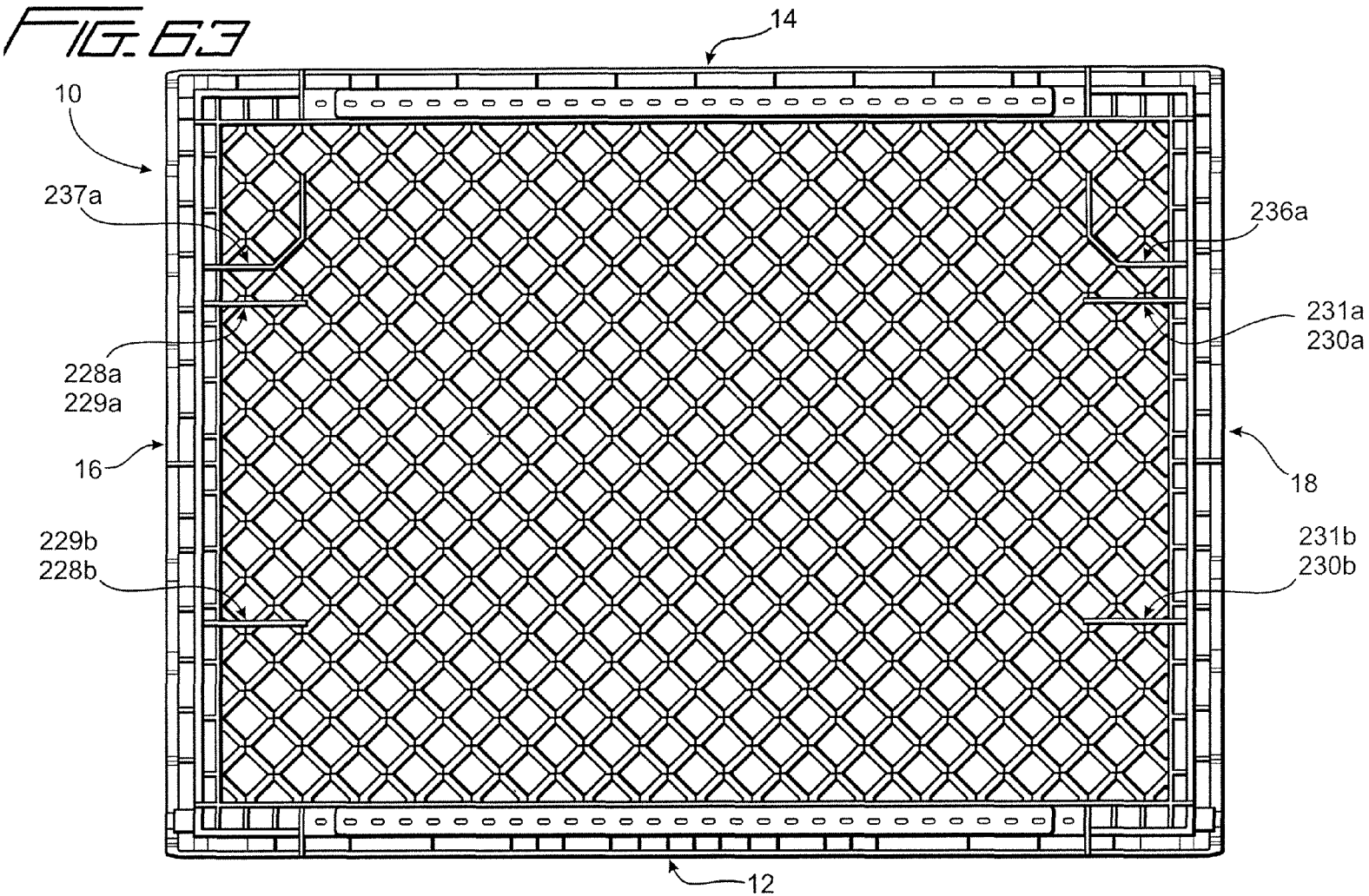
FIG. 63 illustrates a bottom view of the basket shown in FIG. 62.
Figure 64:
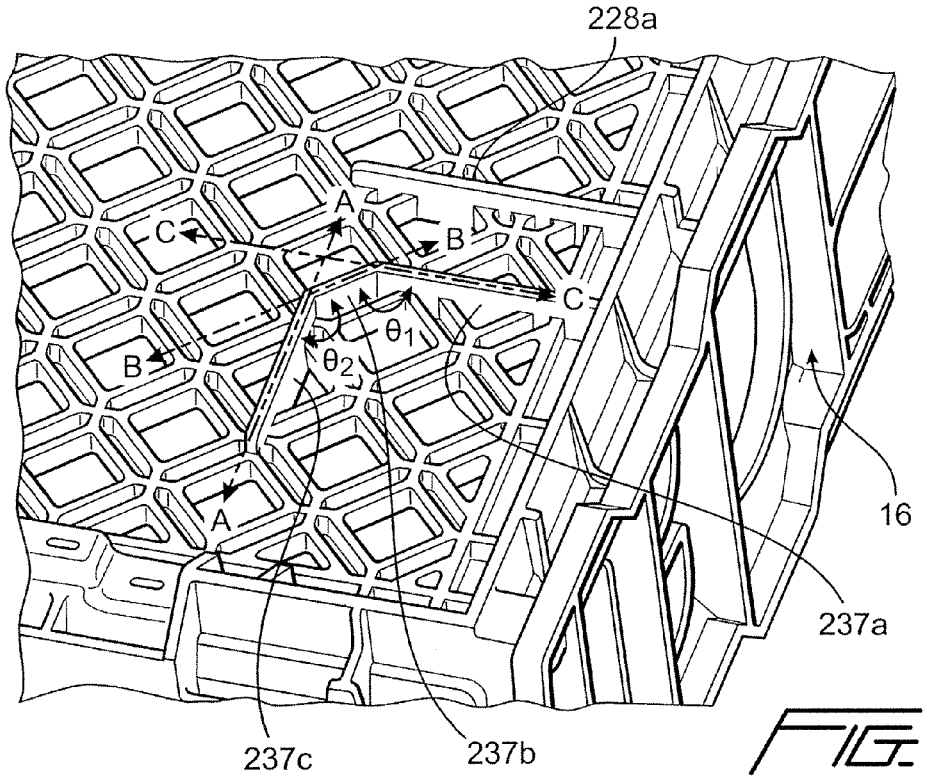
FIG. 64 illustrates a close-up bottom isometric view of the basket shown in FIG. 62.
Figure 65:
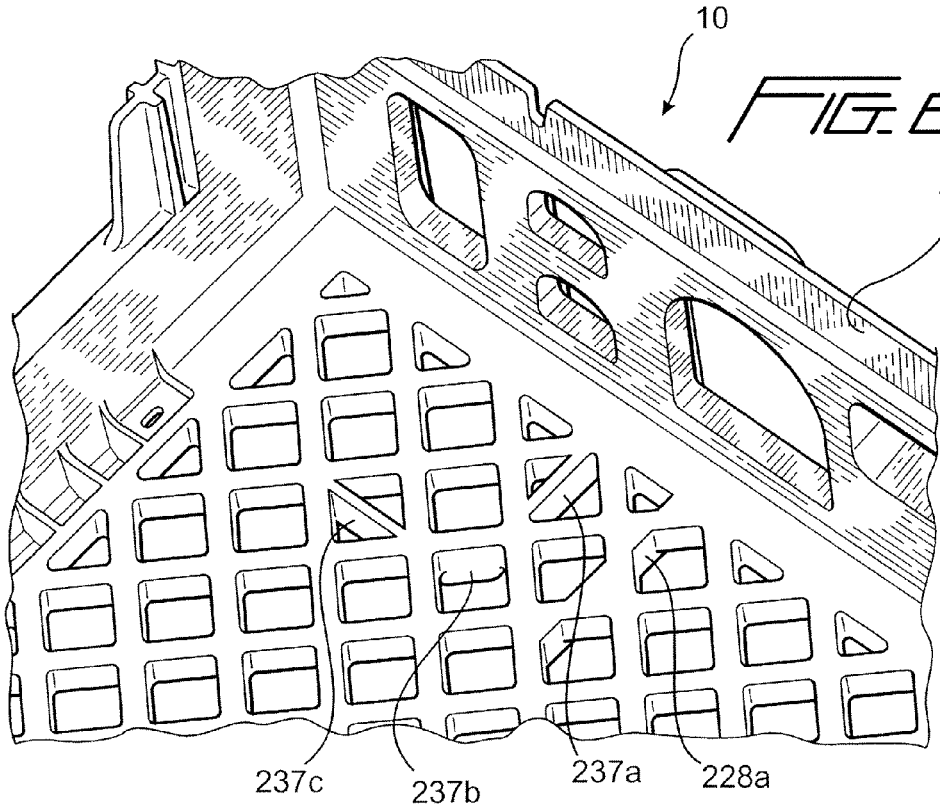
FIG. 65 illustrates a close-up top isometric view of the basket shown in FIG. 62.
Figure 67:
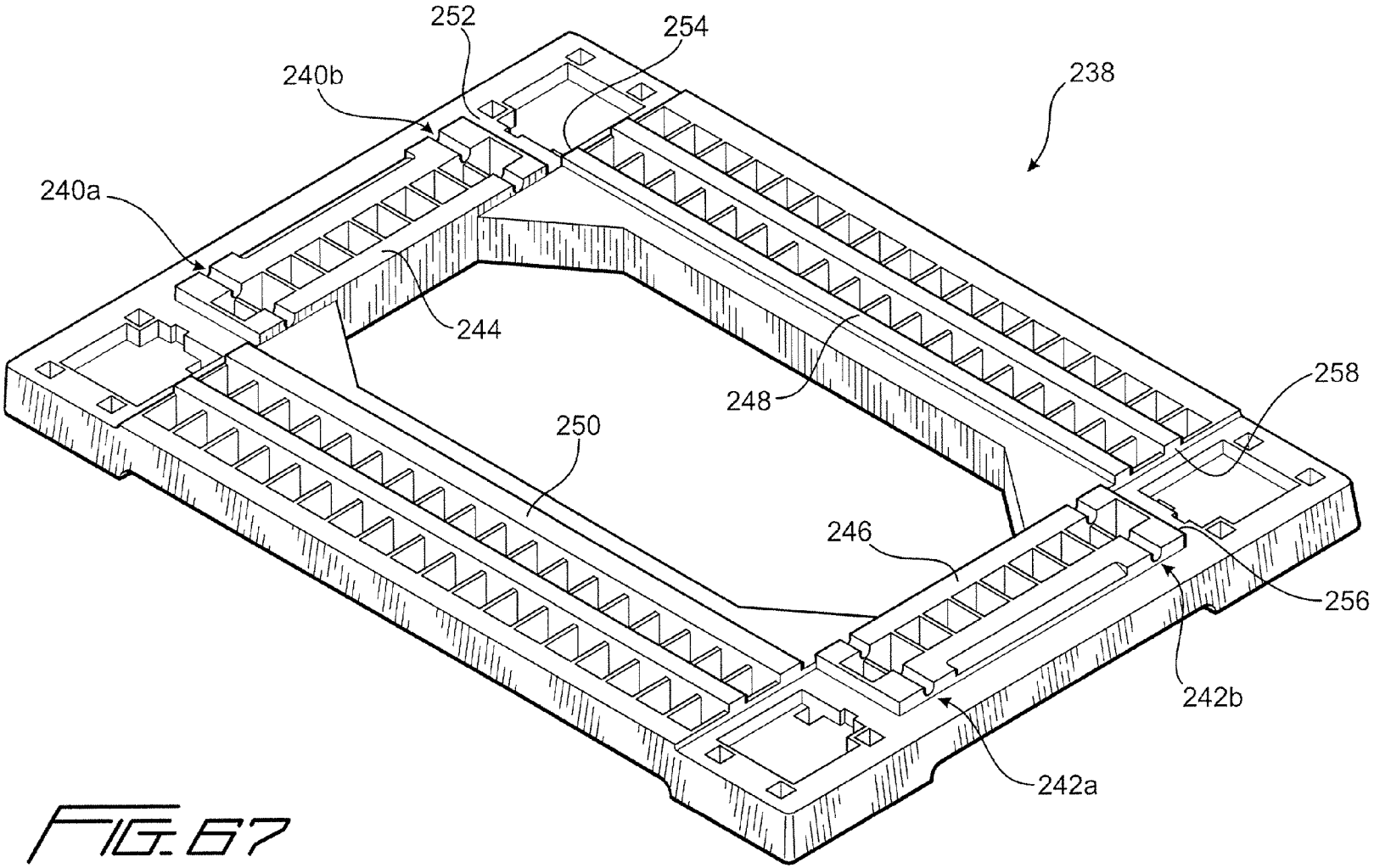
FIG. 67 illustrates a front isometric view of a dolly for use with the baskets shown in FIGS. 1 and 62 according to an embodiment of the present invention.
Figure 68:
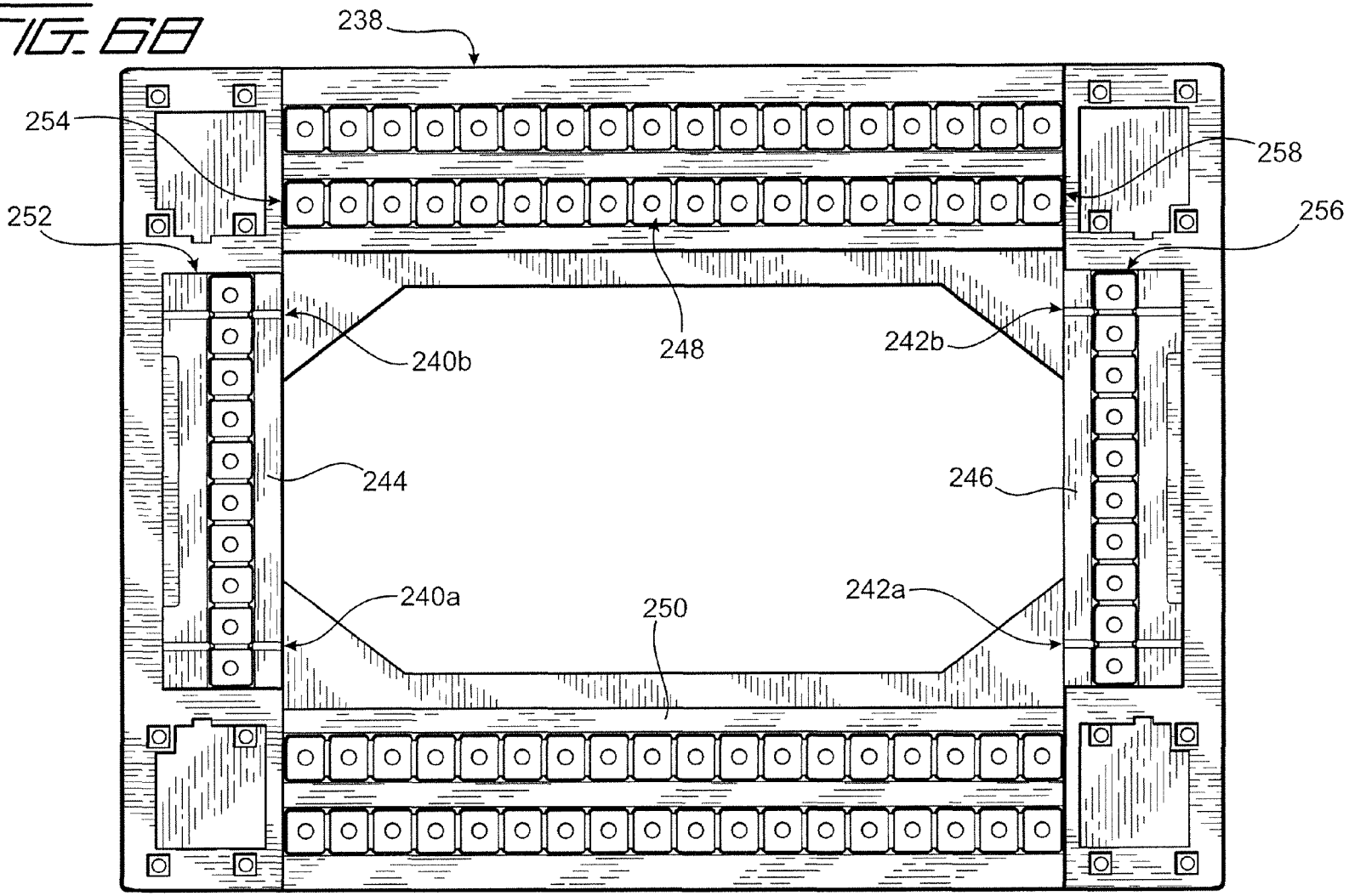
FIG. 68 illustrates a top view of the dolly shown in FIG. 67.

FIG. 62 illustrates a top plan view of basket 10 as shown in FIG. 1 showing orthogonal dolly stacking ribs 236*a, b* according to an alternative embodiment of the present invention. FIG. 63 illustrates a bottom plan view of the basket shown in FIG. 62; FIG. 64 illustrates a close-up bottom isometric view of the basket shown in FIG. 62; FIG. 65 illustrates a close-up top isometric view of the basket shown in FIG. 62; FIG. 66 illustrates a close-up top view of the basket shown in FIG. 62; FIG. 67 illustrates a front isometric view of a dolly for use with the baskets shown in FIGS. 1 and 62 according to an embodiment of the present invention; FIG. 68 illustrates a top view of the dolly shown in FIG. 67; and FIG. 69 illustrates a close-up top view of the dolly shown in FIG. 69 with several components of the baskets shown in FIGS. 1 and 62 superimposed to illustrate stacking features according to an embodiment of the present invention. As best shown in FIGS. 63 and 64, left orthogonal dolly stacking rib 236 and right orthogonal dolly stacking rib 237 each comprise three components. For ease of discussion, and to correspond to FIG. 64, only right orthogonal dolly stacking rib 237 will be discussed in detail. As those of ordinary skill in the art can appreciate, however, this discussion applies equally as well to left orthogonal dolly stacking rib 236. Right orthogonal dolly stacking rib 237 comprises three separate portions: first portion 237*a* that is substantially orthogonal to left and right side walls 18, 16 and that is substantially parallel to front and rear sidewalls 12, 14; second portion 237*b* that is substantially parallel to a floor ribs 22; and third portion 237*c* that is substantially orthogonal to front and rear sidewalls 12, 14, and that is substantially parallel to left and right side walls 18, 16.

First portion 237*a* of right orthogonal dolly stacking rib 237 joins second portion 237*b* at a first end of second portion 237*b* and at a first angle $\theta_1$. Third portion 237*c* of right orthogonal dolly stacking rib 237 joins second portion 237*b* at a second end of second portion 237*b* and at a second angle $\theta_2$. According to a preferred embodiment of the present invention, angles $\theta_1$ $\theta_2$ are substantially similar to each other, and range in value between about 130° and about 140°. According to an exemplary embodiment of the present invention, angles $\theta_1$ $\theta_2$ are substantially similar to each, and are about 135°. As one of ordinary skill in the art of the present invention can appreciate, however, angles $\theta_1$ $\theta_2$ need not be substantially similar, and can be any angle desired. Further, first and third portions 237*a, c* of right orthogonal dolly stacking rib 238 are substantially orthogonal to each other. Left and right orthogonal dolly stacking ribs 236, 237 fit against several components of dolly 238, shown in FIGS. 67-69, such that basket 10 is substantially retained by dolly 238 when stacked upon it. Left and right bottom dolly ribs 230, 228, and modified left and right dolly ribs 231, 229 and left and right orthogonal stacking ribs 236, 237 substantially inhibit or prevent any slippage in several directions between dolly 238 and basket 10.

Referring now to FIGS. 67, 68, dolly 238 comprises, among other additional features, left stacking block 244, right stacking block 246, rear stacking block 248 and front stacking block 250. Left stacking block 244 comprises front and rear left side stacking grooves 240*a, b*. Right stacking block 246 comprises front and rear right stacking grooves 242*a, b*. Left stacking block 244 further comprises rear wall left stacking block 252, and right stacking block 246 also further comprises rear wall right stacking block 256. Rear stacking block 248 comprises left wall rear stacking block 254 and right wall rear stacking block 258. As shown in FIG. 69, left bottom dolly rib 230*a* (shown superimposed on dolly 238) fits within rear left side stacking groove 240*b*. Similarly, modified left bottom dolly rib 231 a can also fit within rear left side stacking groove 240*b*, and the same applies to the right side of basket 10 and dolly 238. Furthermore, left bottom dolly rib 230*b* (located in closer proximity to front wall 12) fits within front left side stacking groove 240*a*, and modified left bottom dolly rib 231*b* also fits within front left side stacking groove 240*a*, and the same applies to the right side of basket 10.

Also shown in FIG. 69, is left orthogonal dolly stacking rib 236 superimposed on dolly 238 in a close up view of the left rear corner of dolly 238. First portion 236*a* of left orthogonal dolly stacking rib 236 fits substantially snugly against rear wall left stacking block 252 and third portion 236*c* of left orthogonal dolly stacking rib 236 fits snugly against left wall rear stacking block 254. Second portion 236*b* joins first and second portions 236*a, c* together. Similarly, although not shown, first portion 237*a* of right orthogonal dolly stacking rib 237 fits substantially snugly against rear wall right stacking block 256 and third portion 237*c* of right orthogonal dolly stacking rib 237 fits snugly against right wall rear stacking block 254. Second portion 237*b* joins first and second portions 237*a, c* together. The combination of left and right orthogonal dolly stacking ribs 236, 237, as well as right and left bottom dolly stacking ribs 228, 230, and modified right and left bottom dolly ribs 229, 231 and the manner in which they interface with dolly 238, as immediately described above, causes basket 10 to be substantially securely retained by dolly 238 such that baskets 10, 10', 10", and so on, will not come off dolly 238 when being transported.

VI. Lifting Features

Figure 58:
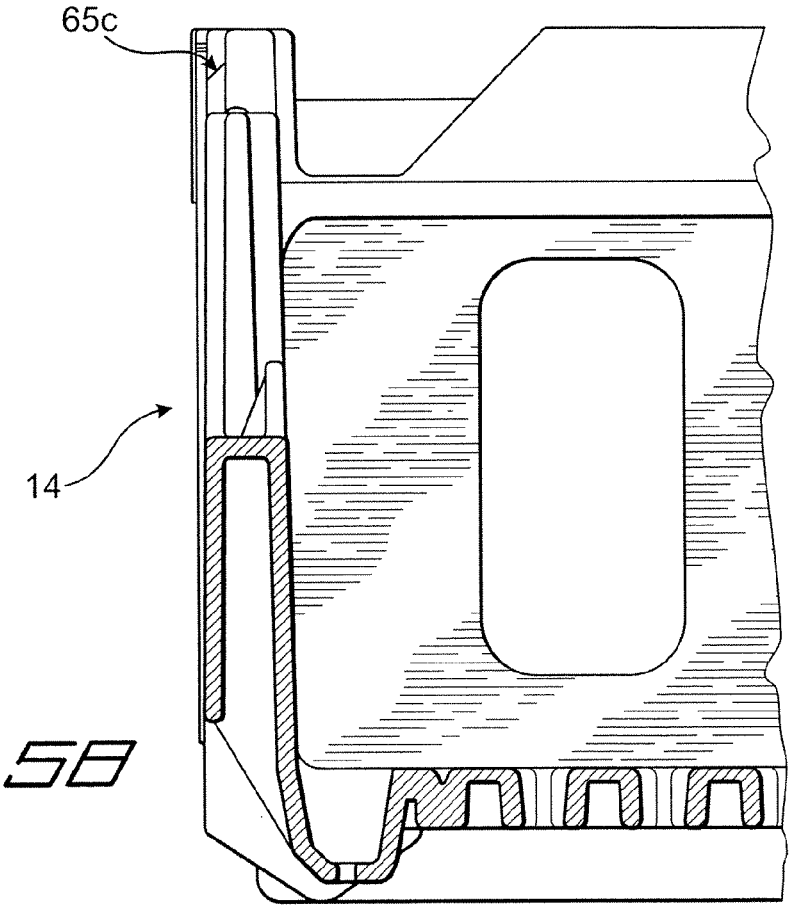
FIG. 58 illustrates a cross sectional view along lines A-A of FIG. 57.
Figure 57:
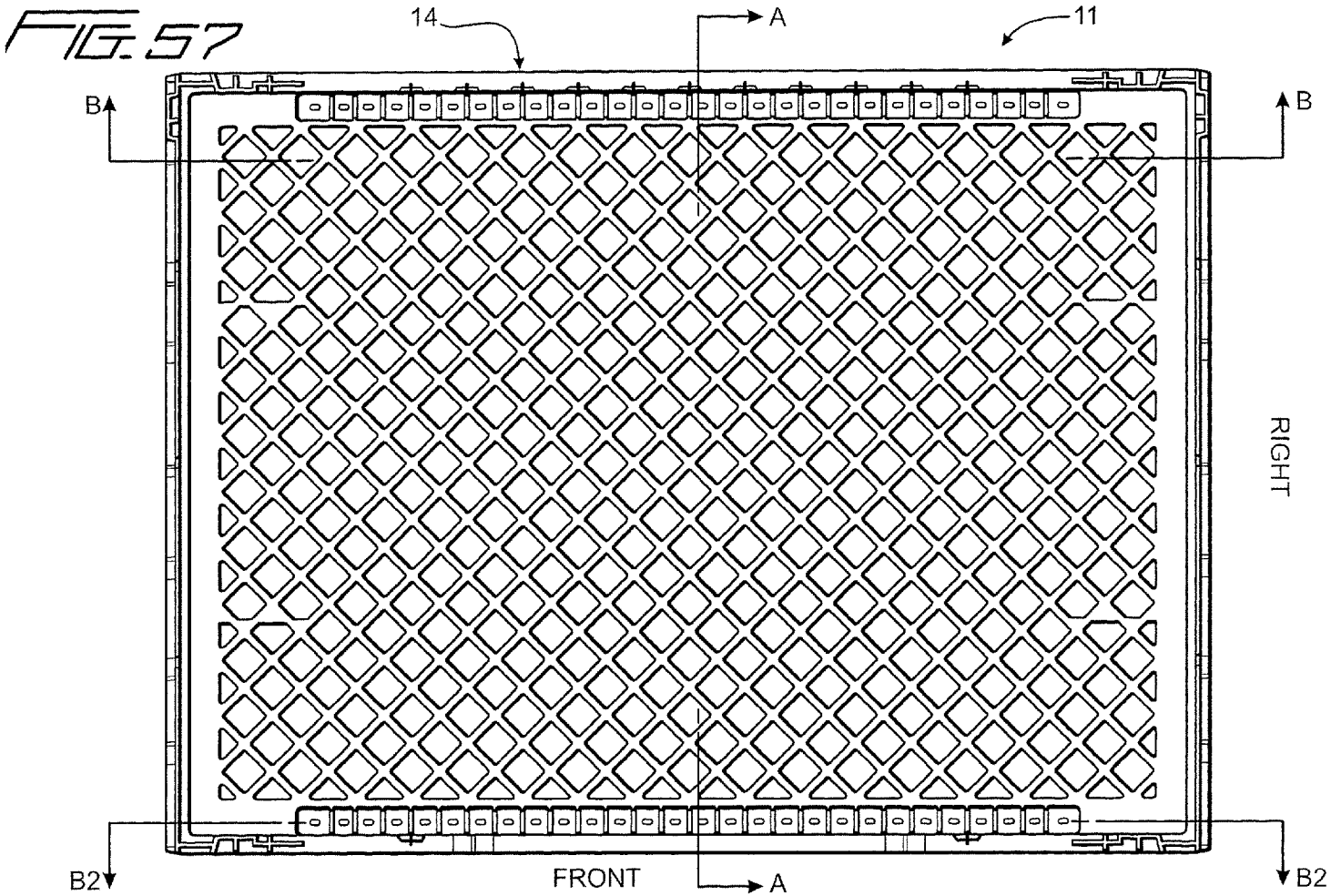
FIG. 57 illustrates a top plan view of the basket shown in FIG. 56.

FIG. 57 illustrates a top plan view of basket 11 according to an alternative embodiment of the present invention. FIG. 58 is a cross sectional view of rear wall 14 illustrating modified first load bearing ridge 65*c* along lines A-A of FIG. 57. FIG. 59 illustrates modified first load bearing ridge 65*c* as viewed from the rear of basket 11. Modified first load bearing ridge 65*d* is substantially similar to modified first load bearing ridge 65*c*, both of which are on rear wall 14. Modified first load bearing ridges 65*c,d* comprise an upper angled surface, preferably at about a 45° angle, that facilitates lifting of an upper basket 11' (or 10') when stacked on a lower basket 11.

When a user lifts upper basket 10', 11' at front wall 12, right side wall stacking feet 54*d'* and left side wall stacking feet 52*a'* (both of upper basket 10', 11'), pivots about right side wall stacking projection 106*d* and left side wall stacking projection 126*a* (both of lower basket 10, 11), respectively. The pivoting between the stacking feet of the upper basket and the stacking projections of the lower basket is substantially unrestricted. During the lifting, however, rear wall lower mounting supports 58*a, b'* of upper basket 10',11' also pivot (see FIG. 5). When upper basket 10',11' is lifted along front wall 12', rear wall lower mounting supports 58*a'*, b' pivots about first load bearing ridges 64*c,d* of lower basket 10,11. Because the top portion of first load bearing ridges 64*c,d* of lower basket 10,11 is substantially horizontal (see FIGS. 5 and 6), it is possible they will restrict rear wall lower mounting supports 58*a', b'* of upper basket 10',11'. Modified first load bearing ridges 65*c,d*, however, have a cut-away top portion at or about a 45° angle (See FIGS. 58 and 59), thereby substantially inhibiting or preventing any interference between upper basket 10',11' and lower basket 10,11 when upper basket 10' 11' is lifted and pivoted.

VII. Anti-Shifting Features

FIG. 60 is a close up bottom plan view of basket 11, and in particular, modified inner stacking rearward rail 57*b*. FIG. 56 illustrates the location of modified inner stacking frontward rails 51*a, b*, and modified inner rearward stacking rails 57*a, b*. FIG. 59 is a view of rear wall 14 and illustrates modified inner rearward stacking rail 57*b*. Modified inner frontward stacking rails 51*a, b* and modified inner rearward stacking rails 57*a, b* are substantially similar in dimensions (as shown in FIG. 59), and are substantially planar with the bottommost portion of inner stacking lateral rails 48*a, b*, and the plurality of stacking feet (54*a-d*, and 52*a-d*). Modified inner stacking forward rails 51*a, b* performs a substantially similar function as inner stacking forward rails 50*a, b*, and modified inner rearward stacking rails 57*a, b* perform a substantially similar function as inner rearward stacking rails 56*a, b*. That is, modified inner stacking forward rail 51*a, b* and modified inner stacking rearward rail 56*a, b* operate in conjunction with front wall stacking support areas 32*a, b* and rear wall stacking support areas 38*a, b* respectively to substantially inhibit or prevent forward and rearward shifting of baskets with respect to each other when in a 0 degree stacking configuration.

Referring to FIGS. 2 and 16, it can be seen that inner stacking forward rail 50*a'* of upper basket 10' is located inwardly from front wall stacking support 32*a*. The same is true for inner stacking forward rail 50*b'* of upper basket 10' and front wall stacking support area 32*b*, inner stacking rearward rail 56*a'* of upper basket 10' and rear wall stacking support area 38*a*, and inner stacking rearward rail 56*b'* of upper basket 10' and rear wall stacking support area 38*b*. Thus, modified inner stacking forward rail 51*a'* of upper basket 11' would also be located inwardly from front wall stacking support 32*a* (of lower basket 10 (or 11). The same is true for modified inner stacking forward rail 51*b'* and front wall stacking support area 36*b* (of lower basket 10 (or 11), modified inner stacking rearward rail 57*a'* and rear wall stacking support area 38*a* (of lower basket 10 (or 11), and modified inner stacking rearward rail 57*b'* and rear wall stacking support area 38*b* (of lower basket 10 (or 11).

VIII. Automated Stacking of Basket 10

Baskets 10 can be automatically stacking following return t processing centers by an automated stacking system. Once consumers or store employees have emptied basket 10 of baked product, baskets 10 are returned to the bakery for reuse. Occasionally, baskets 10 will have sticker applied to them that contain bar code information as well as other markings. The bar code information can include date of and location of manufacture, type of product contained, and shipping information, among other types of information. Regardless of what is on the stickers, they must be removed prior to reuse. In addition, it may be required to clean baskets 10 for sanitary purposes.

Hundreds of baskets 10 may need to be cleaned daily. As a result, automated cleaning systems have been developed that automatically transport baskets 10 through a cleaning system. Baskets 10 are placed into the automated cleaning system by operators, and cleaning occurs using high temperature water and cleaning agents. Following cleaning, operators or automated systems can manipulates the flaps into closed positions so that baskets 10 are ready to received baked product for containment and shipping. Photo-detection systems verify that the flaps are in the closed position prior to filling baskets 10 with baked products.

The present invention has been described with reference to certain exemplary embodiments thereof. However, it will be readily apparent to those skilled in the art that it is possible to embody the invention in specific forms other than those of the exemplary embodiments described above. This may be done without departing from the spirit and scope of the invention. The exemplary embodiments are merely illustrative and should not be considered restrictive in any way. The scope of the invention is defined by the appended claims and their equivalents, rather than by the preceding description.

All United States patents and applications, foreign patents, and publications discussed above are hereby incorporated herein by reference in their entireties into the detailed description portion of the specification.

What is claimed is:

1. A basket for shipping and storing goods, comprising:
a base;
a left sidewall and right sidewall,
each of the left sidewall and the right sidewall joined to and substantially perpendicular to the base, and
each of the left sidewall and the right sidewall substantially parallel to each other;
a front wall and rear wall, wherein,
the front wall and rear wall are joined to, and substantially perpendicular to, the base, and further wherein
the front wall and rear wall are substantially parallel to each other, and further wherein
the front wall and rear wall are joined to, and substantially perpendicular to, the left sidewall and right sidewall, and still further wherein,
the front wall and rear wall each include a top surface, and wherein, the front wall further includes
a window flap area configured to allow a user access to the stored goods,
and wherein
the front wall further includes
a movable window flap located in the window flap area, wherein the movable window flap is movable between a closed position for shipping and an open position for display and retrieval of stored goods wherein the movable window flap comprises:
a bail arm configured to rotate from an open position to a closed position, and vice versa, wherein,
the closed position comprises the bail arm being above the top surface of the front wall, and
the open position comprises the bail arm being recessed within the front wall,
wherein the bail arm comprises:
a bail arm rod configured to substantially inhibit goods from spilling out of the basket;
a first and second bail arm crank member, wherein
the first bail arm crack member is connected to a first end of the bail arm rod, and
the second bail arm crack member is connected to a second end of the bail arm rod;
a first and second bail arm outwardly turned portion, wherein
the first bail arm outwardly turned portion is connected to the first bail arm member, and the second bail arm outwardly turned portion is connected to the second bail arm member, and wherein the first and second bail arm outwardly turned portion are configured to recess into the front wall of the basket; and a first and second bail arm nipple, wherein the first bail arm nipple is connected to the first bail arm outwardly turned portion, and the second bail arm nipple is connected to the second bail arm outwardly turned portion, and wherein the first and second bail arm nipples are configured to rotationally and slidingly engage the basket such that the bail arm can rotate from a closed upper position and slide downwardly and rotationally to an open lower recessed position, and further wherein, the first and second bail arm nipples are further configured to rotationally and slidingly engage the basket such that the bail arm can rotate from an open lower position and slide upwardly and rotationally to a closed upper position.

2. The basket according to claim 1, wherein the bail arm rod comprises:

a plurality of bail arm knobs configured to allow a user to grip the bail arm and rotate it upwardly or downwardly.

3. The basket according to claim 1, wherein the bail arm is configured to recess substantially wholly within an outer perimeter of the basket.

* * * * *